US006091328A

United States Patent [19]

Ichikawa et al.

[11] Patent Number: 6,091,328

[45] Date of Patent: Jul. 18, 2000

[54] FIRE ALARMING SYSTEM

[75] Inventors: Nobuyuki Ichikawa; Eiji Hirooka; Keiichi Takahashi; Kenji Takeyoshi, all of Tokyo, Japan

[73] Assignee: Nohmi Bosai Ltd., Tokyo, Japan

[21] Appl. No.: 08/826,759

[22] Filed: Mar. 24, 1997

[30] Foreign Application Priority Data

Mar. 29, 1996 [JP] Japan ..... 8-075970

[51] Int. Cl.[7] ..... G08B 29/00

[52] U.S. Cl. ..... 340/506; 340/505; 340/825.08; 340/825.2; 340/825.21; 340/825.52

[58] Field of Search ..... 340/501, 505, 340/517, 519, 520, 521, 310.06, 525, 539, 825.07, 825.08, 825.09, 825.1, 825.11, 825.12, 825.13, 825.52, 825.47, 825.2, 825.21

[56] References Cited

U.S. PATENT DOCUMENTS 5,635,904 6/1997 Takahashi et al. ..... 340/506

*Primary Examiner*—Daryl Pope

*Attorney, Agent, or Firm*—Wenderoth, Lind & Ponack, L.L.P.

[57] ABSTRACT

A fire alarming system includes a plurality of terminal devices including fire sensors, transmitters, manual boxs, and/or other devices to be controlled; and a receiving device to which the plurality of terminal devices are connected. A great number of terminal devices with a manual box are connected to the receiving device. When a plurality of manual boxs are activated at the same time, the terminal devices corresponding to the activated manual boxs can be called at the same time without encountering a collision among returning-back signals transmitted from these terminal devices. That is, when a plurality of manual boxs are activated at the same time, the signal of only one of the plurality of activated manual boxs can arrive at the receiving device.

6 Claims, 26 Drawing Sheets

(1) SYNC SIGNAL FROM THE RECEIVING DEVICE (2) ADDRESS SIGNAL GENERATED BY A MANUAL BOX $P_A$ WITH AN ADDRESS OF 62

(3) ADDRESS SIGNAL GENERATED BY A MANUAL BOX $P_B$ WITH AN ADDRESS OF 64

(4) ADDRESS SIGNAL GENERATED BY A MANUAL BOX $P_C$ WITH AN ADDRESS OF 160

(5) SIGNAL ON THE SIGNAL LINE 3
4
SC1 = SS
S422
YES
NO
S437
ERROR HANDLING
S423
fx = 0
YES
NO
S438
RESET fx TO 0
DISABLE RECEIVING OPERATION
S424
m = m + 1
S425
S426
m < 10h
YES
1
NO
S427
Tslt < Tp
NO
YES
S428
ENABLE RECEIVING OPERATION
S429
TRANSMIT MANUAL BOX CALLING PULSE VIA TRX1
DATA FROM A MANUAL BOX ARRIVED?
S430
NO
S439
Tslt > Tep
NO
YES
YES
S431
STORE ADp IN RAM 15
S432
INDICATE THAT A MANUAL BOX IS ACTIVATED
S433
INCREMENT CM2 BY 1
RETURN

FIRE ALARMING SYSTEM

BACKGROUND OF THE INVENTION

1. Field of the Invention

The present invention relates to a fire alarming system.

2. Description of the Related Art

In a conventional fire detection system, a plurality of terminal devices such as a fire sensor, a transmitter, a manual box, or other devices to be controlled are connected to a fire alarming signal receiving device, and each terminal device is assigned its own address. The fire alarming signal receiving device calls terminal devices one after another according to the addresses. At a time, only the called terminal device can transmit information about itself (for example a fire alarming signal) to the fire alarming signal receiving device. This technique is known as polling. In this technique, a plurality of alarm signal lines are connected to the fire alarming signal receiver wherein a plurality of terminal devices are connected to each alarm signal line, and thus a great number of terminal devices are connected to the fire alarming signal receiver. The fire alarming signal receiving device calls these terminal devices one after another via a data processor provided in the fire alarming signal receiving device and acquires information about for example an event of a fire from each terminal device.

In the polling technique, however, any terminal device cannot send information to the fire alarming signal receiving device until it is called by the fire alarming signal receiving device. The calling period increases with the increase in the number of terminal devices connected to the alarm signal lines. If the terminal devices include such a device which should transmit information to the fire alarming signal receiving device in a predetermined time period after the event of information at that device, the maximum number of terminal devices which are allowed to be connected to the signal lines is limited by the above predetermined time period.

A specific example of a terminal device which should transmit information in a limited time period is a manual box. When a fire occurs, if one presses a button or the like of a manual box, the manual box transmits an alarm signal to the fire alarming signal receiving device. The fire alarming signal receiving device transmits a response signal to the manual box thereby indicating that the fire alarming signal receiving device has received the alarm signal. If the manual box receives the response signal, the manual box turns on a response lamp or the like provided on the manual box thereby indicating that the alarm signal was generated by that manual box.

In the worst case, the time required for the response lamp of the manual box to be turned on after the manual box was activated becomes as long as one polling period. If the waiting time from the activation of the manual box to the turning-on of the response lamp is so long, the person, who activated the manual box, will wonder if the fire alarming system is in correct operation. To reduce the waiting time to a desirable level, it is required that the number of terminal devices connected to one signal line be limited to a not large value.

One known technique to ease the above limitation is as follows. A fire alarming signal receiving device sequentially calls a plurality of terminal devices connected to signal lines extending from the fire alarming signal receiving device and acquires information about the status of each terminal device wherein a higher transmission priority is given to the particular information of terminal devices having a manual box and the information of these terminal devices is transmitted before other information. If the fire alarming signal receiving device receives the particular kind of information from a manual box, fire alarming signal receiving device preferentially calls those terminal devices having a manual box before calling other terminal devices and determines which manual box has been activated.

In the conventional technique, as described above, when the fire alarming signal receiving device receives the particular kind of information from a terminal device having a manual box, the fire alarming signal receiving device calls the terminal devices having a manual box one by one to determine which manual box has been activated. Therefore, the fire alarming signal receiving device still requires a long time to determine which terminal device having a manual box has been activated, and thus the terminal device still requires a long time to turn on a lamp for indicating that the fire alarm signal has arrived at the fire alarming signal receiving device, in particular when there are a great number of terminal devices having a manual box.

One possible technique to solve the above problem is to call at the same time all terminal devices having a manual box instead of calling them one by one when the fire alarming signal receiving device receives the particular kind of information from a terminal device having a manual box. In response to the call from the fire alarming signal receiving device, the terminal device whose manual box is in an activated state transmits the signal to the fire alarming signal receiving device. Thus, it is possible to reduce the time from when the manual box is activated until the terminal device turns on the lamp to indicate that the fire alarm signal has arrived at the fire alarming signal receiving device.

However, the above modification leads to another problem. That is, if a plurality of manual boxs are activated at substantially the same time, the terminal devices having these manual boxs respond at the same time. As a result, signals collide with each other, and the fire alarming signal receiving device cannot determine correctly which manual box have been activated.

Furthermore, in the conventional polling technique, the data transmission rate over the alarm signal line should be high enough to acquire the information from a large number of terminal devices in a limited time period as short as for example 5 sec. Therefore, the transmission line is required to have a large number of parallel bit lines, which result in an increase in cost.

In a known technique proposed to solve the above problem, the plurality of terminal devices are divided into groups and an idle period is provided between signals calling the adjacent groups so that in the idle period a terminal device can transmit an interrupt signal to the fire alarming signal receiving device wherein it is possible to determine which group the terminal device belongs to from the interrupt signal. If the fire alarming signal receiving device receives an interrupt signal, the fire alarming signal receiving device calls, one by one, preferentially the terminal devices belonging to the group determined from the interrupt signal.

However, in this polling technique in which if a terminal device detects an event of a fire, it transmits in an idle period to the fire alarming signal receiving device an interrupt signal with information (such as a group number) indicating which group the terminal device belongs to, and the fire alarming signal receiving device calls the terminal devices in that group one by one, still a long time is required to determine which terminal device has detected the event of the fire, in particular when each group includes a large number of terminal devices.

A fire alarm/security system is also known in which a fire alarming signal receiving device polls terminal devices such as a fire sensor, a smoke exhausting system, a fire extinguishing system, and a burglar alarm system, or transmitters connected to these terminal devices, and the called terminal devices transmit the information representing the status to the fire alarming signal receiving device whereby the fire alarming signal receiving device acquires the monitored information. In this fire alarm/security system, control information is transmitted to the terminal devices called by the fire alarming signal receiving device.

In this type of fire alarm/security system, there is a possibility that an error occurs during the transmission between the fire alarming signal receiving device and the terminal devices. For example, there is a possibility that an area where no fire occurs is regarded as having a fire in error. Another possibility is that a terminal device concludes in error that it has received a control command from the fire alarming signal receiving device and the terminal device activates a smoke exhausting system or a fire extinguishing system.

In the conventional fire alarm/security system, to avoid the above problem arising from the error in the transmission between the fire alarming signal receiving device and the terminal devices, the fire alarming signal receiving device generates a primary sum code by adding together an address code and a command code, and transmits the resultant primary sum code to the terminal devices. The terminal devices produce a first sum code by adding the address code and the command code received from the fire alarming signal receiving device. If the obtained first sum code is equal to the received primary sum code, the terminal device regards the signal received from the fire alarming signal receiving device as valid. On the other hand, each terminal device calculates the sum of the returning-back data, the address code, the command code, and the primary sum code thereby producing a secondary sum code, and transmits the resultant secondary sum code together with the returning-back data, address code, and command code to the fire alarming signal receiving device. The fire alarming signal receiving device calculates the sum of the returning-back data, the address code, and the command code received from the terminal device as well as the primary sum code produced by the fire alarming signal receiving device thereby producing a second sum code. If the obtained second sum code is equal to the received secondary sum code, the fire alarming signal receiving device concludes that the terminal device has correctly received the address code and the command code transmitted by the fire alarming signal receiving device.

In the above conventional system, each terminal device has a signal transmission/reception circuit (including a parallel-to-serial converter). If an active bit is input to the signal transmission/reception circuit, it is converted by the circuit into a low-level signal and output over the transmission line. On the other hand, if an inactive bit is input to the signal transmission/reception circuit, it is converted by the circuit into a high-level signal and output over the transmission line. If a collision occurs between a low-level signal and a high-level signal on the transmission line, the result is a high-level signal.

If the fire alarming signal receiving device receives a low-level signal via the transmission line, the received low-level signal is converted into an active bit by a signal transmission/reception circuit (including a parallel-to-serial converter) provided in the fire alarming signal receiving device. On the other hand, if the fire alarming signal receiving device receives a high-level signal via the transmission line, the received high-level signal is converted into an inactive bit by the signal transmission/reception circuit in the fire alarming signal receiving device. Therefore, if a collision occurs between a low-level signal and a high-level signal on the transmission line, the fire alarming signal receiving device receives the high-level signal. The received high-level signal is converted into an inactive bit by the signal transmission/reception circuit provided in the fire alarming signal receiving device and acquired into the fire alarming signal receiving device. In the above conventional system, as described above, if an active bit and an inactive bit are transmitted at the same time over the transmission line from different terminal devices such as fire sensors, the inactive bit is acquired into the fire alarming signal receiving device.

In such the fire alarm/security system according to the conventional technique, if an equal address is assigned by mistake to two different fire sensors, and if one of the two fire sensors transmits a fire alarm signal as the returning-back data while the other fire sensor having the same address transmits information (non-fire signal) indicating that the fire sensor is in a normal status, the above fire alarm signal cannot arrive at the fire alarming signal receiving device. Another possible problem is that when an equal address is assigned by mistake to two different fire sensors, the second sum code can be equal to the secondary sum code, and thus it is impossible to detect the event of the above transmission error.

For example, when the address AD and the commands CM1 and CM2 are FFh, 01 h, and 00 h, respectively, in hexadecimal form (11111111, 00000001, and 00000000 in the form of 8-bit binary numbers; each hexadecimal number is represented with an "h" at its end), if one of the two fire sensors having the same address transmits returning-back data D1 having a value of 01 h (00000001 in the form of an 8-bit binary number) indicating that a fire occurs while the other fire sensor having the same address transmits returning-back data D2 having a value of 00 h (00000000 in the form of an 8-bit binary number) indicating the normal status, then the result will be as follows. The primary sum code PS is given as 00 h as a result of the calculation described above. The secondary sum code SS1 for the returning-back data D1 indicating the event of a fire becomes 01 h. The secondary sum code SS2 for the returning-back data D2 indicating the normal status becomes 00 h. Because the same address is assigned to the two terminal devices, the returning-back data D1 and D2 are transmitted at the same time, and the secondary sum codes SS1 and SS2 are also transmitted at the same time.

As a result, collision occurs on the signal line L between the returning-back data D1 and D2. Similarly, the secondary codes SS1 and SS2 collide with each other on the signal line. When a collision occurs between 01 h and 00 h, only the signal corresponding to 00 h can propagate along the signal line for the following reason. Bits having a value of 0 become high on the transmission line while those bits having a value of 1 become low on the transmission line. If a low-level signal and a high-level signal are applied to the signal line at the same time, the resultant signal level on the signal line becomes high. Therefore if 01 h and 00 h, which can be represented as 00000001 and 00000000, respectively, in the form of 8-bit binary numbers, are applied to the signal line at the same time, the collision between a "0"-bit and a "1"-bit results in a "0"-bit on the signal line, and thus only the 00 h signal can exist on the signal line. As a result it seems that 00 h is transmitted for both the returning-back data and the secondary sum code. Therefore, the fire alarming signal receiving device regards the received returning-back data as 0 h, and calculates the second sum code as 00 h according to the calculation rule described above. Thus the calculated second sum code becomes equal to the received apparent secondary sum code. Thus the fire alarm signal cannot arrive at the fire alarming signal receiving device. This is a serious problem in the conventional system. Besides, the fact that such the error has occurred during the transmission cannot be detected.

Furthermore, in the polling operation according to the conventional technique, if the fire alarming signal receiving device detects a transmission error for a terminal device or a group containing that terminal device, the fire alarming signal receiving device stops polling other terminal devices or groups including other terminal devices, and polls again the terminal device which has encountered the transmission error or the group including that terminal device. If a transmission error is detected again in that polling operation, the fire alarming signal receiving device concludes that a transmission error has really occurred and makes an indication of the event of the transmission error.

In the above conventional technique, however, the repetition of the polling operation required for confirming a transmission error causes a delay in the operation of acquiring status information from other terminal devices or the group including that terminal device. This causes an increase in the total time required to poll the terminal devices in the fire alarm/security system.

SUMMARY OF THE INVENTION

It is an object of the present invention to provide a fire alarming system including a great number of terminal devices having a manual box, and capable of calling at the same time all terminal devices whose manual box has been activated and determining which manual box has been activated, without encountering a collision between signals transmitted from the terminal devices.

It is another object of the present invention to provide a fire alarming system including a great number of terminal devices having a manual box belonging to one group, and capable of quickly determining which terminal device has generated a signal indicating an event of an abnormal state such as a fire.

It is still another object of the present invention to provide a fire alarming system in which terminal devices can transmit a fire alarm signal to a fire alarming signal receiving device without encountering an error even when an equal address is assigned to different terminal devices.

It is another object of the present invention to provide a fire alarming system capable of preventing a wrong alarm from being generated by a transmission error and capable of detecting an event of a transmission error and providing an indication of the event of the transmission error in which when a transmission error occurs, the error can be handled without causing an increase in the total time required for polling the terminal devices of the fire alarming system.

According to one aspect of the present invention, there is provided a fire alarming system in which a plurality of terminal devices including fire sensors, transmitters, manual boxs, and/or other devices to be controlled are connected to a receiving device, said fire alarming system being characterized in that when a plurality of said manual boxs are activated and thus they generate a fire alarming signal at the same time, only the signal generated by one of said plurality of activated manual boxs is transmitted to said receiving device.

With the above arrangement, it is possible to determine which terminal device having a manual box is activated without encountering a collision among returning-back signals transmitted from the terminal devices when all terminal devices having a manual box in an activated state are called at the same time.

According to another aspect of the present invention, there is provided a fire alarming system in which a plurality of terminal devices including fire sensors, transmitters, manual boxs, and/or other devices to be controlled are connected to a receiving device, said fire alarming system being characterized in that said plurality of terminal devices are divided into a plurality of groups; said receiving device performs a polling operation group by group; and in a time period between the transmission of a polling signal to a particular group of said plurality of groups and the transmission of a polling signal to the next group, said receiving device receives information in a time-division fashion from a plurality of terminal devices belonging to said particular group.

With the above arrangement of the present embodiment, it is possible to quickly determine which terminal device has detected an event of an abnormal state even if there are a great number of terminal devices in one group.

According to a further aspect of the present invention, there is provided a fire alarming system in which:

a fire alarming signal receiving device generates a primary sum code from an address code and a command code to be transmitted to terminal devices; and transmits the address code, the command code (CM), and the primary sum code;

each terminal device generates a first sum code from the address code (AD) and the command code received from the fire alarming signal receiving device; compares the first sum code with the primary sum code received from the fire alarming signal receiving device; generates a secondary sum code from a returning-back data, the address code, and the command code; and transmits the returning-back data and the secondary sum data to the fire alarming signal receiving device; and the fire alarming signal receiving device generates a second sum code from the returning-back data, the address code, and the command code received from the terminal device; and compares the second sum code with the secondary sum code received from the terminal device.

With the above arrangement, the terminal devices can transmit a fire alarm signal to the fire alarming signal receiving device without encountering an error even when an equal address is assigned to different terminal devices. Furthermore, it is possible to detect an event of such an error.

According to still another aspect of the present invention, there is provided a fire alarming system in which a plurality of terminal devices such as fire sensors, transmitters, manual boxs, and/or other devices to be controlled are connected to a fire alarming signal receiving device, the fire alarming system further including: transmission error detecting means for detecting a transmission error when any of the plurality of terminal devices has a transmission error; storage means for storing the number of times that the transmission error occurs; and transmission error indicating means for indicating that a transmission error has occurred when the number of times that the transmission error occurs stored in the storage means becomes greater than a predetermined number. With the above arrangement according to the invention, it is possible to prevent a wrong alarm from being generated by a transmission error. It is also possible to detect an event of a transmission error and provide an indication of the event of the transmission error. When a transmission error occurs, the error can be handled without causing an increase in the total time required for polling the terminal devices of the fire alarming system.

According to a further aspect of the invention, there is provided a fire alarming system in which a plurality of terminal devices including fire sensors, transmitters, manual boxs, and/or other devices to be controlled are connected to a receiving device, the fire alarming system being characterized in that even when some terminal device has a transmission error, a polling operation is continued without being terminated. With the above arrangement according to the invention, it is possible to prevent a wrong alarm from being generated by a transmission error. It is also possible to detect an event of a transmission error and provide an indication of the event of the transmission error. When a transmission error occurs, the error can be handled without causing an increase in the total time required for polling the terminal devices of the fire alarming system.

According to another aspect of the present invention, there is provided a fire alarming system in which a plurality of terminal devices including fire sensors, transmitters, manual boxs, and/or other devices to be controlled are connected via a signal line to a receiving device, and the fire alarming signal receiving device polls the plurality of terminal devices thereby acquiring terminal device information from the terminal devices, making decision, displaying information, and/or controlling the terminal devices, the fire alarming system being characterized in that it further includes: first signal inverting means disposed at a node between the fire alarming signal receiving device and the signal line; and second signal inverting means disposed at a node between each terminal device and the signal line. The above arrangement of the invention ensures that the terminal devices can transmit a fire alarm signal to the fire alarming signal receiving device without encountering an error even when an equal address is assigned to different terminal devices. Furthermore, it is possible to detect an event of such an error.

DESCRIPTION OF THE PREFERRED EMBODIMENTS

Figure 1:
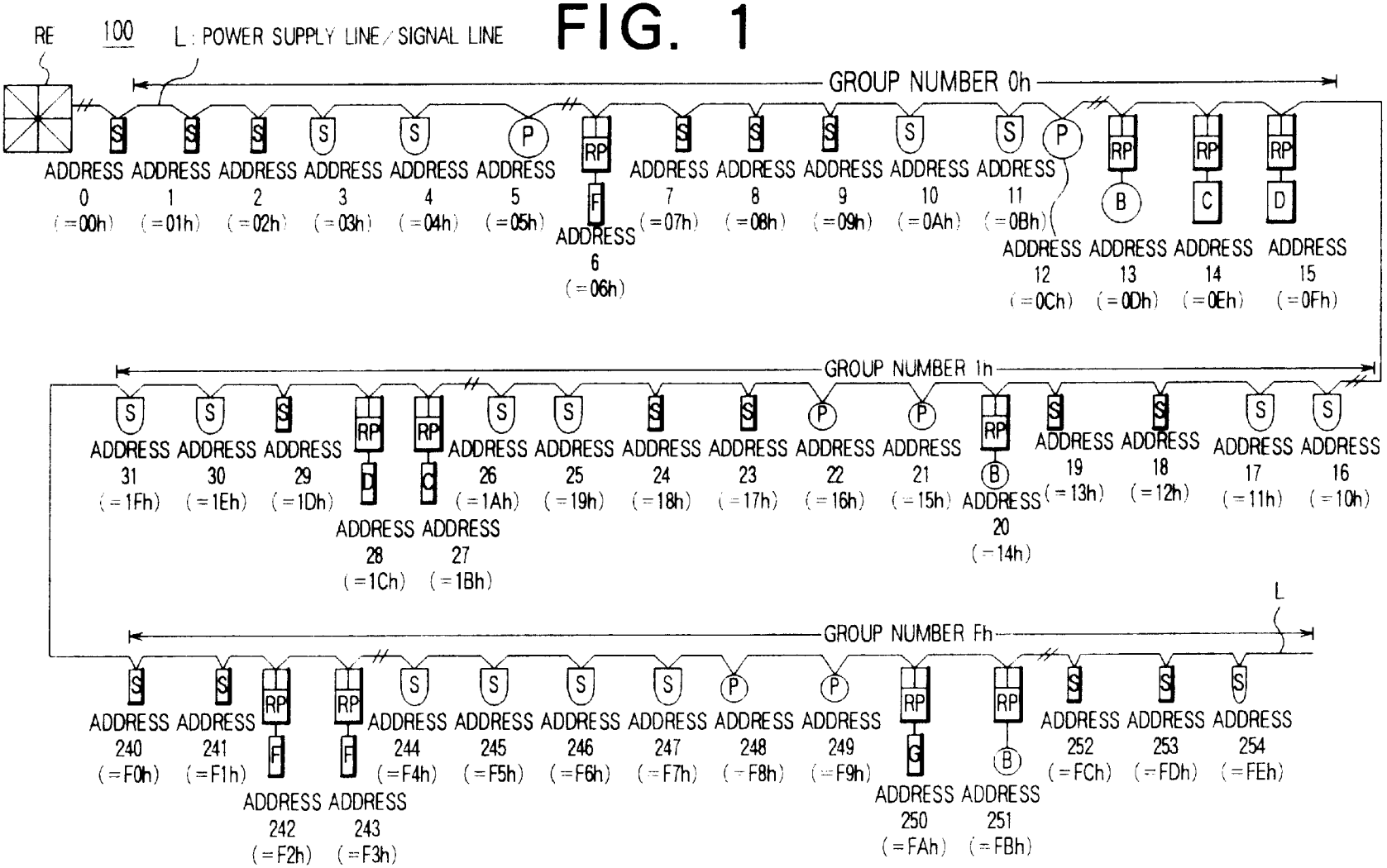
FIG. 1 is a system diagram of an embodiment of a fire alarming system according to the present invention.

FIG. 1 is a schematic representation of an embodiment of a fire alarm/security system 100 according to the present invention.

The fire alarm/security system 100 includes a fire alarming signal receiving device RE, a signal line L consisting of a pair of wires also serving as a power supply line, and various types of terminal devices, wherein the terminal devices are connected to the fire alarming signal receiving device RE via the signal line L.

The fire alarming system 100 includes as many as for example 255 terminal devices connected to the fire alarming signal receiving device RE. The terminal devices include analog fire sensors S, manual boxs P, and transmitters RP. The analog fire sensors S detect smoke, heat, light of a flame, gas, a smell or the like arising from a fire and generate an output signal corresponding to the detected physical quantity. Several types of analog fire sensors are available. They include: smoke sensing type fire detectors such as a photoelectric smoke sensor, a light attenuation sensor, and an ion sensor; a heat sensor; a flame sensor; a gas sensor; and a smell sensor. On-off type fire sensors F, which generate a fire alarm signal when they detect a fire phenomenon at a level greater than a predetermined value, are also connected to the signal line L via the corresponding transmitters RP. Furthermore, fire doors D, local bells B, gas leakage detectors G are also connected to the signal line L via the transmitters RP.

Each terminal device is assigned an address represented by a 2-digit hexadecimal number in such a manner that the address increases one by one in the order of the distance from the fire alarming signal receiving device RE. More specifically, terminal devices are assigned addresses 00 h, 01 h, 02 h, . . . , FEh in the order of the distance from the fire alarming signal receiving device RE. For an easier understanding, the addresses will be represented in decimal form in most cases.

The terminal devices having addresses 00 h to FEh are divided into 16 groups G0 to G15 in the order of the distance of the terminal devices from the fire alarming signal receiving device RE. As shown in FIG. 1, each of groups G0 to G14 includes 16 terminal devices, and group G15 includes 15 terminal devices. Each of these 255 terminal devices is assigned its own 8-bit address different from each other in the range from 00 h to FEh.

Figure 2:
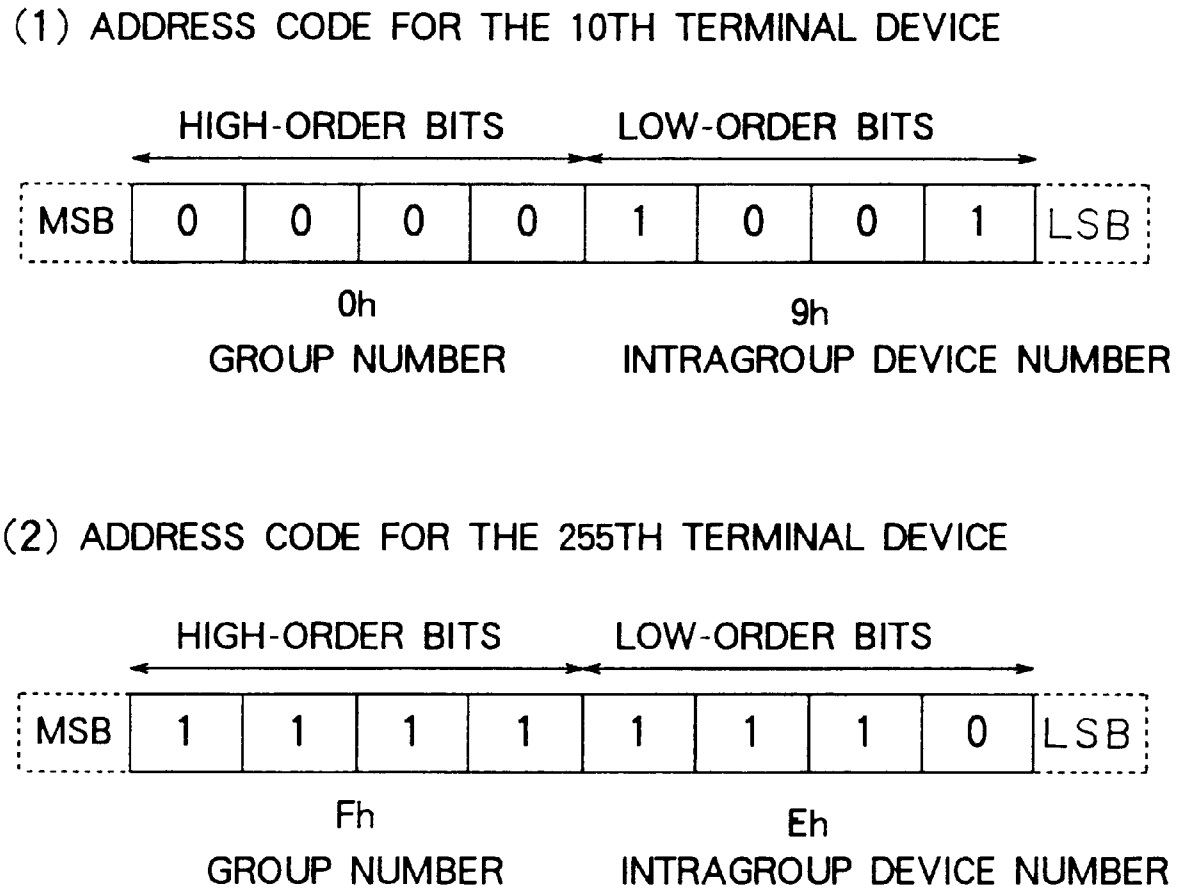
FIG. 2 is a schematic representation of 8-bit address codes for two terminal devices according to the above embodiment wherein FIG. 2(1) illustrates an 8-bit binary address code for a 10th (in decimal) terminal device, and FIG. 2(2) illustrates an 8-bit binary address code for a 255th (in decimal) terminal device.

FIG. 2 is a schematic representation of 8-bit address codes for two terminal devices in the system of the present embodiment wherein FIG. 2(1) illustrates an 8-bit binary address code for a 10th (in decimal) terminal, and FIG. 2(2) illustrates an 8-bit binary address code for a 255th terminal.

As shown in FIG. 2, the binary address code for each terminal can be divided into higher 4-bits (hereafter referred to simply as higher bits) and lower 4-bits (hereafter referred to simply as lower bits). The higher bits represent the group number and the lower bits represent the terminal number in the group. In the case of the 10th (in decimal) terminal device, its binary address code is "00001001", and thus the higher bits of the address code are "0000" (0 h) which indicate that the terminal device belongs to the 0th group. The lower bits are "1001" (9 h) and thus it is indicated that the terminal device is the 10th one in the group. The address "09 h" represented by the combination of the higher bits and the lower bits indicates that the terminal device is the 10th one of all the devices in the fire alarming system 100.

In the case of the 255th (in decimal) terminal device, its binary address code is "11111110", and thus its higher bits are "1111" (Fh) which indicate that the terminal device belongs to the 15th group. The lower bits are "1110" (Eh) and thus it is indicated that the terminal device is the 15th one in that group. The address "FEh" represented by the combination of the higher and lower bits indicates that the terminal device is the 255th one of all the devices in the fire alarming system 100.

In the present embodiment, as described above, the entire 8-bit code represents the address in the total fire alarming system 100. The higher bits of the 8-bit code represent the group number, and the lower bits represent the terminal device number within the particular group (hereafter referred to as an intra-group terminal device number).

Since each of terminal devices is assigned its own address represented by a plurality of bits wherein the group number is represented by particular bits of the address, it is possible to call at the same time a plurality of terminal devices having an equal group number in a "group information acquisition frame" in "point polling". Furthermore, because the called terminal devices having the equal group number are assigned different intra-group terminal device numbers, it is possible to specify the response timing so that the called terminal devices having the equal group number can response to the call at different times.

The fire alarming signal receiving device RE polls the terminal devices in a point polling mode, system polling mode, or selecting mode. so as to acquire information from particular terminal devices or control particular terminal devices.

In the following description, the term "polling" is used to describe the point polling or the system polling, and the selecting operation is not included in the "polling" operations.

Figure 3:
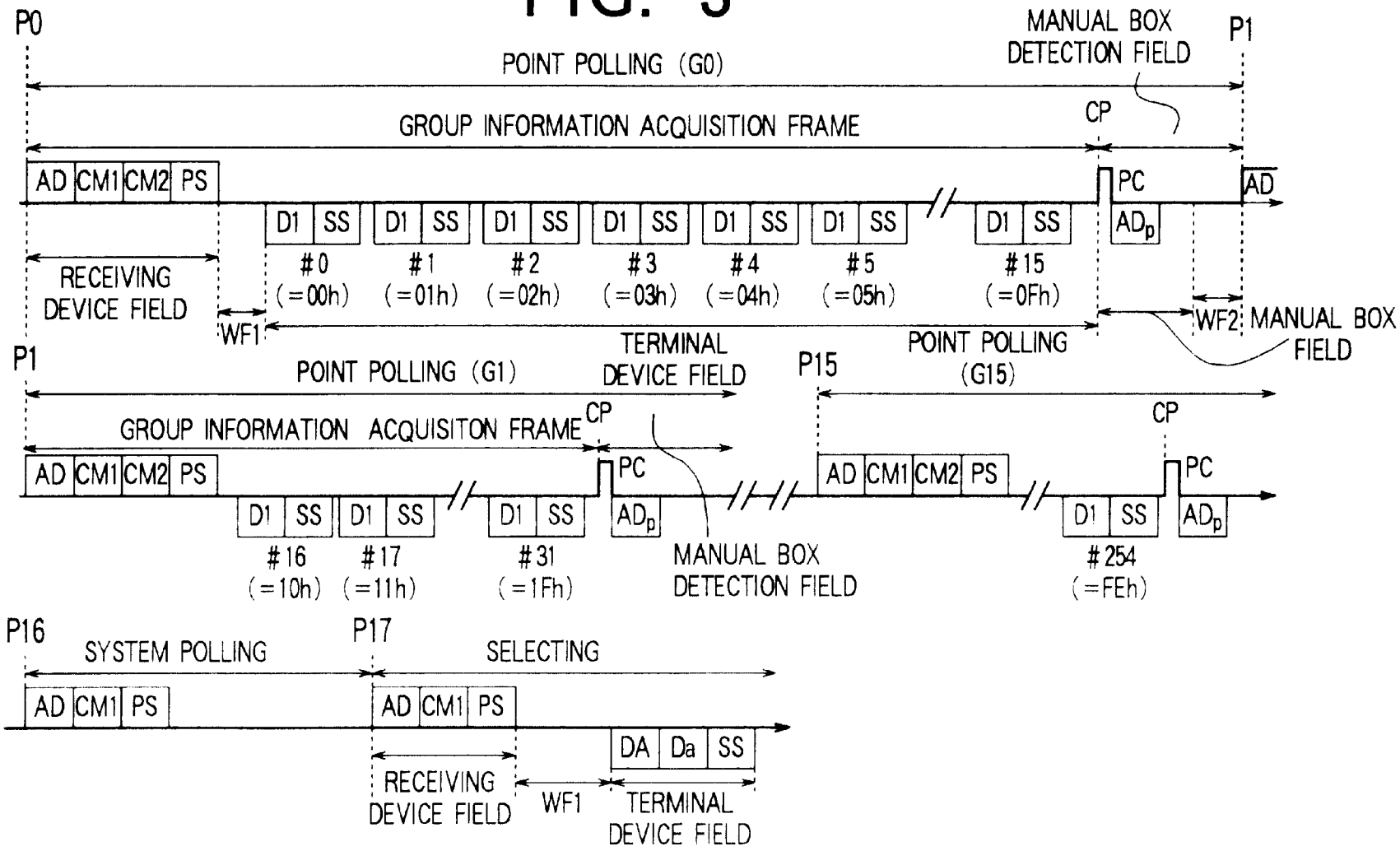
FIG. 3 is timing chart illustrating the operation of the system according to the above embodiment of the invention.

FIG. 3 is a timing chart illustrating the operation according to the present embodiment.

The "point polling" shown in FIG. 3 consists of a "group information acquisition frame" and a "manual box detection frame".

The "group information acquisition frame" is used by the fire alarming signal receiving device RE to poll the terminal devices in such a manner that the 255 terminal devices, which are divided into groups, for example 16 groups, are called group by group rather than device by device. The terminal devices belonging to the called group transmit in a device-by-device fashion requested data such as status information or terminal type indicating information ID to the fire alarming signal receiving device RE at response times assigned to the respective terminal devices.

In the present embodiment of the fire alarming system in which a plurality of terminal devices such as fire sensors, transmitters, manual boxs, or other devices to be controlled are connected to a receiving device of the system, the terminal devices are divided into a plurality of groups and the receiving device polls these terminal devices group by group wherein the receiving device acquires, in a time-division fashion, information from a plurality of terminal devices belonging to a particular group of the above plurality of groups in a time period between the completion of transmission of a polling signal to the above group and the start of transmission of a polling signal to the next group.

With the arrangement of the present embodiment, it is possible to quickly determine which terminal device has detected an event of an abnormal state even if there are a great number of terminal devices in one group.

In the case where a plurality of time slots are used in the above time-division communication, the slot width is set such that the width increases with the start time of the time slots in the time period between the transmission of a polling signal to a particular group of said plurality of groups and the transmission of a polling signal to the next group, as will be described in further detail later with reference to FIG. 23.

When analog fire sensors are used as the terminal devices, the "status information" refers to such data representing physical quantity corresponding to a detected fire phenomenon. In the case of a transmitter RP connected to an on-off fire sensor F or a gas leakage detector G, the "status information" refers to data indicating an event of a fire or leakage of gas. For a transmitter RP connected to a device to be controlled such as a fire retarding door D or a local bell B, the "status information" refers to such data indicating whether the device is in an open state or a closed state, or data indicating whether the device is in operation or not, or otherwise data indicating whether the bell is ringing or not. In the case of an manual box, the "status information" refers to such data indicating whether or not its push button switch is pressed and thus it is in an on-state.

The information acquired in a "group information acquisition frame" in the point polling is referred to as "group information".

Because the manual boxs P are activated by persons, the information given by manual boxs P is highly reliable. Taking this fact into consideration, "manual box detection frames" are provided in the point polling thereby making it possible to quickly acquire the status information. As shown in FIG. 3, each time a "group information acquisition frame" is executed for each group, all manual boxs of the fire alarming system are called at the same time in a manual box detection frame. If there is an activated manual box, the activated manual box transmits, in response to the call, its address to the fire alarming signal receiving device RE in a time slot assigned to that manual box, of a plurality of time slots assigned to the respective manual boxs.

"Activated manual box address information" refers to the address acquired in the "manual box detection frame". In the present embodiment, when a plurality of manual boxs P are activated, only the one manual box having the lowest address can transmit its address and the other activated manual boxs having higher addresses cannot transmit their address. This operation will be described in further detail later.

The "system polling" refers to an operation in which the fire alarming signal receiving device RE transmits control commands to all terminal devices thereby controlling them. The control commands issued by the fire alarming signal receiving device RE to the terminal devices in the system polling include a fire reset command (used to reset to a normal monitoring state a terminal device such as an analog fire sensor S or a transmitter which has transmitted a fire alarm signal or other terminal devices such as a transmitter having a local bell B ringing), storage reset command (used to reset a terminal device such as a fire sensor or a transmitter which have transmitted a fire alarming signal to perform a storage operation thereby determining whether a fire is continuously detected), and a local sound stop command (used to inactivate a local bell B).

The "selecting" refers to an operation in which the fire alarming signal receiving device transmits a particular control command to a desired terminal device designated by a particular address so as to control that terminal device, or transmits a particular command such as a status information request command to a particular terminal device thereby acquiring the status information from the particular terminal device.

In FIG. 3, the operation process starts from the top and left and proceeds to right. At the right end in FIG. 3, the process goes down by one line and proceeds to left, and so on. In FIG. 3, the signals shown above the horizontal lines are transmitted by the fire alarming signal receiving device RE while the signal shown below the horizontal lines are transmitted by terminal devices.

The signals (codes) transmitted from the fire alarming signal receiving device RE to terminal devices include an address AD, commands CM1 and CM2, and a primary checksum code PS. The signals (codes) transmitted from terminal devices to the fire alarming signal receiving device RE include returning-back data D1, a secondary checksum code SS, a device address DA, and returning-back data D2. These signals (codes) are described in greater detail below.

The codes AD, CM1, CM2, PS, D1, SS, DA, and Da each consist of a start bit SB, an 8-bit data area, and a stop bit EB. That is, each code consists of 10 bits in total. When these codes are transmitted from the fire alarming signal receiving device RE to a terminal device or from a terminal device to the fire alarming signal receiving device RE, each 10-bit binary-code is transmitted bit by bit starting from the most significant bit. For simplicity, hereinafter in the following description, the 8-bit data area representing the contents of each code AD, CM1, CM2, PS, D1, DA, Da, and SS is expressed by a 2-digit hexadecimal number.

First, an address AD, commands CM1 and CM2, a primary checksum code PS are transmitted from the fire alarming signal receiving device RE to terminal devices. The address AD can take any of 2-digit hexadecimal numbers from 00 h to FFh. When the address AD has a value within the range from 00 h to FEh (in other words, AD≠FFh), the address designates a particular terminal device in the fire alarming system 100 to be selected in the selecting operation (hereinafter the address will be referred to as the "selecting address code"). On the other hand, when the address AD has a value equal to FFh, it indicates that the operation should be performed in a point polling or system polling mode (hereinafter referred to as a polling command).

The command CM1 is also a 2-digit hexadecimal number. When the operation is performed in the selecting mode (that is, AD≠FFh), a specific command is designated by a particular 2-digit hexadecimal number of the command CM1. For example, when the command CM1 is equal to 82 h, it designates a fire test command. 83 h designates a lamp turning-off command used to turn off an indication lamp of a fire sensor in the selecting mode.

On the other hand, when the operation is performed in the polling mode (AD=FFh), the command CM1 designates a specific operation to be performed. That is, when the command CM1 is equal to 0 Xh, it designates that point processing should be performed (point processing command), and FXh designates system processing (system processing command).

In the above expression, X is a hexadecimal number from 0 h to Fh which designates the polling operation more specifically. For example, when the command CM1 is equal to 00 h, it designates a request for returning back terminal type indicating information (ID) in the point polling operation. Similarly, 01 h designates a request for a state information in the point polling operation, F0 h is a fire reset command in the system polling operation, F1 h is a storage reset command in the system polling operation, F2 h is a local sound stop command in the system polling operation, and F3 h is a voice-alarm stop command in the system polling operation.

The command CM2 also takes a 2-digit hexadecimal number. However, the command CM2 is not used in the selecting and system polling operations.

In the case of point polling, the lower digit of the command CM2 designates the group which should transmit specific information in the polling operation to the fire alarming signal receiving device (thus the lower digit is referred to as a point-polling group designation code). For example, the command CM2 is represented in the form of 0 Xh where X is a hexadecimal number from 0 h to Fh designating the group number that should transmit specific information back to the fire alarming signal receiving device.

The primary checksum code PS is a code used by terminal devices to judge whether a message received from the fire alarming signal receiving device RE includes no error. The primary checksum code PS is calculated from the codes AD, CM1, and CM2 according to a predetermined rule as will be described later.

When the operation is performed in the point polling mode, each terminal device transmits status information or terminal type indicating information ID as the returning-back data D1 and also a secondary checksum code SS to the fire alarming signal receiving device RE.

In the case of the selecting operation, each terminal device transmits a device address DA, a returning data Da, and a secondary checksum code SS to the fire alarming signal receiving device RE. On the other hand, terminal devices transmit nothing in the system polling operation. The "returning-back data Da" refers to data which is returned back when a terminal device receives a control command such as a device status information request command, a terminal type indicating information request command, thereby notifying the fire alarming signal receiving device that the terminal device has correctly operated according to the received command.

The secondary checksum code SS is used by the fire alarming signal receiving device RE to confirm that a message received from a terminal device includes no error. In the case of the point polling operation, the secondary checksum code SS is calculated from AD, CM1, CM2, PS, and D1, while it is calculated from AD, CM1, CM2, PS, DA, and Da in the setting operation, according to the calculation rule described later.

The operation of the system according to the present embodiment of the invention will be described in greater detail below with reference to FIG. 3.

The point polling process includes a "group information acquisition frame" and a "manual box detection frame". The "group information acquisition frame" consists of a "receiver field" in which a receiver calls a terminal device, a "first waiting field WF1" in which no transmission is performed between the receiving device and the terminal device, and a "terminal device field" in which the called terminal device transmits a signal to the receiving device. The "manual box detection frame" consists of a "manual box field" in which transmission is performed between the receiving device and a manual box, and a "second waiting field WF2" in which no transmission is performed between the receiving device and the terminal device.

First at time P0, as shown in FIG. 3, a point polling operation starts with a "receiving device field" in a "group information acquisition frame." In this receiving device field, the fire alarming signal receiving device RE transmits FFh as an address AD, 01 h as a command CM1, 00 h as a command CM2, and a primary checksum code PS.

In a terminal device field, if terminal devices receive any of the above commands, the terminal devices of each group check whether the group number received from the fire alarming signal receiving device RE is equal to the group number represented by the higher digit of the device address. if the result of the above checking is positive, the terminal device transmits a returning-back data D1 and a secondary checksum code SS to the fire alarming signal receiving device RE after the end of a first waiting field WF1.

In the above operation in which each terminal device transmits requested data, the 16 terminal devices belonging to the called group transmit the requested data at response times assigned to the respective terminal devices in the order of increasing terminal numbers.

On the other hand, after the first waiting field WF1, the fire alarming signal receiving device RE enters the terminal device field. The terminal device field includes 16 slots in which the fire alarming signal receiving device RE receives status information from the corresponding terminal devices. In the terminal device fields, the respective terminal devices having their own terminal number from 0 to 15 transmit returning-back data D1 and a secondary checksum code SS in the corresponding time slots assigned to the respective terminal devices, while the fire alarming signal receiving device RE acquires the data transmitted from the respective terminal devices.

After the completion of the terminal device field, a "manual box detection frame" is started. The "manual box detection frame" is one of operations performed in the point polling. At time CP in the "manual box detection frame", as shown in FIG. 3, the fire alarming signal receiving device RE transmits a fire-alerting-device calling pulse PC thereby calling only manual boxs P. If the push button of a particular manual box P is pressed and thus it is in an active state, the manual box P transmits its device address ADp immediately after receiving the fire-alerting-device calling pulse PC. In the above operation, the fire-alerting-device calling pulse PC also serves as a start bit for the data transmission from the manual box P. That is, the 8-bit device address ADp is transmitted at a right time synchronized relative to the fire-alerting-device calling pulse PC. In this way, the fire alarming signal receiving device RE can acquire the address information ADp of the manual box P in the activated state.

After completion of the manual box field in the "manual box detection field", the fire alarming signal receiving device RE enters a second waiting field WF2. After the second waiting field WF2, the point polling operation (G0) for the group having a group number of 0 is completed.

Then the command CM2 designating the group is incremented by 1. At time P1, a point polling operation (G1) for a group having a group number of 1 is started and the operation is performed in a manner similar to the point polling operation (G0). Although not shown in FIG. 3, at points P2, P3, . . . , P14, groups having group numbers 2 h to Fh are designated, and the point polling operation is performed for these groups in a manner similar to the point polling operation (G0).

After completion of the point polling operation for the group having a group number of Fh, the point polling operation for acquiring the terminal type indicating information ID is performed although not shown in FIG. 3. In this operation, the fire alarming signal receiving device RE transmits FFh as the address data AD, 00 h as the command CM1, 01 h as the command CM2, and the primary checksum code PS. In a terminal device field, the respective terminal devices transmit their own terminal type indicating information ID as the returning-back data D1 as opposed to the above terminal device field in which the status information is transmitted from the respective terminal devices.

The point polling operation is performed for the group having a group number of 0 h in a manner similar to the point polling operation for acquiring the status information except for the returning-back data D1. Similarly, groups having group numbers 0 h to Fh are designated one by one, and the point polling operation is performed for the designated group. In this way, the fire alarming signal receiving device RE acquires the terminal type indicating information ID from the respective terminal devices. After completion of the polling operation for the group having a group number of Fh, another point polling operation is started to acquire the status information.

The system polling operation according to the embodiment of the invention will be described below.

If, at time P16 in FIG. 3, a human operator operates the control panel OP of the fire alarming signal receiving device RE thereby issuing a command telling it that it should perform a fire resetting operation in the system polling mode, the fire alarming signal receiving device transmits a polling command (AD=FFh), a fire resetting command (CM1=F0 h), and a primary checksum code PS one by one thereby performing the fire resetting operation.

Although in the system polling operation according to the above specific embodiment, no signal is transmitted from the terminal devices to the fire alarming signal receiving device RE, terminal devices may also transmit a signal indicating that they have correctly received the command from the fire alarming signal receiving device RE.

In the case where a storage reset command, a local sound stop command, or a voice-alarm stop command is executed in the system polling mode, a storage reset command (CM1=F1 h), a local sound stop command (CM1=F2 h), or a voice-alarm stop command (CM1=F3 h) is transmitted instead of the fire reset command (CM1 F0 h) in the above-described operation. Except for the above, the operation is performed in a manner similar to the fire reset operation in the system polling mode.

Now the selecting operation according to the present embodiment of the invention will be described below.

If, at time P17 in FIG. 3, a human operator operates the control panel OP of the fire alarming signal receiving device RE thereby issuing a command telling it that it should perform a selecting operation for turning off an indication lamp of a terminal device having an address AD of 12 h, the fire alarming signal receiving device RE sequentially transmits commands including an address (AD=12 h) designating a terminal device to be selected, an indication lamp turn-off command (CM1=83 h), and a primary checksum code PS.

Of the terminal devices which have received the above signals, the one having an address AD of 12 h transmits its device address DA, a returning-back data Da, and a secondary checksum code SS to the fire alarming signal receiving device RE wherein the returning-back data Da indicates that the indication lamp has been turned off successfully. In addition to the indication lamp turn-off command (CM1=83 h), the commands transmitted by the fire alarming signal receiving device RE in the selecting mode include a fire test command (CM1=82 h), an indication lamp turn-on command (CM1=84 h), a CL interval control command (CM1=85 h), a smoke shut-off transmitter reset command (CM1=86 h), an interlocking ringing command (CM1=87 h), a manual ringing command (CM1=88 h), an SCI shut-off command (CM=89 h), a fire reset command (CM1=F0 h), storage reset command (CM1=F1 h), a local bell stop command (CM1=F2 h), a voice-alarm stop command (CM1=F3 h), a terminal type indicating information request (CM1=00 h), and a status information request (CM1=01 h). In the selecting operation, a proper command of the above is transmitted from the fire alarming signal receiving device, and the command is executed in a manner similar to the above-described operation of turning off the indication lamp of a terminal device except for the difference in the specific command.

In the present embodiment, if a plurality of manual boxs are activated at the same time during a manual box detection frame in the point polling mode, the address of only one manual box of those is transmitted to the fire alarming signal receiving device RE as described in detail below.

Figure 4:
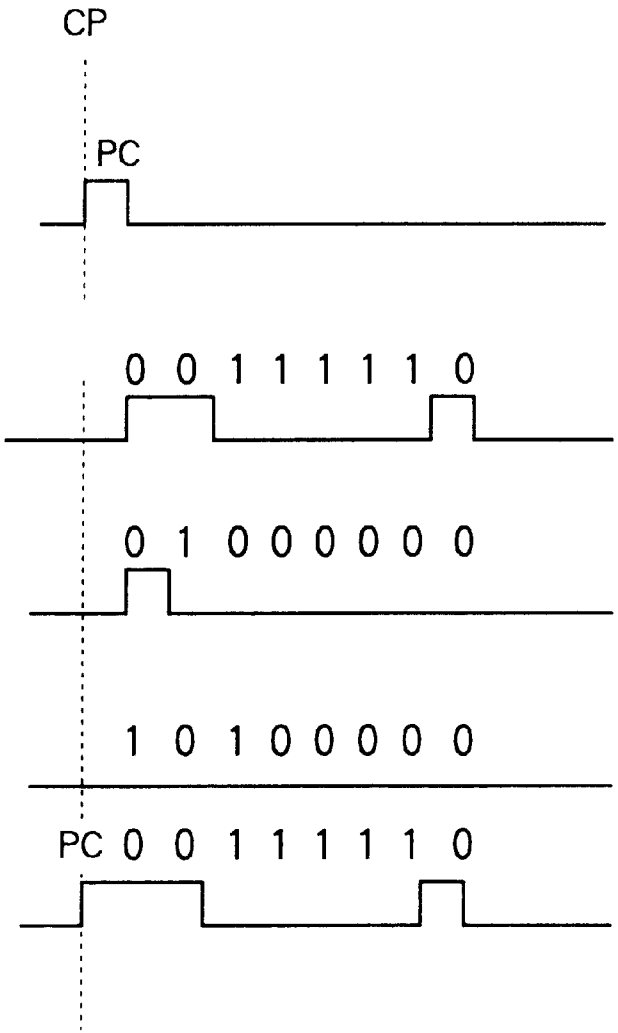
FIG. 4 is a timing chart illustrating an operation which will be performed when three different manual boxs $P_A$, $P_B$, and $P_C$ try to transmit a response signal (that is, when they try to transmit their own address to notify that a fire is detected)

FIG. 4 is a timing chart illustrating an example of an operation which will be performed when three different manual boxs $P_A$, $P_B$, $P_C$ try to transmit a response signal (that is, when they try to transmit their own address to notify that they are activated).

In the timing chart shown in FIG. 4, if a plurality of manual boxs try to transmit their own address so as to notify that they are activated, only the device address AD which is the lowest of all the device addresses is transmitted to the fire alarming signal receiving device RE and the other addresses AD are not transmitted. Therefore, no collision among the address data occurs on the transmission line. The reason why the collision among the address data AD on the transmission line can be avoided will be described in further detail below.

FIG. 4(1) illustrates a manual box calling pulse PC output from the fire alarming signal receiving device RE at time CP. FIGS. 4(2), 4(3), and 4(4) illustrate address signals transmitted from the manual boxs $P_A$, $P_B$, and $PC_C$, respectively.

In FIG. 4, for convenience of description, the addresses AD of the respective manual boxs PA, PB, and Pc are represented in decimal form, while the address data are represented in binary form in the timing chart. That is, the manual box $P_A$ has an address of "62" in decimal form ("00111110" in binary form), the manual box $P_B$ has an address of "64" in decimal form ("01000000" in binary form), and the manual box $P_C$ has an address of "160" in decimal form ("10100000" in binary form).

It is assumed herein that the manual boxs $P_A$, $P_B$, and $P_C$ are in activated states when they receive a manual box calling pulse PC from the fire alarming signal receiving device RE at time CP shown in FIG. 4(1). In response to the manual box calling pulse from the fire alarming signal receiving device RE at time CP, the manual boxs $P_A$, $P_B$, and $P_C$ transmit their own device address AD bit by bit starting from the most significant bit.

Since the manual box $P_B$ has an address AD of "01000000" (in binary form), its most significant bit is "0". The manual box $P_A$ has an address AD of "00111110" (in binary form), and its most significant bit is also "0". On the other hand, the manual box $P_C$ has an address AD of "10100000" (in binary form), and thus its most significant bit is also "1".

That is, the most significant bits of the respective addresses AD are "0" (inactive level) for the manual boxs $P_A$ and $P_B$ and "1" (active level) for the manual boxs $P_C$. In this case, since signals at 0-level and a signal at 1-level are transmitted over the signal line at the same time, the resulting signal on the signal line L becomes "0" (inactive level).

Judging from the fact that when the manual box $P_C$ tries to transmit the "1"-level signal (active level signal), the signal line L is at the "0" level (inactive level), the manual box $P_C$ concludes that another manual box having an address AD lower than the address AD of the manual box $P_C$ is transmitting a signal over the signal line L, and the manual box $P_C$ gives up transmitting the following bits of its own address AD. On the other hand, because the signal line L is at the "0" level (inactive level) when the manual boxs $P_A$ and $P_B$ try to transmit the "0"-level signal (inactive level signal), they conclude, at the time when the most significant bits of the addresses AD are transmitted, that no other manual boxs having an address lower than those of the manual boxs $P_A$ and $P_B$ are trying to transmit a signal over the signal line, and thus they continue to transmit the following bits of their own addresses AD.

As for the bit following the most significant bit of the address AD, the manual box $P_A$ transmits a "0"-level signal (inactive level signal) while the manual box $P_B$ transmits a "1"-level signal (active-level signal). As a result, the signal on the signal line L becomes "0"(inactive).

Judging from the fact that when the manual box $P_B$ tries to transmit the "1"-level signal (active level signal), the signal line L is at the "0" level (inactive level), the manual box $P_B$ concludes that another manual box having an address AD lower than the address AD of the manual box $P_B$ is transmitting a signal over the signal line L, and the manual box $P_B$ give up transmitting the following bits of its own address AD.

On the other hand, because the signal line L is at the "0" level (inactive level) when the manual boxs $P_A$ tries to transmit the "0"-level signal (inactive level signal), it concludes, at the time when the bit following the most significant bit of the address AD is transmitted, that no other manual boxs having an address lower than that of the manual box $P_A$ are trying to transmit a signal over the signal line, and thus it continues to transmit the following bits of its own address AD.

As for the further following bit of the address AD, the manual box $P_A$ transmit a "1"-level signal (active level signal) and the signal line is at a "1"level (active level). As a result, at this stage, the manual box $P_A$ concludes that no other manual boxs having an address lower than that of the manual box $P_A$ are trying to transmit a signal over the signal line, and thus it continues to transmit the following bits of its own address AD. The above judgement and operation are performed repeatedly until the entire address AD has been transmitted.

As a result, only the address of the manual box $P_A$ having the lowest address of the all is transmitted to the fire alarming signal receiving device RE. Thus a collision among device addresses can be prevented when a plurality of manual boxs try to transmit their device address to notify that they are activated. As shown in FIG. 4(4), the address data AD consisting of 8 bits of the manual box $P_A$ is transmitted over the signal line following the manual box calling pulse, which also serves as the start bit, provided by the fire alarming signal receiving device RE.

Alternatively, when plurality of manual boxs try to transmit their address to notify that they are activated, only the highest address AD of the device addresses may be transmitted to the fire alarming signal receiving device RE while inhibiting the transmission of the other addresses. In any case, in the system including a great number of terminal devices having a manual box, when a plurality of manual boxs in activated states are called at the same time, it is possible to determine which terminal device is in an activated state without encountering a collision among signals returned back from the terminal devices.

As described above, in the fire alarming system according to the present embodiment of the invention in which a plurality of terminal devices such as fire sensors, transmitters, manual boxs or other devices to be controlled are connected to the receiving device, when a plurality of manual boxs are activated, only one of these activated manual boxs can transmit a signal to the receiving device. In this system according to the present embodiment, each manual box has priority decision means for determining the degree of priority in transmission of a signal to the receiving device relative to other manual boxs which are trying to transmit a signal at the same time. More specifically, the priority decision means determines which address is the lowest or highest of a plurality of manual boxs in activated states so that the address of a manual box regarded as having the lowest or highest address is transmitted to the receiving device.

Thus, in the system having a great number of terminal devices having a manual box according to the present embodiment, when a plurality of manual boxs in activated states are all called at the same time, it is possible to determine which terminal devices have an activated manual box without encountering a collision among signals returned back from the terminal devices.

Figure 5:
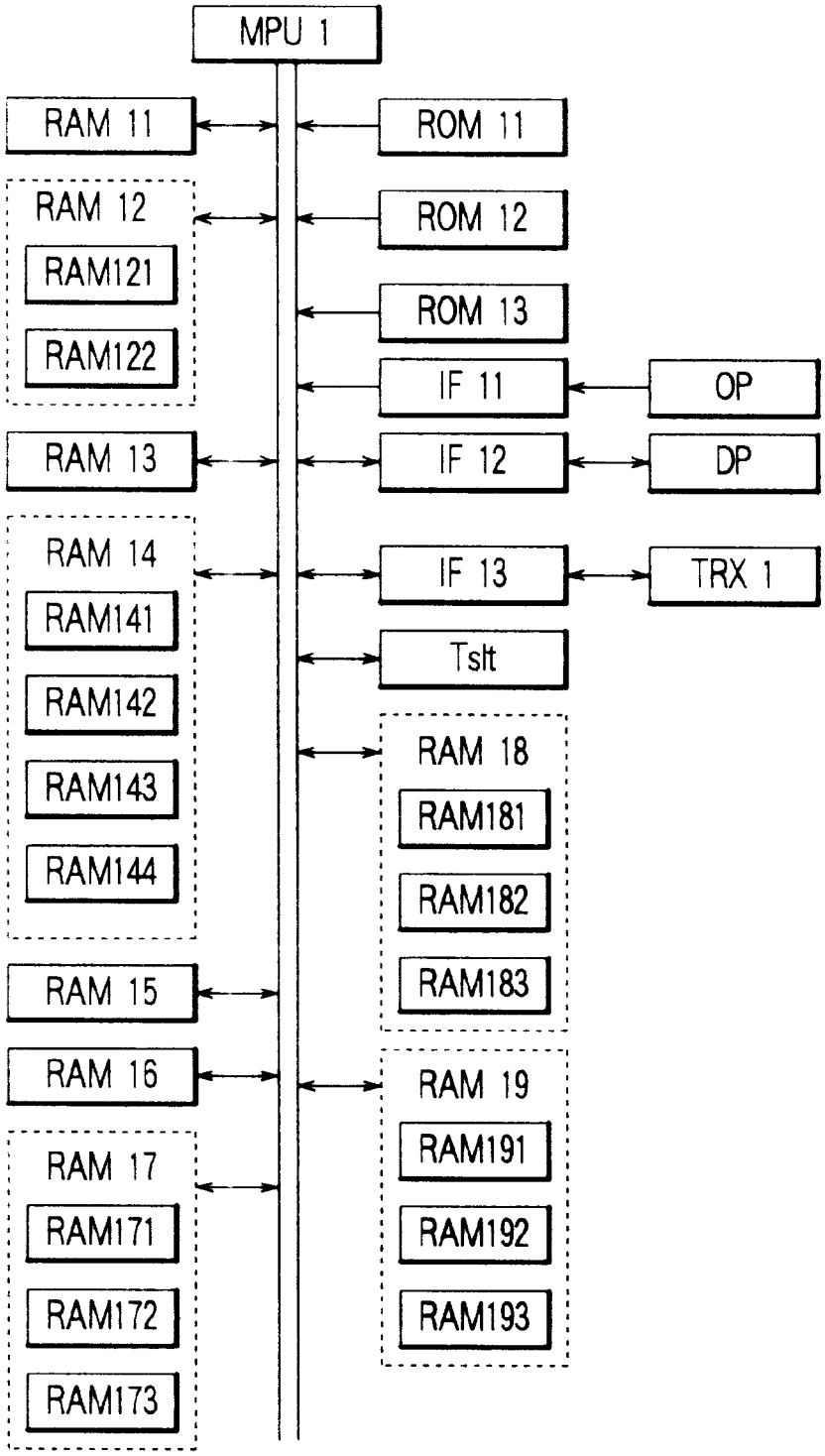
FIG. 5 is a block diagram illustrating an example of a fire alarming signal receiving device RE used in the above embodiment.

FIG. 5 is a block diagram illustrating an example of the fire alarming signal receiving device RE used in the present embodiment.

The fire alarming signal receiving device RE includes a microprocessor MPU1, read only memories ROM 11 to ROM 13, random access memories RAM 11 to RAM 19, interfaces IF11 to IF13, a signal transmitter/receiver TRX1, a control panel OP, a display DP, and a timer Tslt. The ROM 11 is used to store programs and data used to perform the operation shown in the flowcharts of FIGS. 9 to 15. The ROM 12 is used to store a terminal mapping table describing the correspondence between the address (the group number and the terminal number) and the terminal type indicating information ID of each terminal device. The ROM 13 is used to store an interlocking control table defining the relationship between the areas and the devices such as fire retarding doors to be controlled when a fire occurs in a particular area.

The RAM 11 is used as a work area. The RAM 12 is used to store a returning-back data D1 and a secondary checksum code SS returned back from a terminal device in a group information acquisition frame during a point polling operation. The RAM 12 includes a RAM 121 for storing the returning-back data D1 and a RAM 122 for storing the secondary checksum code SS. The RAM 13 is used to store the addresses and the terminal type indicating information ID of various terminal devices.

In the initial setting operation, the address and the terminal type indicating information ID of each terminal device stored in the ROM 12 are loaded into the RAM 13. If it is required to modify the address and the terminal type indicating information ID as in the case where some terminal devices are replaced or an additional device is connected to the system, the address and the terminal type can be modified by operating the control panel. If new terminal type indicating information ID is returned in a group information acquisition frame in a point polling operation, the terminal type indicating information ID stored in the RAM 13 is updated by the returned terminal type indicating information ID.

The RAM 14 is used to store an address AD, commands CM1 and CM2, and a primary checksum code PS to be transmitted to terminal devices in the above-described group information acquisition frame. The RAM 14 includes a RAM 141 for storing the address AD, a RAM 142 for storing the command CM1, a RAM 143 for storing the command CM2, and a RAM 144 for storing the primary checksum code PS.

The RAM 15 is used to store the address of a manual box which has transmitted a signal in a manual box detection frame in point polling. The RAM 16 is used to store transmission error detection variables fx for respective addresses AD. The transmission error detection variable fx represents the number of transmission errors detected for a terminal device having an address AD equal to x wherein the number of transmission errors is represented in a decimal form.

The RAM 17 is used to store an address AD, a command CM1, and a primary checksum code PS to be transmitted to a terminal device in a system polling operation. The RAM 17 includes a RAM 171 for storing the address AD, a RAM 172 for storing the command CM1, and a RAM 173 for storing the command CM2.

The RAM 18 is used to store an address AD, a command CM1, and a primary checksum code PS to be transmitted to a terminal device in a selecting operation. The RAM 18 includes a RAM 181 for storing the address AD, a RAM 182 for storing the command CM1, and a RAM 183 for storing the primary checksum code PS.

The RAM 19 is used to store a device address DA, a returning-back data Da, and a secondary checksum code SS returned back from a terminal device in a selecting operation. The RAM 19 includes a RAM 191 for storing the device address DA of the terminal device, a RAM 192 for storing the returning-back data Da, and a RAM 193 for storing the secondary checksum code SS.

The timer Tslt is used to control the start time and the end time of a slot in which status information is received and the start time and the end time of a manual box slot.

The interface IF11 is used to connect the control panel OP to the microprocessor MPU1. The interface IF12 is used to connect the display DP to the microprocessor MPU1. The interface IF13 is used to connect the signal transmitter/receiver TRX1 to the microprocessor MPU1.

The signal transmitter/receiver TRX1 includes a parallel-to-serial converter, a transmitter, a receiver, and a serial-to-parallel converter. The control panel OP includes a ten-key keyboard and various switches. The display DP includes a CRT and various indication lamps.

Figure 6:
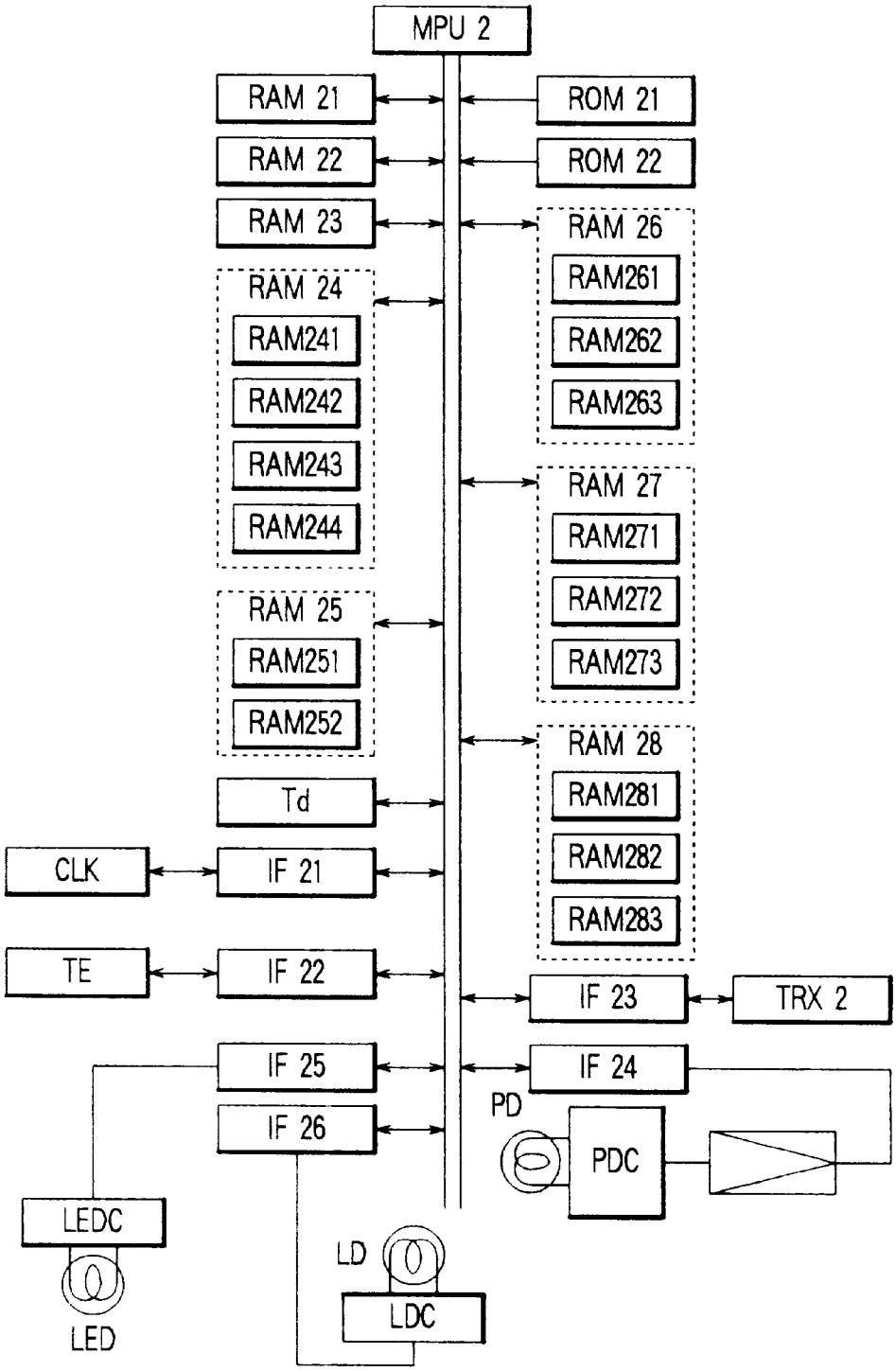
FIG. 6 is a block diagram illustrating an analog photoelectric fire sensor S as an example of a terminal device used in the above embodiment.

FIG. 6 is a block diagram illustrating an analog photoelectric fire sensor S as an example of a terminal device used in the present embodiment.

The analog photoelectric fire sensor S includes: a microprocessor MPU2; read only memories ROM 21 to ROM 22; random access memories RAM 21 to RAM 28; interfaces IF21 to IF26; a signal transmitter/receiver TRX2; a light emitting diode LD serving as a smoke detection light emitting device; a photodiode PD serving as a photosensor; a clock generator CLK for generating pulses at predetermined time intervals in response to which the light emitting diode LD and the photodiode PD are driven thereby performing a smoke sensing operation; a light emitting diode LED serving as an operation indicating lamp; a timer Td; a light emitting diode driving circuit for driving the light emitting diode LD so that it emits light with a desired optical power; a photo detecting circuit PDC including an amplifier and a sample-and-hold circuit; a light emitting diode driving circuit LEDC for driving the operation indicating lamp LED; and a fire test circuit TE for performing a fire test by increasing the sensitivity of the photo sensing unit to a predetermined level.

The ROM 21 is used to store programs and data for controlling the operations such as the point processing, the system processing, and the selecting operation. The ROM 22 is used to store the device address (the higher digit thereof represents the group number of the group to which the device belong, and the lower digit represents the terminal device number) and terminal type indicating information ID. Instead of the ROM 22, a dip switch or the like may also be employed. The RAM 21 provides a work area. The RAM 22 is used to store information about the physical quantity corresponding to the current amount of smoke. The RAM 23 is used to store an intragroup terminal device number m and information indicating when the status information regarding the terminal device should be transmitted to the fire alarming signal receiving device RE (that is, the slot assigned to the terminal device). The time when the status information should be transmitted to the fire alarming signal receiving device RE is calculated immediately after the initial setting operation on the basis of the intragroup terminal device number m indicated by the lower digit of the device address. Hereinafter, the above-described time is referred to as the data transmission start time Tdm.

The RAM 24 is used to store an address AD, commands CM1 and CM2, a primary checksum code PS received from the fire alarming signal receiving device RE in a group information acquisition frame in a point polling operation. The RAM 24 includes a RAM 241 for storing the address AD, a RAM 242 for storing the command CM1, a RAM 243 for storing the command CM2, and a RAM 244 for storing the primary checksum code PS.

The RAM 25 is used to store a returning-back data D1 and a secondary checksum code SS to be returned to the fire alarming signal receiving device RE in a group information acquisition frame in a point polling operation. The RAM 25 includes a RAM 251 for storing the returning-back data D1 and a RAM 252 for storing the secondary checksum code SS.

The RAM 26 is used to store an address AD, a command CM1, and a primary checksum code PS in a system polling operation. The RAM 26 includes a RAM 261 for storing the address AD, a RAM 262 for storing the command CM1, and a RAM 263 for storing the primary checksum code PS.

The RAM 27 is used to store an address AD, a command CM1, and a primary checksum code PS in a selecting operation. The RAM 27 includes a RAM 271 for storing the address AD, a RAM 272 for storing the command CM1, and a RAM 273 for storing the primary checksum code PS.

The RAM 28 is used to store the device address DA of the fire sensor S, a returning-back data Da, and a secondary checksum code SS which are returned back in a selecting operation. The RAM 28 includes a RAM 281 for storing the device address DA, a RAM 282 for storing the returning-back data Da, and a RAM 283 for storing the secondary checksum code SS.

The interface IF21 is used to couple the clock CLK to the microprocessor MPU2. The interface IF22 is used to couple the fire test circuit TE to the microprocessor MPU2. The interface IF23 is used to couple the signal transmitter/receiver TRX2 to the microprocessor MPU2. The interface IF24 is used to couple the photo detecting circuit PDC to the microprocessor MPU2. The interface IF25 is used to couple the light emitting diode driving circuit LEDC to the microprocessor MPU2. The interface IF26 is used to couple the smoke detection light emitting diode driving circuit to the microprocessor MPU2. The timer Td is used to control the timing of the operation of returning back data. The signal transmitter/receiver TRX2 is similar to the signal transmitter/receiver TRX1.

The analog fire sensor S is not limited to the photoelectric type sensor used in the above specific embodiment, and other types of fire sensors such as those of the heat sensing type, flame sensing type, gas sensing type, and smell sensing type may also be employed. In this case, the smoke detection light emitting diode LD and the circuit LDC for driving it, and the photodiode PD and the circuit PDC for receiving a signal from the photodiode PD may be replaced by devices and circuits suitable for the particular type of the sensor employed. For example, in the case of a heat-sensitive analog fire sensor, a thermistor serving as heat sensing means and a circuit for detecting a signal from the thermistor may be employed. When a flame-sensitive analog fire sensor is employed, it may include a burning-sensitive element or a photodetector such as an ultraviolet photodetector and a circuit for detecting a signal from the photodetector. A gas sensor and a circuit for detecting a signal from it may be employed for a gas-sensitive analog fire sensor, and a smell sensor and a circuit for detecting a signal from it may be employed for a smell-sensitive analog fire sensor. The system may be constructed in the same manner as the above embodiment except for the sensor and the circuit for detecting a signal from it.

Figure 7:
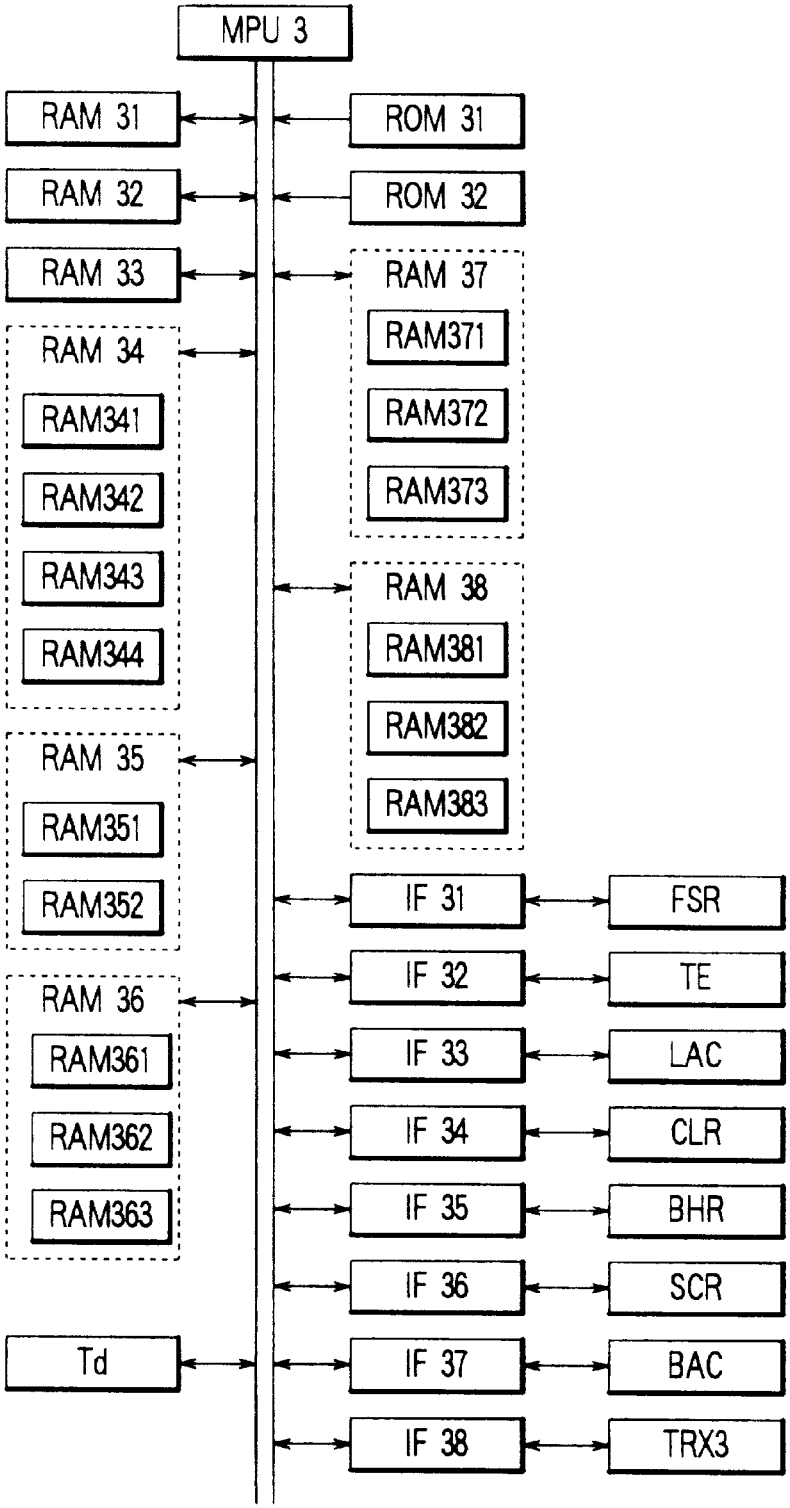
FIG. 7 is a block diagram illustrating a transmitter RP as an example of a terminal device used in the above embodiment.

FIG. 7 is a block diagram illustrating a transmitter RP as an example of a terminal device used in the present embodiment.

The transmitter RP includes: a microprocessor MPU3; read only memories ROM 31 and ROM 32; random access memories RAM 31 to RAM 38; interfaces IF31 to IF38; a timer Td serving as a returning-back timing control timer for control the start timing of a data returning operation; a fire alarm signal receiver FSR for receiving a fire alarm signal from an on-off type fire sensor connected to the transmitter RP; a fire test circuit TE for performing a fire test by increasing the sensitivity of the photo sensing part of the on-off type fire sensor connected to the transmitter up to a predetermined level; a local-area audible-alarm controller LAC for controlling the local bell (not shown); a CL control circuit CLR for controlling the CL line (not shown) of the transmitter; a smoke shutting-off control circuit BHR for controlling the opening-and-closing operation of a fire retarding door D (not shown); an SCI shutting-off control circuit SCR for controlling the on-off operation of the transmitter RP and a power supply connected to an end of a signal line; a voice alarm control circuit BAC for controlling a voice alarm via a loud speaker (not shown); and a signal transmitter/receiver TRX3.

Figure 10:
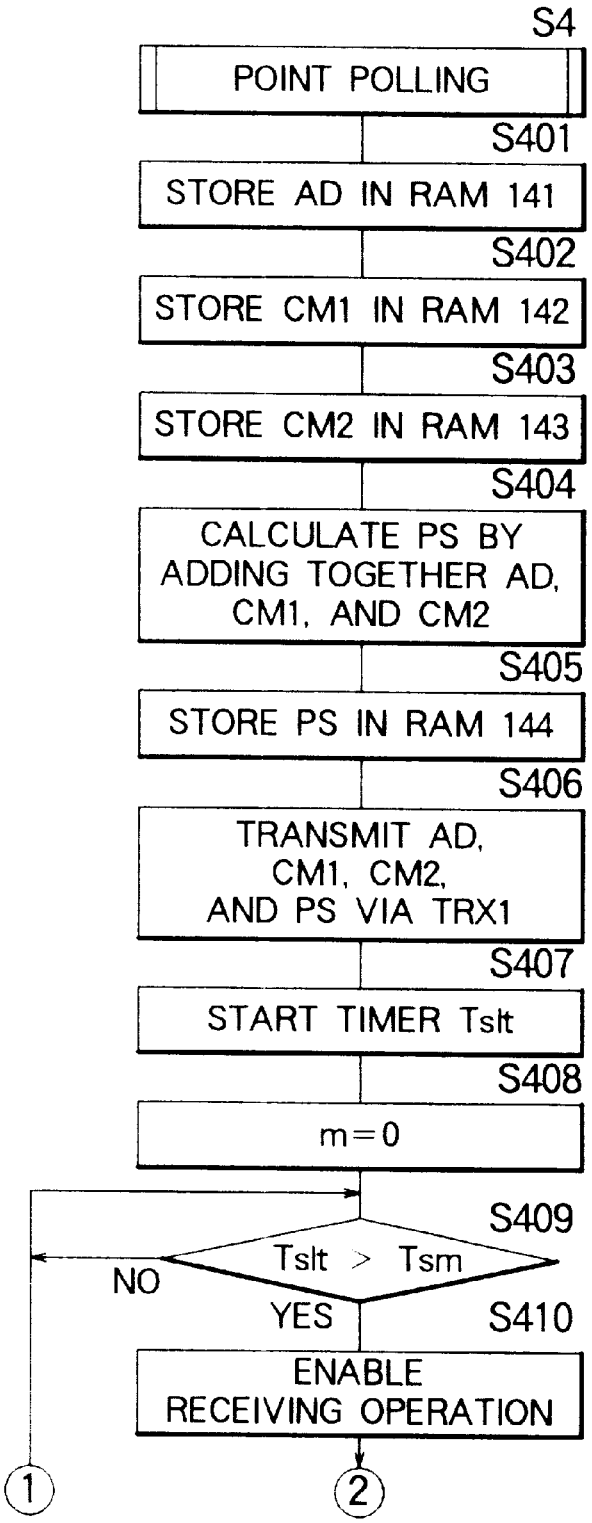
FIG. 10 is a flowchart illustrating a specific operation of the point polling process (step S4) shown in FIG. 9.
Figure 11:
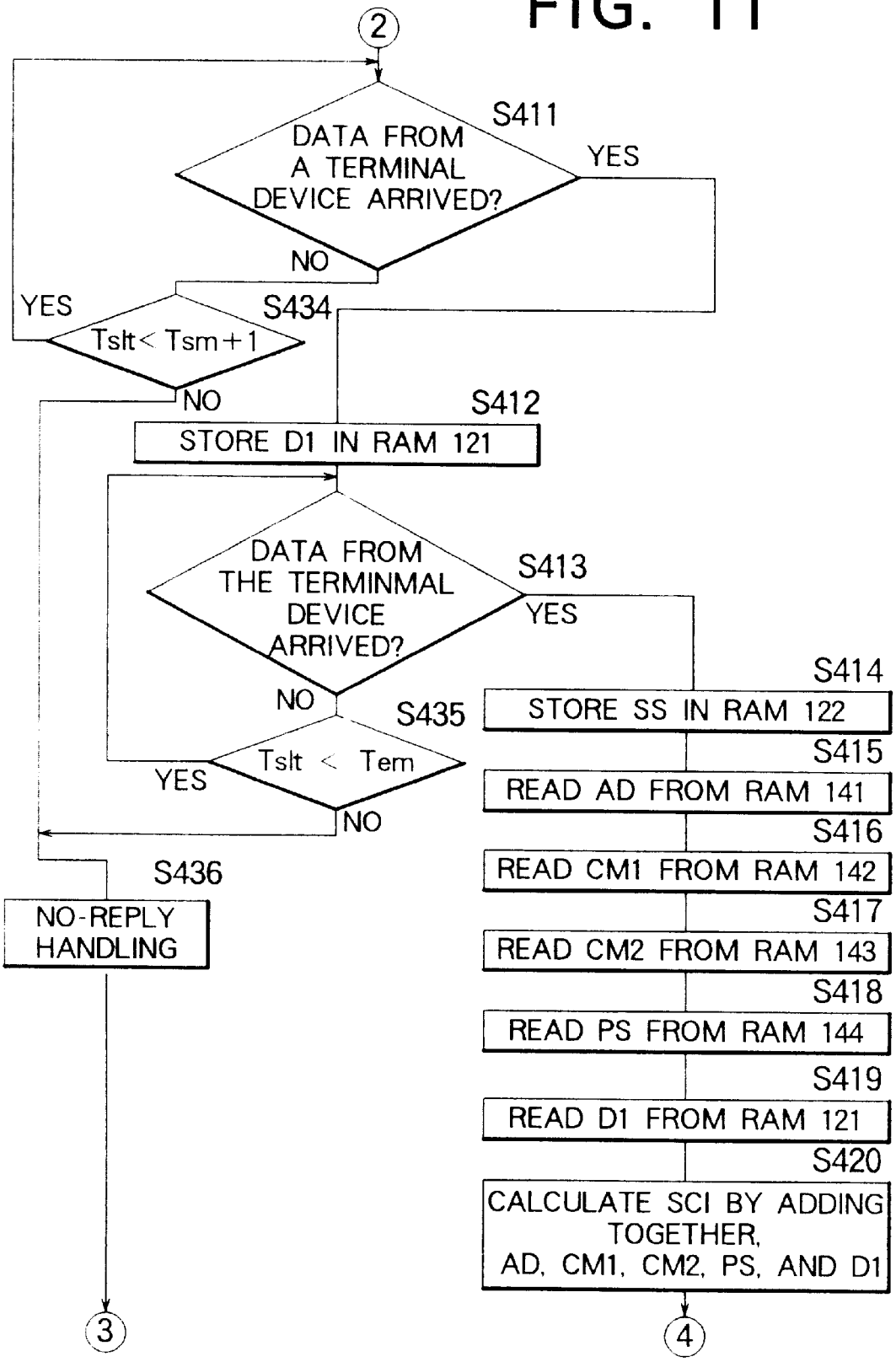
FIG. 11 is a flowchart illustrating the specific operation of the point polling process (step S4) shown in FIG. 9.
Figure 12:
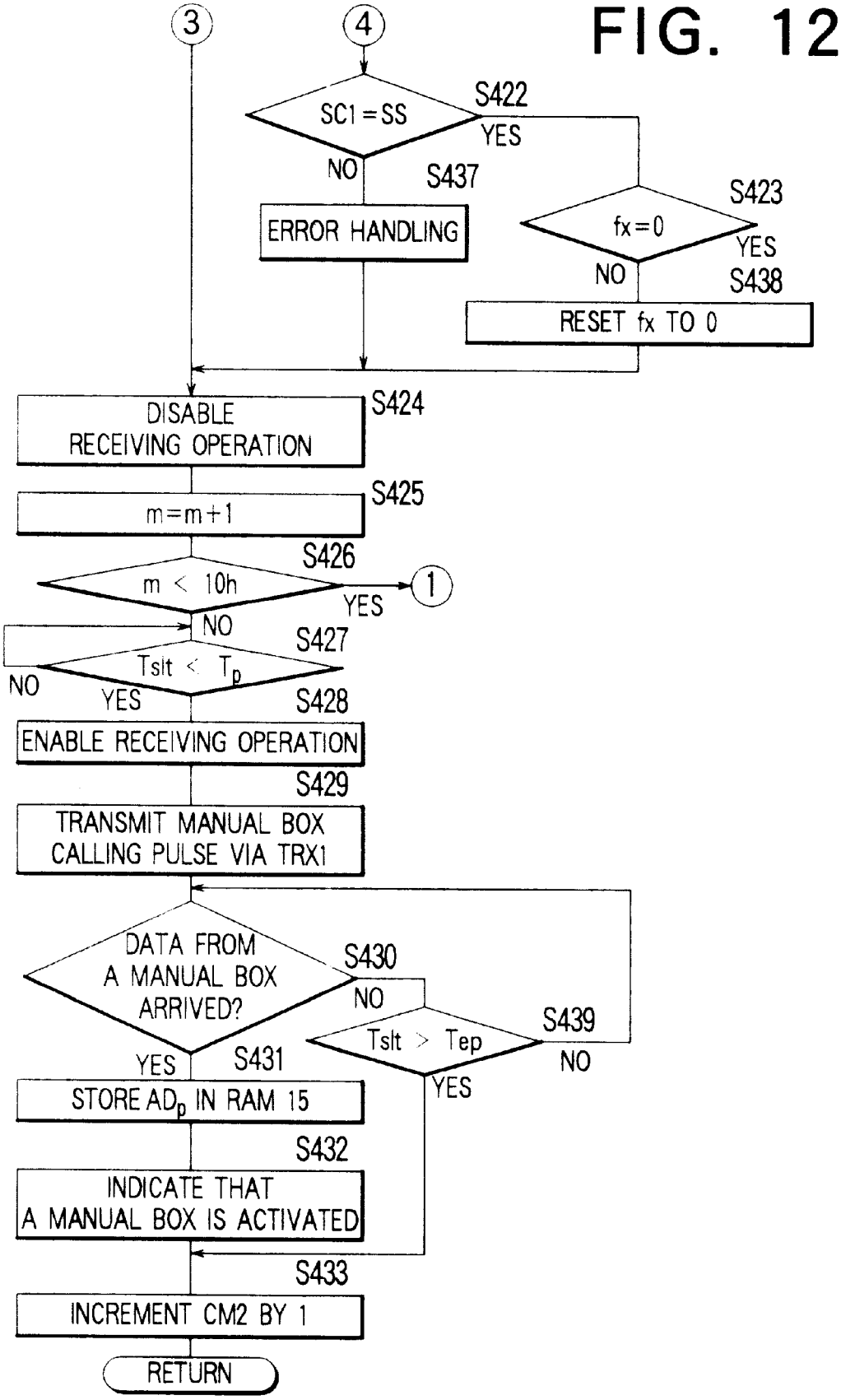
FIG. 12 is a flowchart illustrating the specific operation of the point polling process (step S4) shown in FIG. 9.

The ROM 31 is used to store programs and data used in the operation shown in the flowcharts of FIGS. 10 to 12. The ROM 32 is used to store the device address (the higher digit thereof represents the group number of the group to which the device belong, and the lower digit represents the terminal device number) and terminal type indicating information ID. Instead of the ROM 32, a dip switch or the like may also be employed.

The RAM 31 provides a work area. The RAM 32 is used to store the current status information (representing for example whether or not the on-off type fire sensor F is transmitting a signal indicating an event of a fire). The RAM 33 is used to store the information indicating when the status information regarding the terminal device having an intra-group terminal device number m should be transmitted to the fire alarming signal receiving device RE (that is, the information about the slot assigned to the terminal device). Hereinafter, the above-described timing is referred to as the data transmission start time Tdm. The timing in terms of when the status information should be transmitted to the fire alarming signal receiving device RE is calculated immediately after an initial setting operation, which will be described later, on the basis of the terminal device number indicated by the lower digit of the device address.

The RAM 34 is used to store an address AD, commands CM1 and CM2, a primary checksum code PS received from the fire alarming signal receiving device RE in a group information acquisition frame in a point polling operation, wherein the RAM 34 includes a RAM 341 for storing the address AD, a RAM 342 for storing the command CM1, a RAM 343 for storing the command CM2, and a RAM 344 for storing the primary checksum code PS. The RAM 35 is used to store a returning-back data D1 and a secondary checksum code SS to be returned to the fire alarming signal receiving device RE in a group information acquisition frame in a point polling operation, wherein the RAM 35 includes a RAM 351 for storing the returning-back data D1, and a RAM 352 for storing the secondary checksum code SS.

The RAM 36 is used to store an address AD, a command CM1, and a primary checksum code PS in a system polling operation, wherein the RAM 36 includes a RAM 361 for storing the address AD, a RAM 362 for storing the command CM1, and a RAM 363 for storing the primary checksum code PS.

The RAM 37 is used to store an address AD, a command CM1, and a primary checksum code PS in a selecting operation, wherein the RAM 37 includes a RAM 371 for storing the address AD, a RAM 372 for storing the command CM1, and a RAM 373 for storing the primary checksum code PS.

The RAM 38 is used to store the device address DA of the terminal device, a returning-back data Da, and a secondary checksum code SS returned back from the terminal device in a selecting operation, wherein the RAM 38 includes a RAM 381 for storing the address DA, a RAM 382 for storing the returning-back data Da, and a RAM 383 for storing the secondary checksum code SS.

The interface IF31 is used to connect the fire alarm signal receiver FSR to the microprocessor MPU3. The interface IF32 is used to connect the fire test circuit TE to the microprocessor MPU3. The interface IF33 is used to connect the local-area audible-alarm controller LAC to the microprocessor MPU3. The interface IF34 is used to connect the control circuit CLR between CL to the microprocessor MPU3. The interface IF35 is used to connect the smoke shutting-off control circuit BHR to the microprocessor MPU3. The interface IF36 is used to connect the SCI shutting-off control circuit SCR to the microprocessor MPU3. The interface IF37 is used to connect the voice alarm control circuit BAC to the microprocessor MPU3. The interface IF38 is used to connect the signal transmitter/receiver TRX3 to the microprocessor MPU3. The signal transmitter/receiver TRX3 is similar to the signal transmitter/receiver TRX1. Although in the above specific embodiment, the on-off type fire sensor, the local bell, the fire retarding door, the loud speaker are all connected to one transmitter, only any one of these devices may also be connected to the transmitter.

Figure 8:
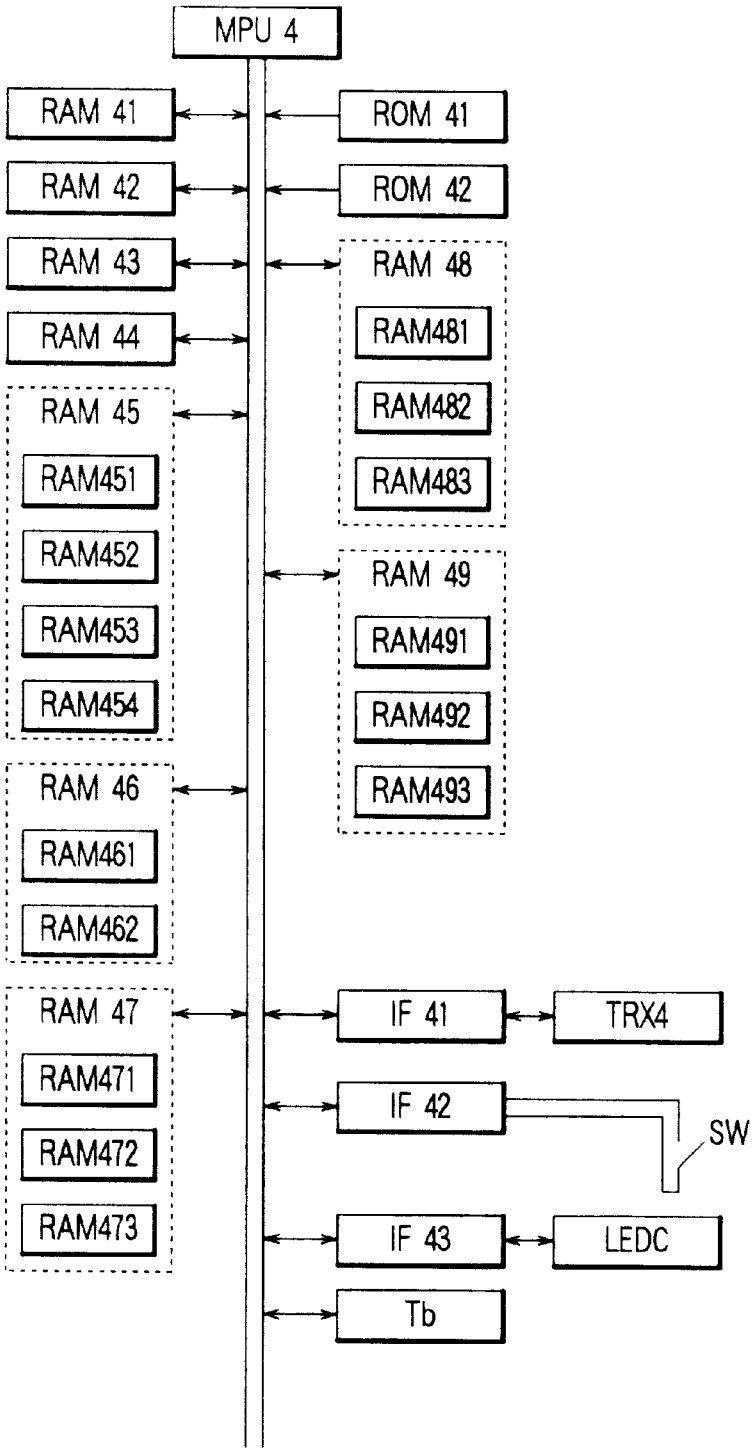
FIG. 8 is a block diagram illustrating a manual box P used in the above embodiment.

FIG. 8 is a block diagram illustrating a manual box P used in the present embodiment.

The manual box P includes: a microprocessor MPU4; read only memories ROM 41 and ROM 42; random access memories RAM 41 to RAM 49; interfaces IF41 to IF43; a signal transmitter/receiver TRX4; a switch SW of the push button type which will be operated when a fire occurs; a light emitting diode LED serving as a response lamp; a light emitting diode driving circuit LEDC for driving the response lamp LED; and a bit timer Tb.

Figure 18:
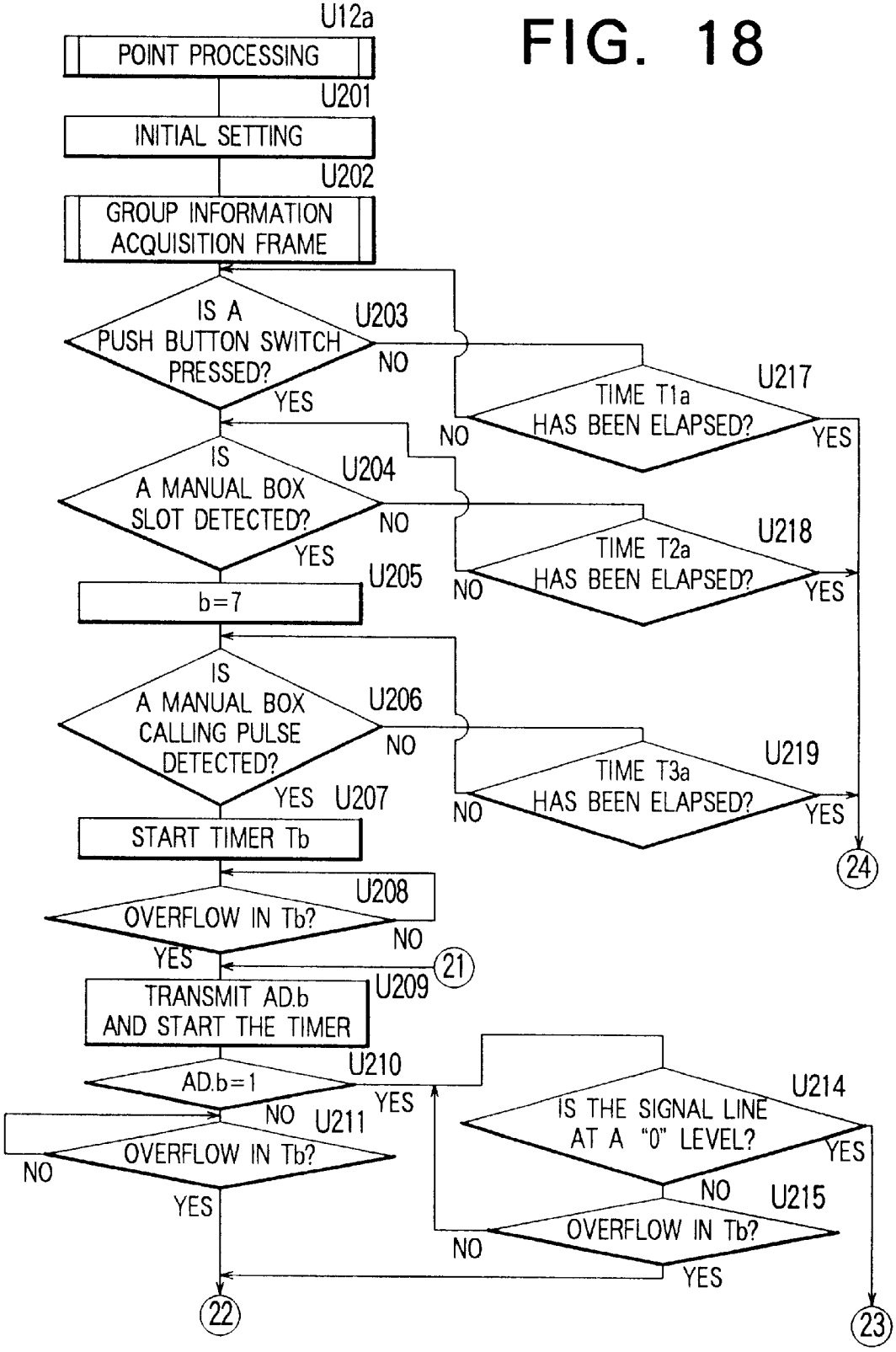
FIG. 18 is a flowchart illustrating the point processing operation of a manual box P serving as one of terminal devices according to the above embodiment.
Figure 19:
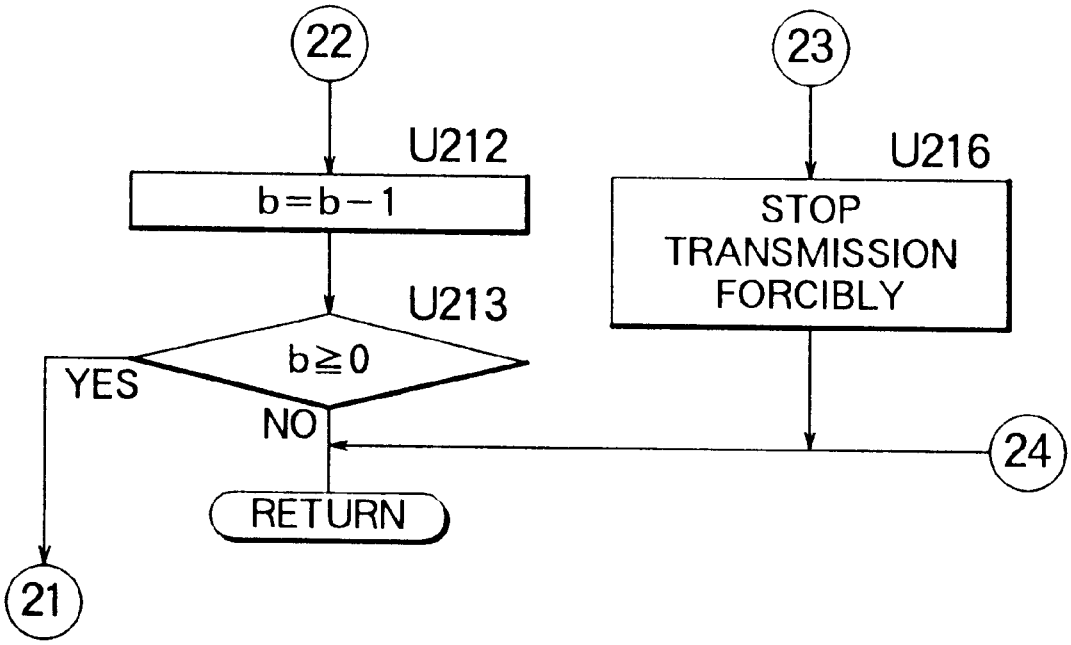
FIG. 19 is also a flowchart illustrating the point processing operation of the manual box P serving as one of terminal devices according to the above embodiment.

The ROM 41 is used to store programs and data used in the operation shown in the flowcharts of FIGS. 18 and 19. The ROM 42 is used to store the device address wherein the higher digit thereof represents the group number and the lower digit represents the terminal device number. Instead of the ROM 42, a dip switch or the like may also be employed.

The RAM 41 provides a work area. The RAM 42 is used to store the information representing the current operation status. The RAM 43 is used to store the information representing the timing in terms of when the information representing the operation status should be transmitted to the fire alarming signal receiving device RE in the operation shown in FIGS. 18 and 19. As in the case of the analog photoelectric fire sensor, the above timing is calculated immediately after the initial setting operation on the basis of the intragroup terminal device number m indicated by the lower digit of the device address. The RAM 44 is used to store the device address which will be transmitted when the manual box is activated in the operation shown in FIGS. 18 and 19.

The RAM 45 is used to store an address AD, commands CM1 and CM2, a primary checksum code PS received from the fire alarming signal receiving device RE in a group information acquisition frame in a point polling operation, wherein the RAM45 includes a RAM 451 for storing the address AD, a RAM 452 for storing the command CM1, a RAM 453 for storing the command CM2, and a RAM 454 for storing the primary checksum code PS.

The RAM 46 is used to store a returning-back data D1 and a secondary checksum code SS returned back to the fire alarming signal receiving device RE in a group information acquisition frame during a point polling operation, wherein RAM 46 includes a RAM 461 for storing the returning-back data D1, and a RAM 462 for storing the secondary checksum code SS.

The RAM 47 is used to store an address AD, a command CM1, and a primary checksum code PS received from the fire alarming signal receiving device RE in a system polling operation, wherein the RAM 47 includes a RAM 471 for storing the address AD, a RAM 472 for storing the command CM1, and a RAM 473 for storing the primary checksum code PS.

The RAM 48 is used to store an address AD, a command CM1, and a primary checksum code PS received from the fire alarming signal receiving device RE in a selecting operation, wherein the RAM 48 includes a RAM 481 for storing the address AD, a RAM 482 for storing the command CM1, and a RAM 483 for storing the primary checksum code PS.

The RAM 49 is used to store a device address DA, a returning-back data Da, and a secondary checksum code SS returned back to the fire alarming signal receiving device RE in a selecting operation, wherein the RAM 49 includes a RAM 491 for storing the device address DA, a RAM 492 for storing the returning-back data Da, a RAM 493 for storing the secondary checksum code SS.

The interface IF41 is used to connect the signal transmitter/receiver TRX4 to the microprocessor MPU4. The interface IF42 is used to connect the switch SW of the push button type to the microprocessor MPU4. The interface IF43 is used to connect the light emitting diode driving circuit LEDC serving as the response lamp to the microprocessor MPU4.

The signal transmitter/receiver TRX4 is similar to the signal transmitter/receiver TRX1. The bit timer Tb serves as a control timer for preventing a collision between a manual box calling pulse which will be described later and an address transmission signal.

The operation of the fire alarming signal receiving device RE according to the present embodiment will be described in further detail below.

Figure 9:
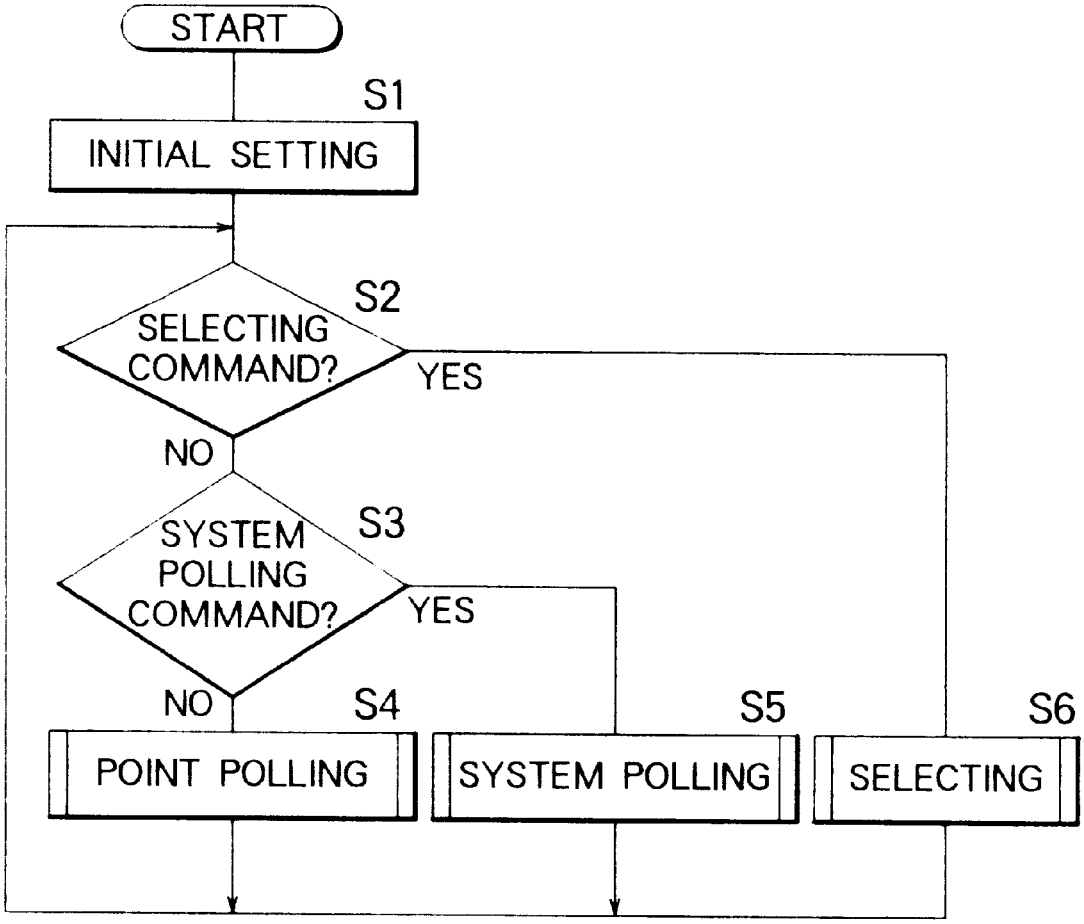
FIG. 9 is a system flow chart illustrating the operation of the fire alarming signal receiving device RE according to the above embodiment.

FIG. 9 is a system flow chart illustrating the operation of the fire alarming signal receiving device RE according to the present embodiment.

First, the fire alarm system is started by turning on the power supply thereof. Then initial setting is performed (step S1) in which the transmission error detection variables fx are set for example to "0" for all addresses. After that, it is judges whether a human operator has issued a selecting command telling for example that an indication lamp should be turned off, via the control panel OP of the fire alarming signal receiving device RE (step S2). If no selecting command is input in step S2, the process goes to step S3 so as to judge whether the human operator has issued a system polling command via the control panel OP of the fire alarming signal receiving device RE. If no system polling command is input in step S3, a point polling operation is performed in step S4 and then the process returns to step S2 so as to repeat the above operation (steps S2 to S4).

In the case where it is concluded in step S2 that the operator has input a selecting command such as an indication lamp turn-off command, the process goes to step S6 and performs the selecting operation. If it is concluded in step S3 that the operator has input a system polling command, then the process goes to step S5 and performs the system polling operation. On the other hand, if it is concluded in step S3 that no command is input by the operator via the control panel OP, the process goes to step S4 and performs the point polling operation.

The specific operation in the polling or selecting operation is designated by the particular command input by the operator via the control panel OP of the fire alarming signal receiving device RE. The specific contents of the address AD, the commands CM1, the command CM2, and the primary checksum code PS are determined according to the above particular command input, and the corresponding polling or selecting operation is performed.

FIGS. 10 to 12 are flowcharts illustrating the details of the point polling operation performed in step S4 of FIG. 9.

In these figures, the operation in a "group information acquisition frame" is performed substantially in steps S401 to S426, and the operation in a "manual box detection frame" is performed substantially in steps S427 to S433.

First, a polling command (AD=FFh), a state information transmission request command (CM1=01 h) in a point polling operation, a group designation code (for example CM2=00 h) in the point polling operation are stored in the RAM 141, RAM 142, and RAM 143, respectively (step S401 to S403).

Then the address AD and the commands CM1 and CM2 stored in the RAM 141 to RAM 143 are added together thereby obtaining a primary checksum code PS (step S404). The obtained primary checksum code PS is stored in the RAM 144 (step S405). The address AD, the commands CM1 and CM2, and the primary checksum code PS stored in the RAM 141 to RAM 144 are transmitted one by one via the signal transmitter/receiver TRX1. The control timer Tslt is then started (step S407). Furthermore, m is reset to 0 (step S408) wherein m is a hexadecimal number indicating the intragroup terminal device number. If the timer Tslt has already been started before step S408, the timer Tslt is reset and restarted.

Then it is judged whether the control timer Tslt indicates that the slot start time Tsm has come for receiving the returning-back data D1 and the secondary checksum code SS from the terminal device having an intragroup terminal device number equal to m (step S409), A subscript m of the slot start time Tsm indicates the intragroup terminal device number. If the control timer Tslt indicates that the slot start time Tsm has come (step S409), then the receiving operation is enabled (step S410).

On the other hand, if the control timer Tslt indicates that the slot start time Tsm has not come yet, the process remains in step S409 until the slot start time Tsm has come. Until the control timer Tslt indicates that the slot start time Tsm has come, the fire alarming signal receiving device RE does nothing to terminal devices (that is, the process enters a first waiting field WF1). If the receiving operation becomes enabled, and if a returning-back data D1 from a terminal device has arrived within a first time period T1 (step S411 and S434), the returning-back data D1 is stored in the RAM 121 (step S412).

The first time period T1 is a period from the above slot start time Tsm to the slot start time Tsm+1 assigned to a terminal device having an intragroup terminal device number (m+1) which is greater by 1 than the intragroup terminal device number of the terminal device of interest. The judgement of whether the first time period Tl has elapsed is made by the above control timer Tslt (S434).

If a secondary checksum code SS from the terminal device has arrived within a second time period T2 (step S413 and S435), the secondary checksum code SS is stored in the RAM 122 (step S414).

Herein the second time period T2 is defined as a period from the above slot start time Tsm to the slot end time Tem assigned to a terminal device having an intragroup terminal device number m. The judgement of whether the second time period T2 has elapsed is also made by the above control timer Tslt (S435). To determine whether the signal from the terminal device has arrived at the fire alarming signal receiving device RE without an error, a sum checking operation is performed using the secondary checksum code SS stored in the RAM 122.

That is, the address AD, the commands CM1 and CM2, the primary checksum code PS, and the returning-back data D1 are read from RAM 141 to RAM 144 and RAM 121, respectively (step S414 to S419). A secondary calculation code SC1 is then determined by adding together the address AD, the commands CM1 and CM2, the returning-back data D1, and the primary checksum code PS (step S420).

It is judged whether the obtained secondary calculation code SC1 is equal to the secondary checksum code SS stored in the RAM 122 (step S422). If the result of the judgement in step S422 is positive, then the received data can be regarded as having no error. If the above point polling operation is first execution (step S423), the receiving operation is disabled because the transmission error detection variable fx is equal to 0 (steps S423 and S424). Thus the acquisition of data from the terminal device whose intragroup terminal device number is equal to m is completed. If there is some data being received at this point in time, the data is discarded.

Then m is incremented by 1 (step S425), the above operation is repeated (steps S409 to S424) thereby acquiring a returning-back data D1 and a secondary checksum code SC1 from a terminal device having an intragroup terminal device equal to m+1. The above operation is performed repeatedly (steps S409 to S426)until m has reached 10 h. If m becomes greater than 10 h (step S426), that is, if the acquisition of the returning-back data D1 and the secondary checksum code SS are completed for all 16 terminal devices in the group, the process goes to step S427.

In this way, the returning-back data D1 of the terminal devices belonging to one group are transmitted device by device in slots assigned to the respective terminal devices and thus the fire alarming signal receiving device RE acquires a set of group information.

In the case where the returning-back data D1 from the terminal device having the x-th address number cannot be received within the predetermined time period Tsm+1 (S434), a no-reply handling process is performed for the terminal device having the x-th address number (S436). In the no-reply handing process, the transmission error detection variable fx for the terminal device having the x-th address number is incremented by 1. If the transmission error detection variable fx becomes for example 3, an error indication is given on the display DP of the fire alarming signal receiving device RE (thereby notifying that an error has occurred). The variables fx used to indicate the number of detected errors are stored in the RAM 16 for each-address. Also in the case where the secondary checksum code SS from the terminal device having x-th address number cannot be received within the predetermined time period Tem (S435), the transmission error detection variable fx is incremented by 1 and a no-reply handling process is performed (S436). If the transmission error detection variable fx reaches 3, an error indication is given on the display DP of the fire alarming signal receiving device RE (thereby notifying that an error has occurred). As in the previous case, the transmission error detection variables fx are stored in the RAM 16 for each address. If the secondary calculation code SC1 is not equal to the secondary checksum code SS in step S422 (that is, if the result of the sum checking operation is invalid), then an error handling process is performed (S437). In the error handling process, as in the no-reply handling process, the transmission error detection variable fx is incremented by 1. If the transmission error detection variable fx reaches 3, an error indication is given on the display DP of the fire alarming signal receiving device RE (thereby notifying that an error has occurred). The transmission error detection variables fx are stored in the RAM 16 for each address.

In the second execution and also in the further subsequent executions of the point polling operation, it is judged in step S423 whether or not the transmission error detection variable fx is equal to 0 (that is, it is judged whether the value fx stored in the RAM 16 is equal to 0 thereby judging whether a no-reply handling process or an error handling process has been performed for the terminal device of interest in the polling operations before the present execution). If no error was detected in the previous execution (that is, if fx is equal to 0) (S423), the receiving operation is disabled (S424).

On the other hand, if it is concluded in step S423 that an error was detected in the previous execution (that is, if the transmission error detection variable fx is not equal to 0), the transmission error detection variable fx is reset to 0 (step S438). Therefore, unless a no-reply handling process or an error handling process is performed three times in succession, an error indication is not given (an indication notifying that a transmission error has occurred is not given). The transmission error detection variable fx reset to 0 are stored again in the RAM 16 at the corresponding address.

In the fire alarming system according to above embodiment, a plurality of terminal devices such as fire sensors, transmitters, manual boxs, and/or other devices to be controlled are connected to a fire alarming signal receiving device, and the fire alarming system further includes: transmission error detecting means for detecting a transmission error when any of the plurality of terminal devices has a transmission error or a non-reply error; storage means for storing the number of times that the transmission error occurs; and transmission error indicating means for indicating that a transmission error has occurred when the number of times that the transmission error occurs stored in said storage means becomes greater than a predetermined number.

Furthermore, in the fire alarming system according to the above embodiment, a plurality of terminal devices such as fire sensors, transmitters, manual boxs, and/or other devices to be controlled are connected to a fire alarming signal receiving device, and the fire alarming system is characterized in that even when some terminal device has a transmission error, a polling operation is continued without being terminated.

With the above arrangement, even if a transmission error occurs during a point polling operation and thus if a no-reply handling process or an error handling process is performed, it is possible to continue the point polling operation. Therefore, the transmission error does not cause an increase in the total time required to perform the polling operation for the entire terminal devices.

Now, the operation in a "manual box detection frame" (performed substantially in steps S427 to S433) will be described below. First, the microprocessor MPU1 judges whether the control timer Tslt indicates that the manual box slot start time Tp has come (step S427). If it is concluded in step S427 that the control timer Tslt indicates that the manual box slot start time Tp has come, a manual box detection frame is started, and the receiving operation is enabled in step S428. A manual box calling pulse PC is transmitted from the signal transmitter/receiver TRX1 (step S429).

The manual box calling pulse PC also serves as a start bit for the data transmission from a manual box P to the fire alarming signal receiving device RE. By the fire-alerting-device calling pulse PC, not only the manual boxs in one group but the manual boxs of all groups are called. Therefore, the fire alarming signal receiving device RE can acquire the address ADp of a manual box P in an activated state for all groups.

If the address ADp of a manual box P in an activated state is received within a third time period T3 (S430, S439), the obtained address ADp is stored in the RAM 15 (S431), and the display on the fire alarming signal receiving device RE indicates that the manual box P has detected an event of a fire a nd also indicates the address of that manual box P (S432). The command (group designation code) CM2 is then incremented by 1, and the result is stored in the RAM 143 (S433). In this case, the previous content of the group designation code CM2 is deleted. Herein the "third time period" T3 refers to a period from a manual box slot start time Tp to a manual box slot end time Tep. The control timer Tslt monitors the elapse of time and determines whether the third time period T3 has elapsed.

If the control timer Tslt concludes that the elapsed time has not reached the manual box slot end time Tep (S439), the control timer Tslt waits until the elapsed time has reached the manual box slot end time Tep (S430).

If the address ADp of a manual box P in an activated state does not arrive at the fire alarming signal receiving device RE within the third time period T3 (S430, S439), the group designation code CM2 is incremented by 1 and the result is stored in the RAM 143 (S433). Also in this case, the previous content of the group designation code CM2 is deleted.

If in the above step S433, the group designation code becomes equal to the last group number, it is reset to the first group number.

In this way, the addresses ADp of all manual boxs P in all groups are returned as the activated manual box address information to the fire alarming signal receiving device RE in the manual box slot and thus the fire alarming signal receiving device RE acquires the information. Then the group designation code (command) CM2 is incremented by 1 (S433), and the process enters a second waiting field WF2 (not shown) in which the fire alarming signal receiving device RE does nothing to terminal devices. After the second waiting field WF2, the microprocessor MPU1 returns the process to step S2. If neither a selecting command nor a system polling command is issued (S2, S3), the point polling operation including the group information acquisition frame is performed for the group having the next group number, that is group number 1 in this case.

The variations in the transmission timing of the returning-back data D1 and the secondary checksum code SS returned back from the respective terminal devices are absorbed in the above-described second waiting field WF2. The above tolerance in terms of the signal transmission facilitates the processing requirements of terminal devices, and also makes it possible to achieve synchronization associated with the transmission byte frame.

The point polling operation including the "group information acquisition frame" and the "manual box detection frame" is performed sequentially for the groups 2, 3, . . . , 15. After completion of the above point polling operation for acquiring the status information, the terminal type indicating information ID is acquired by performing the point polling operation in which instead of the state information transmission request command (CM1=01 h) a terminal type identification information transmission request command (CM1=00 h) as well as an address AD and a command CM2 is transmitted by the fire alarming signal receiving device RE. That is, the point polling operation including a "group information acquisition frame" and a "manual box detection frame" is performed sequentially for the groups 0, 1, 2, 3, . . . ,15.

This point polling operation is performed in substantially the same manner as the above-described point polling operation including the "group information acquisition frame" for acquiring the status information except that instead of the status information, the terminal type indicating information ID is transmitted as the returning-back data D1. After completion of the above point polling operation, the point polling operation including the "group information acquisition frame" and the "manual box detection frame" for acquiring the status information and the point polling operation including the "group information acquisition frame"

and the "manual box detection frame" for acquiring the terminal type indicating information ID are performed alternately.

Alternatively, the fire alarming signal receiving device RE may further include a transmission frame length control timer Tf and the transmission frame length control timer Tf may be started before step S2 so that the processes from step S2 to step S433 is performed before an overflow occurs in the transmission frame length control timer Tf. In the case where the second waiting field WF2 is not completed within the above time period, the point polling which is in process for a particular group is forcibly stopped, and the group designation code CM2 is incremented by 1 and the point polling operation for the next group is started.

Via the above operation, the status information of the terminal devices of the groups G0 to G15 is acquired from a group to another. Furthermore, in the above operation, it is possible to acquire the addresses of all manual boxs in activated states of all groups only by executing the point polling once. On the basis of the acquired data, the fire alarming signal receiving device RE can determine which terminal device has detected an event of a fire.

Although in the above embodiment, the point polling operation including the "group information acquisition frame" and the "manual box detection frame" for acquiring the status information and the point polling operation including the "group information acquisition frame" and the "manual box detection frame" for acquiring the terminal type indicating information ID are performed alternately, only the point polling operation including the "group information acquisition frame" and the "manual box detection frame" for acquiring the status information may be performed in a normal state, and the point polling operation including the "group information acquisition frame" and the "manual box detection frame" for acquiring the terminal type indicating information ID is performed only when a human operator issues a command via the control panel OP thereby telling the fire alarming signal receiving device RE to perform the point polling operation including the "group information acquisition frame" and the "manual box detection frame" for acquiring the terminal type indicating information ID. After acquiring the terminal type indicating information ID for all terminal devices, the process may return to the routine in which only the point polling operation including the "group information acquisition frame" and the "manual box detection frame" for acquiring the status information is performed.

In the above "point polling" operation for acquiring the terminal type indicating information ID, the manual box detection frame may be skipped.

Figure 13:
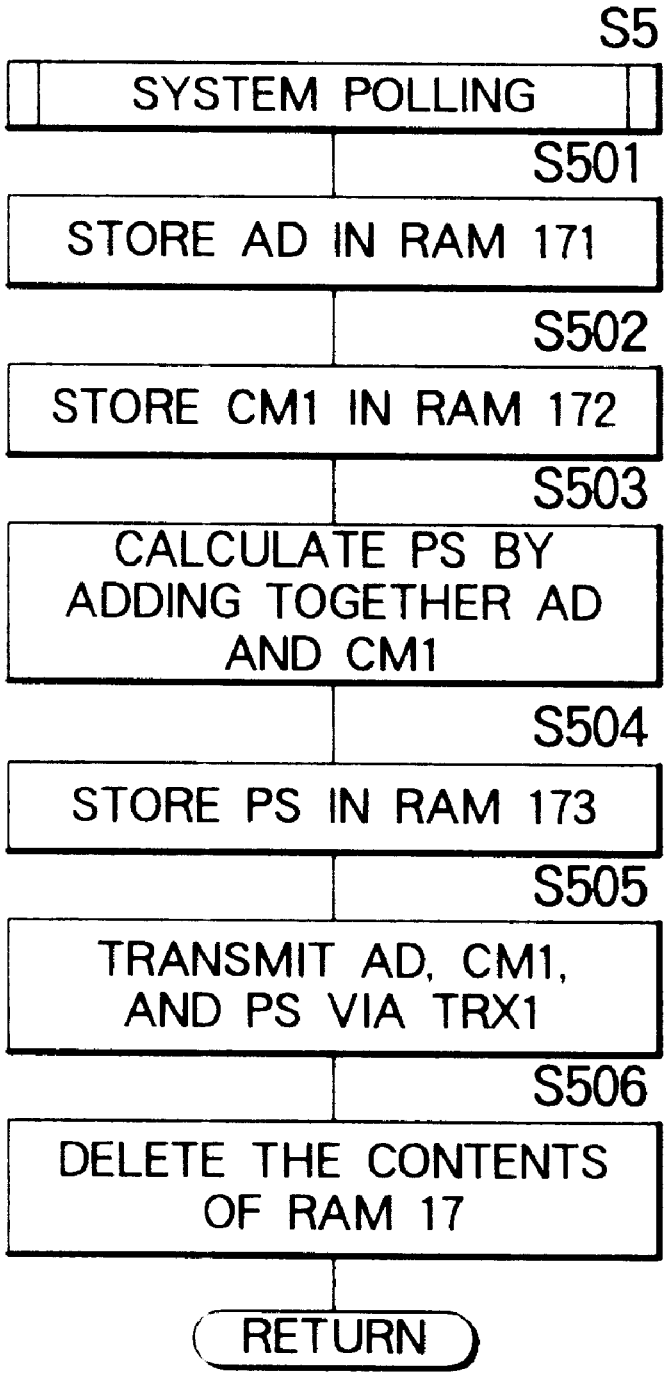
FIG. 13 is a flowchart illustrating a specific example of an operation performed when an operator inputs a command via the control panel OP to tell the fire alarming signal receiving device RE to perform a system polling operation (step S5)

FIG. 13 is a flowchart illustrating a specific operation performed when an operator inputs a command via the control panel OP to tell the fire alarming signal receiving device RE to perform a system polling operation.

If the above command is input via the control panel OP in step S5, a system polling operation is started and an address AD and a command CM1 are stored in the RAM 171 and RAM 172, respectively (steps S501 and S502). A primary checksum code PS is then determined by adding together the address AD and the command CM1 (S503). The resultant primary checksum code PS is stored in the RAM 173 (S504).

The address AD, the command CM1, and the primary checksum code PS stored in the RAM 171 to RAM 173 are sequentially transmitted via the signal transmitter/receiver TRX1 (S505). After the transmission, the address AD, the command CM1, and the primary checksum code PS are removed from RAM 17 so as to prevent these data from being transmitted again (S506). Then the process returns to step S2 of FIG. 9.

Although in the above embodiment, terminal devices do not respond when the fire alarming signal receiving device RE transmits the address AD, the command CM1, and the primary checksum code PS, terminal devices may transmit a response signal D1 telling that the command CM1 from the fire alarming signal receiving device RE has been received and may further transmit a secondary checksum code SS used by the fire alarming signal receiving device RE to determine whether the transmission from terminal devices to the fire alarming signal receiving device RE has been performed successfully without an error, as in the point polling operation illustrated above with reference to FIGS. 10 to 12.

Figure 14:
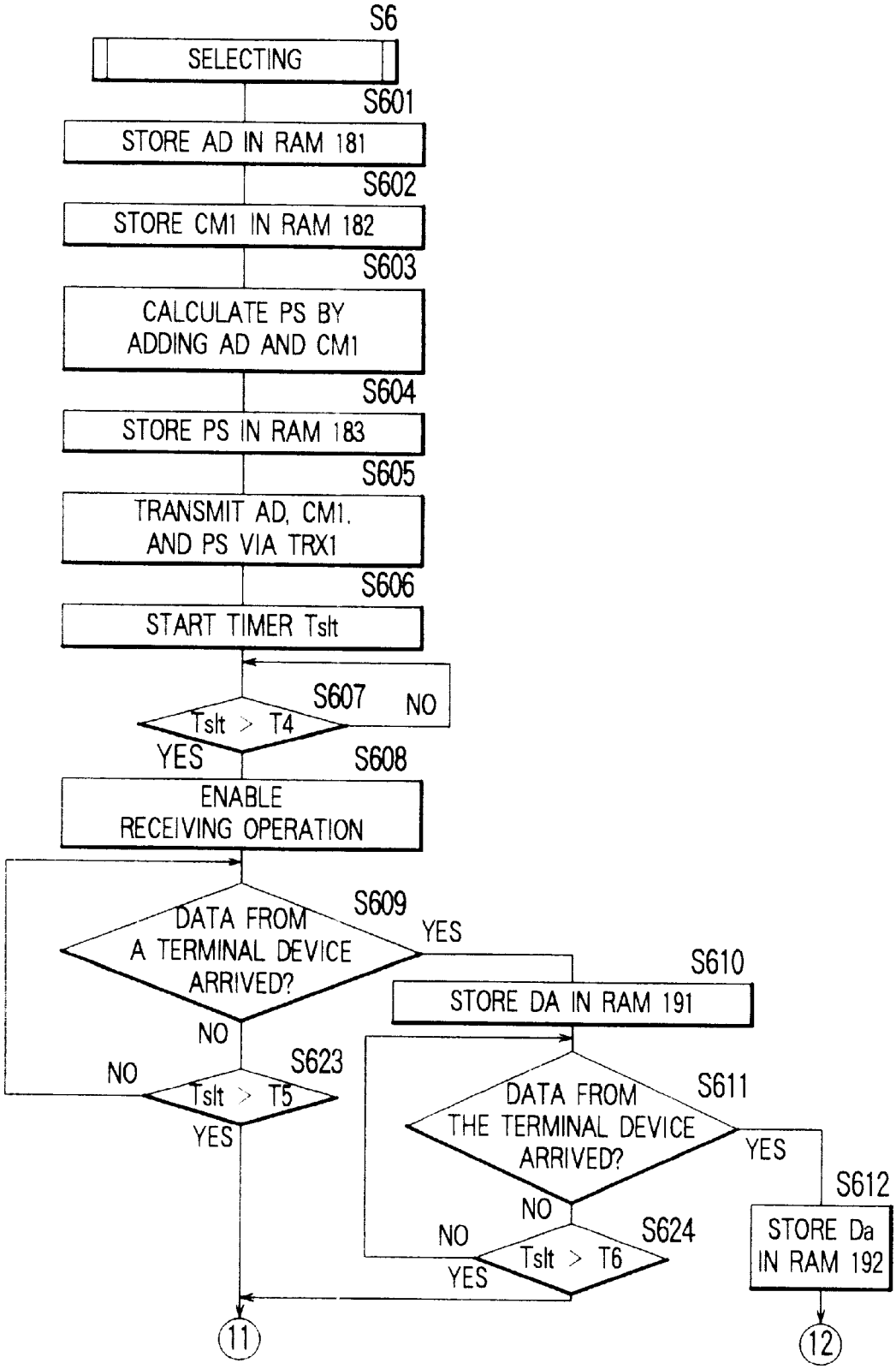
FIG. 14 is a flowchart illustrating a specific example of an operation performed when an operator inputs a command via the control panel OP to tell the fire alarming signal receiving device RE to perform a selecting operation (step S6)
Figure 15:
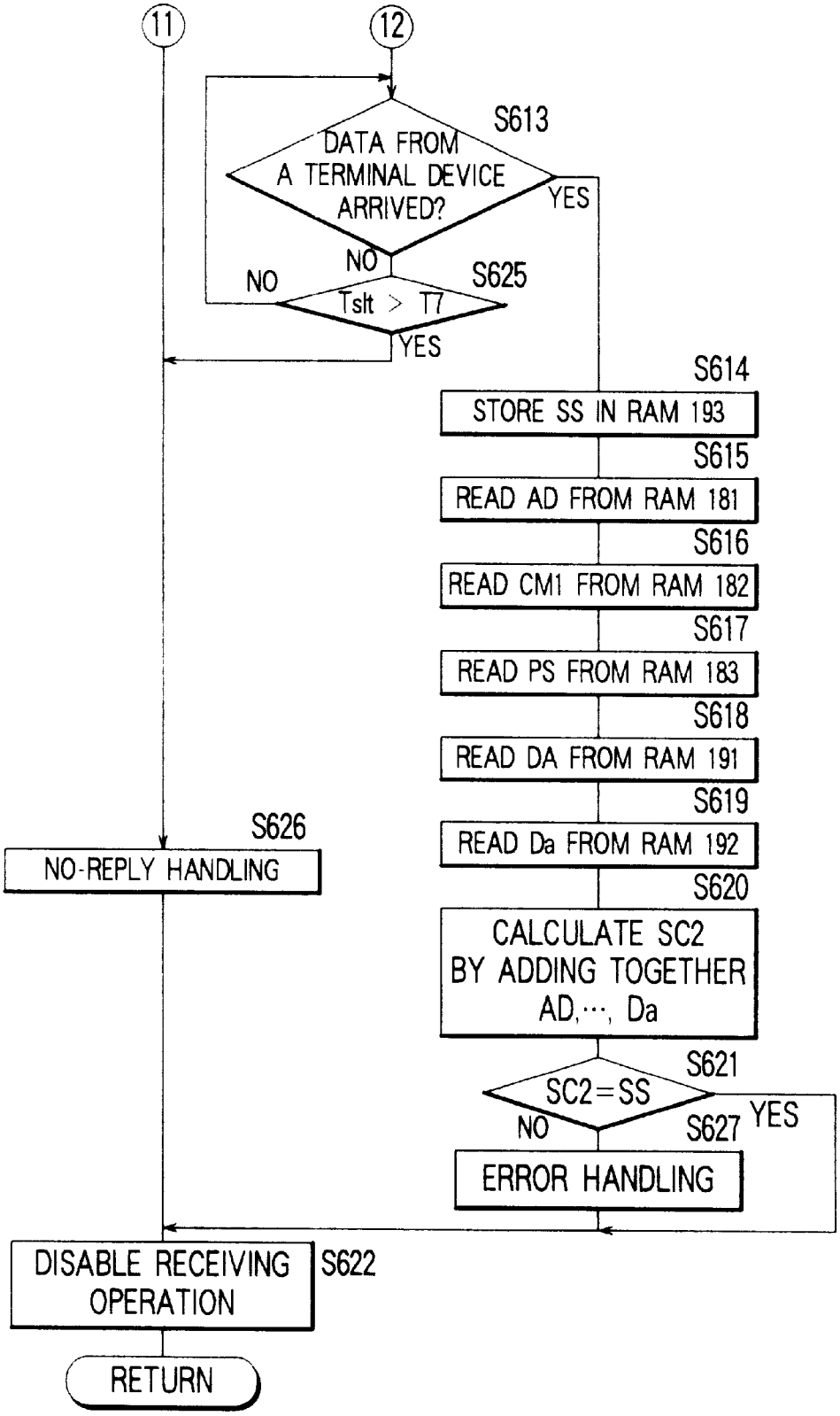
FIG. 15 is also a flowchart illustrating the specific example of the operation performed when an operator inputs a command via the control panel OP to tell the fire alarming signal receiving device RE to perform a selecting operation (step S6)

FIGS. 14 and 15 are flowcharts illustrating a specific operation performed when an operator inputs a command via the control panel OP to tell the fire alarming signal receiving device RE to perform a selecting operation.

If the above command is input via the control panel OP in step S6, a system polling operation is started and an address AD and a command CM1 are stored in the RAM 181 and RAM 182, respectively (steps S601 and S602). A primary checksum code PS is then determined by adding together the address AD and the command CM1 (S603). The resultant primary checksum code PS is stored in the RAM 183 (S604). The address AD, the command CM1, and the primary checksum code PS stored in the RAM 181 to RAM 183 are sequentially transmitted via the signal transmitter/receiver TRX1 (S605).

The control timer Tslt is then started (S606). The control timer Tslt monitors the elapse of time and determines whether or not it is a start time T4 of a slot in which the device address DA, a returning-back data Da, and a secondary checksum code SS are received from the terminal device having an intragroup terminal device number equal to m (step S607). If the control timer Tslt indicates that the above slot start time T4 has come (S607), the receiving operation is enabled (S608).

On the other hand, if the control timer Tslt indicates that the slot start time T4 has not come yet (S608), the process waits in step S609 until the control timer indicates that the slot start time T4 has come. Until the control timer Tslt indicates that the slot start time T4 has come, the process remains in a first waiting field WF1 in which the fire alarming signal receiving device RE does nothing to terminal devices. If the device address DA has arrived from the terminal device having that device address within a predetermined time period T5 (S609, S623), the received device address DA of the terminal device is stored in the RAM 191 (S610), wherein the judgement of whether the predetermined time period TS has elapsed is made by the above control timer Tslt. After that, if the returning-back data Da has been received from the terminal device within the predetermined time period T6 (S611, S624), the received returning-back data Da is stored in the RAM 192 (S612). The judgement of whether the predetermined time period T6 has elapsed is also made by the above control timer Tslt. Furthermore, if the secondary checksum code SS has be received from the terminal device within the predetermined time period T7 (S613, S625), the received secondary checksum code SS is stored in the RAM 193 (S614), wherein the judgement of whether the predetermined time period T7 has elapsed is also made by the above control timer Tslt.

To determine whether the signal from the terminal device has arrived at the fire alarming signal receiving device RE without an error, a sum checking operation is performed using the secondary checksum code SS stored in the RAM 193. That is, the address AD, the command CM1, the primary checksum code PS, the device address DA of the terminal device, and the returning-back data Da are read from the RAM 181–RAM 183, RAM 191, and RAM 192, respectively (step S615 to S619). A secondary calculation code SC2 is then determined by adding together the address AD, the commands CM1, the primary checksum code PS, the device address DA of the terminal device,and the returning-back data Da (step S620).

Then it is judged whether the obtained secondary calculation code SC2 is equal to the secondary checksum code SS stored in the RAM 193 (step S621). If the result of the sum checking operation is positive, then the received data is regarded as having no error (S621), and the receiving operation is disabled (S622). Then the process returns to step S2 of FIG. 9.

In the case where the device address DA cannot be received from the terminal device within the predetermined time period T5 (S609, S623), a no-reply handling process is performed in step S626 (an error indication is given on the display DP of the fire alarming signal receiving device RE thereby notifying that no reply has arrived).

Also in the case where the returning-back data Da from the terminal device has not arrived within the predetermined time period T6 (S624) or the secondary checksum code SS from the terminal device has not arrived within the predetermined time period T7 (S625), the no-reply handling process is performed (an error indication is given on the display DP of the fire alarming signal receiving device RE thereby notifying that a transmission error has occurred) (S626).

If the secondary calculation code SC2 is not equal to the secondary checksum code SS in step S621 (that is, if the result of the sum checking operation is invalid), then an error handling process is performed (an error indication is given on the display DP of the fire alarming signal receiving device RE thereby notifying that a transmission error has occurred) (S627).

Also in the case where either the no-reply handling process is performed (S626) or the error handling process is performed (S627), the receiving operation is disabled (S622), and the process returns to step S2 of FIG. 9.

Figure 16:
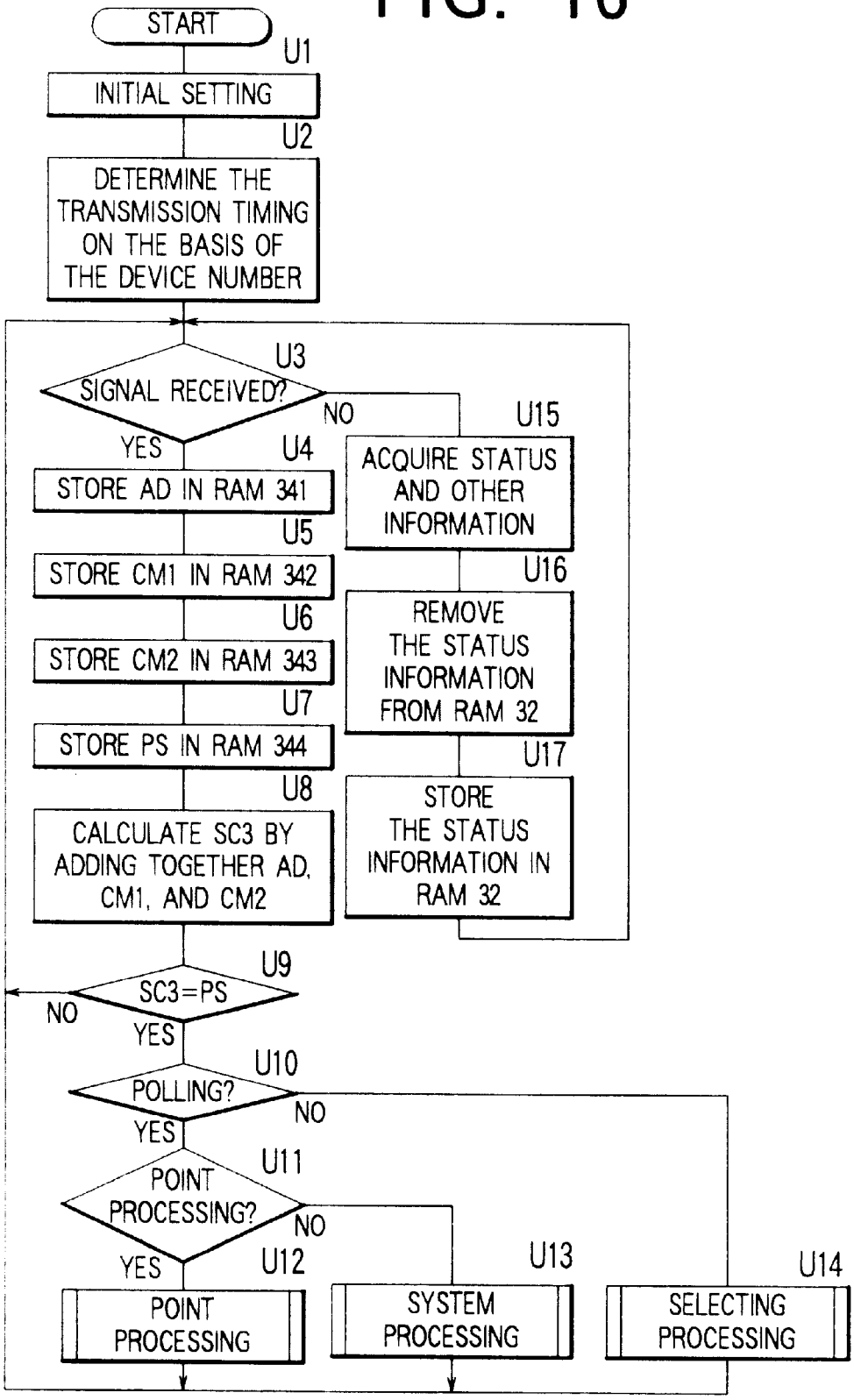
FIG. 16 is a main flowchart illustrating the operation of a transmitter RP serving as one of terminal devices according to the above embodiment.

FIG. 16 is a main flowchart illustrating the operation of a transmitter RP as an example of a terminal device used in the present embodiment.

First, initial setting is performed (step U1) and the data transmission timing (data transmission start time Tdm) is calculated from the intragroup terminal device number in the group to which that device belongs (step U2). If there is a received signal (U3), the address AD, the commands CM1 and CM2, and the primary checksum code PS are stored in the RAM 341 to RAM 344, respectively (steps U4 to U7).

A primary calculation code SC3 is determined by adding together the address AD, and the commands CM1 and CM2 stored in the RAM 341 to RAM 343 (U8). Then it is judged whether the obtained primary calculation code SC3 is equal to the primary checksum code PS (step U9). If the checksum code PS in terms of the received signal is valid (step U9), the transmission is regarded as valid and then it is judged whether or not the content of the address AD is a polling command (step U10). If it is a polling command, then it is further judged whether or not the content of the command CM1 is a point processing command (step U11). If it is a point processing command (CM1=0 Xh), the designated point processing command is performed (step U12).

If it is concluded in step U10 that the content of the address AD is not a polling command (AD≠FF), then a selecting process is performed (step U14).

On the other hand, if it is concluded in step U11 that the command CM1 is not a point processing command (CM1≠0 Xh), then a system processing is performed (step U13).

If there is no received signal (step U3), the status information is acquired (step U15) and the obtained status information is stored in the RAM 32. At this point in time, if the RAM 32 includes data for the previous 5 executions, then the oldest status data is removed (steps U16 and U17).

In the case where an on-off type fire sensor F or a gas leakage sensor G is connected to the transmitter, the transmitter acquires the status information by checking whether there is a fire alarming signal or a gas leakage alarming signal. In the case where a fire door D is connected to the transmitter, the transmitter acquires the status information by checking whether the signal produced by the fire retarding door D is an open-state signal indicating that the door is in an open state or a closed-state signal indicating that the door is in a closed state. On the other hand, when a local bell B is connected to the transmitter, the transmitter acquires the status information by checking whether there is a ringing-state signal indicating that the local bell B is in a ringing state.

The operation for a photoelectric fire sensor S and a manual box P is also performed in a similar manner.

In the case where no command CM2 is transmitted from the fire alarming signal receiving device RE as is in the system polling operation and the selection operation, the operation is performed in a similar manner except that step U6 is not performed.

In the sum checking operation described above, different combinations of codes, which should result in different sums, can have an equal sum. For example, if an equal address is assigned to two different terminal devices, the checksum can be equal for these two terminal devices.

In the case where an equal address is assigned to different terminal devices, these terminal devices transmit their data to the receiving device at the same time. If the data D1 transmitted from these different terminal devices are equal to each other, no problem occurs. However the data D1 are different from each other, a problem occurs as described below.

Assume that the 0th bit of the returning-back data D1 is assigned to a fire alarming bit, and the 0th bit is set to "1" when a fire occurs while the 0th bit is set to "0" when there is no fire. If a collision occurs between fire alarming bits of "1" and "0", then the result on the signal line L becomes "0". Therefore, if one of terminal devices assigned the same address detects an event of a fire while the other one detects no fire, the former terminal device transmits a "1" at the 0th bit and the latter terminal device transmits a "0" at the 0th bit. Thus, a collision occurs between the "1" and "0", and the result on the signal line L becomes "0". As a result, the fire alarming signal receiving device receives the data having "0" at the 0th bit, and concludes that no fire is detected at the terminal devices assigned the same address. Therefore, in the case where only one of the two terminal devices having the same address detects an event of fire, the fire alarming signal cannot arrive at the fire alarming signal receiving device RE.

To avoid the above problem, the reporting signal may be transmitted over the signal line L after inverting it. The fire alarming signal receiving device RE inverts the received signal into the original form. This ensures that a fire alarming signal can arrive at the fire alarming signal receiving device RE even when only one of two terminal devices having the same address detects an event of a fire.

In the fire alarming system according to the above embodiment, as described above, a plurality of terminal devices including fire sensors, transmitters, manual boxs, and/or other devices to be controlled are connected via a signal line to a receiving device, and the fire alarming signal receiving device polls the plurality of terminal devices thereby acquiring terminal device information from the terminal devices, making decision, displaying information, and/or controlling the terminal devices, wherein the fire alarming system is characterized in that it further includes: first signal inverting means disposed at a node between the fire alarming signal receiving device and the signal line; and second signal inverting means disposed at a node between each terminal device and the signal line.

Furthermore, in the above embodiment, the fire alarming signal receiving device includes: primary sum code generating means for generating a primary sum code by adding together an address code and a command code to be transmitted to the terminal devices; and first transmission means for transmitting the address code, the command code, and the primary sum code; each said terminal device includes: first sum code generating means for generating a first sum code by adding together the address code and the command code received from the fire alarming signal receiving device; first judgement means for judging whether the first sum code is equal to the primary sum code received from the fire alarming signal receiving device; secondary sum code generating means for generating a secondary sum code by adding together returning-back data to be returned to the fire alarming signal receiving device, the address code received from the fire alarming signal receiving device, the command code received from the fire alarming signal receiving device, and the primary sum code received from the fire alarming signal receiving device, the secondary sum code being generated when the first sum code is equal to the primary sum code; and second transmission means for transmitting the returning-back data and the secondary sum code to the fire alarming signal receiving device; and the fire alarming signal receiving device further includes: second sum code generating means for generating a second sum code by adding together said returning-back data received from the terminal, said address code to be transmitted to the terminal device, the command code to be transmitted to the terminal device, and the primary sum code to be transmitted to the terminal device; and second judgement means for judging whether the second sum code is equal to the secondary sum code received from the terminal device.

In the above embodiment, the addresses AD and DA are examples of the address code, the commands CM1 and CM2 are examples of the command code, and the returning-back data D1 and Da are examples of the above-described returning-back data.

Furthermore, in the above embodiment, the primary sum code may be modified so as not to be included in that summing object when a secondary sum code and a second sum code are generated.

Figure 17:
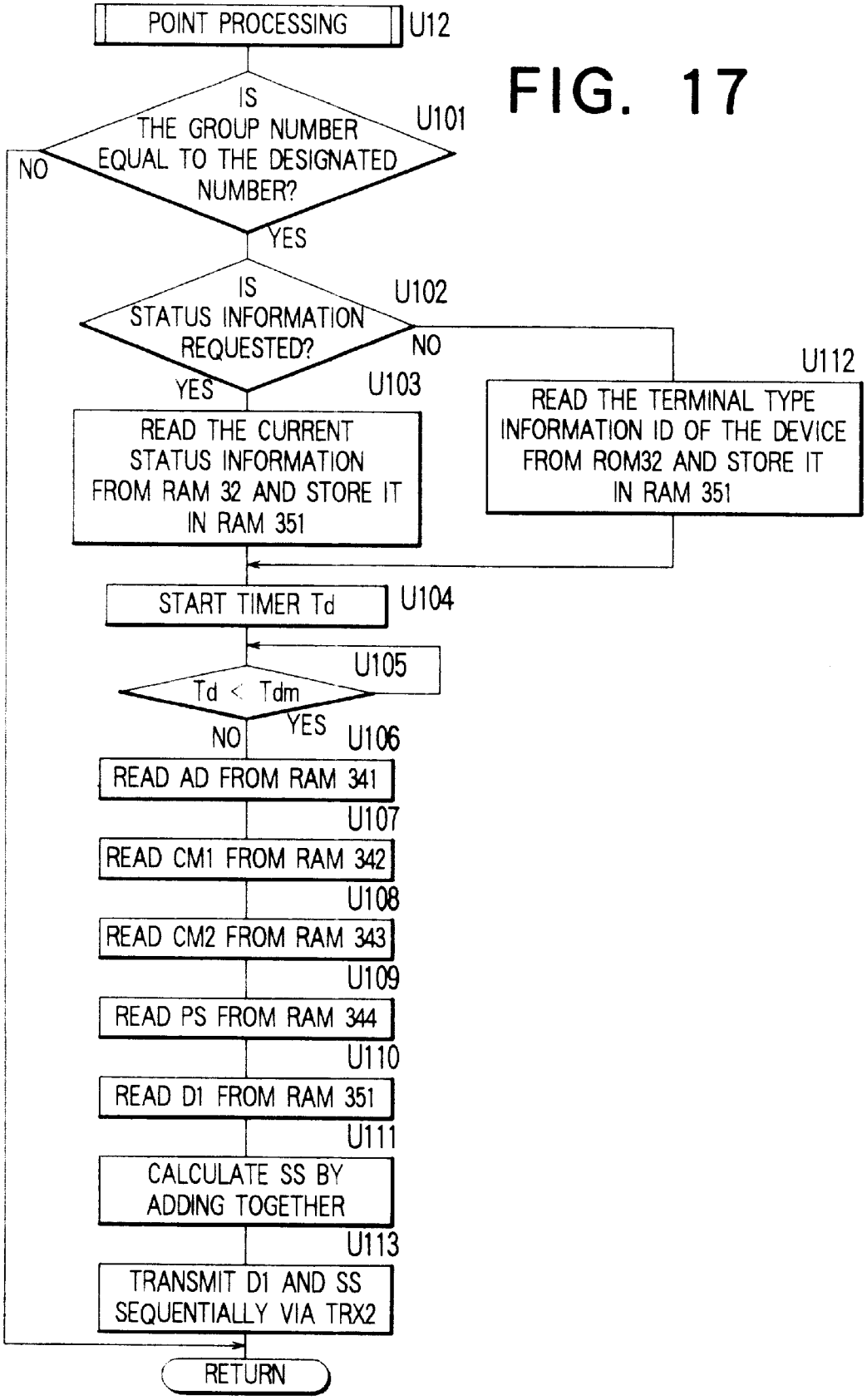
FIG. 17 is a flowchart illustrating the point processing operation of the transmitter RP according to the above embodiment.

FIG. 17 is a flowchart illustrating the point processing operation of the transmitter RP according to the present embodiment.

The microprocessor MPU3 judges whether the group to which the microprocessor MPU3 belongs is called, by comparing the group number of the group to the lower digit of the command CM2 (step U101). If the microprocessor MPU3 concludes that the group to which the microprocessor MPU3 belongs is called, the status information is transmitted to the fire alarming signal receiving device RE as follows.

To determine the specific operation to be performed in the point processing, the microprocessor MPU3 judges whether the received command CM1 is a state information transmission request (step U102). If the received command CM1 is a state information transmission request, the microprocessor MPU3 reads the current status information from RAM 32, and stores it as a returning-back data D1 in the RAM 351 (step U103). Then the microprocessor MPU3 starts the returning-back timing control timer Td (step U104). If the timer Td has already been started (U104), the timer Td is reset and restarted.

The microprocessor MPU3 judges whether the control timer Td indicates that the data transmission start time Tdm has come (step U105). The subscript m of the data transmission start time Tdm indicates the intragroup terminal device number. If it is concluded in step U105 that the control timer Td indicates that the data transmission start time Tdm has come, the codes of the address AD, the command CM1, the command CM2, the primary checksum code PS, and the returning-back data D1 are read from RAM 341–RAM 344 and RAM 351 (steps U106 to U110), and the codes of the address AD, the command CM1, the command CM2, the primary checksum code PS, and the returning-back data D1 are added together thereby obtaining a secondary checksum code SS. The resultant secondary checksum code SS is stored in the RAM 352 (step U111). The returning-back data D1 and the secondary checksum code SS stored in the RAM 351 and RAM 352 are transmitted sequentially via the signal transmitter/receiver TRX1 (step U113).

On the other hand, if the microprocessor MPU3 concludes in step U101 that the lower digit of the command CM2 is not equal to the group number assigned to the group the microprocessor MPU3 belongs to, it concludes that the group the microprocessor MPU3 belongs to is not designated, and thus the process exits from the routine without executing the point processing operation.

If the received command CM1 is not a state information transmission request (CM1≠01 h) (in this case, the received command CM1 must be terminal type indication information transmission request (CM1=00 h)) (step U102), the terminal type indicating information ID of the terminal device stored in ROM 32 is read and stored in the RAM 351, and then steps U104 to U113 are executed. The operation in steps U104 to U113 is performed in a manner similar to the previous case except that instead of the status information the terminal type indicating information ID of the terminal device is transmitted as the returning-back data D1 to the fire alarming signal receiving device RE.

If it is concluded in step U105 that the control timer Td indicates that the data transmission start time Tdm has not come yet, the process waits for the data transmission start time Tdm.

Until the data transmission start time Tdm has come, the process remains in a first waiting field WF1 (in steps U102 to U105) in which the fire alarming signal receiving device RE does nothing to terminal devices. The above first waiting field WF1 provides a good opportunity for the transmitter RP to analyze the data such as a fire alarming signal received from a sensor such as an on-off type fire sensor F connected to the transmitter RP.

Although in the above specific example, the transmitter is taken as an example of a terminal device and the point processing operation thereof is described, the point processing operation may also be performed in a similar manner for other types of terminal devices such as a photoelectric fire sensor or a heat-sensing fire detector. For example, when a photoelectric fire sensor S is employed as a terminal device, the point processing operation is the same except that the status information is acquired in such a manner that a light emitting diode LD connected to a light emitting diode driving circuit LDC periodically emits light in response to clock pulses generated by a clock generator, and a photodiode PD connected to a photo detecting circuit PDC detects the light scattered by smoke thereby detecting the smoke density. The operation is performed in a manner similar to the point processing operation for the transmitter RP except that the status information is acquired.

In the above embodiment, the data transmission start time Tdm is calculated from the intragroup terminal device number m assigned to the terminal device (step U2) wherein the data transmission start time Tdm is set to a later time with the increase in the intragroup terminal device number m of the terminal device (that is, with the distance of the terminal device measured from the fire alarming signal receiving device RE).

In the calculation of the data transmission start time Tdm, a table representing the relationship between the intragroup terminal device number m and the data transmission start time Tdm may be stored in a proper ROM of the terminal device so that the data transmission start time Tdm for the terminal device can be determined by referring to the table. The data transmission start time Tdm is equal to the start time of a corresponding slot generated and used by the fire alarming signal receiving device RE to handle the intragroup terminal number m. The status information of the respective terminal device is transmitted sequentially to the fire alarming signal receiving device in the time slots corresponding to the data transmission start times Tdm assigned to the respective terminal devices.

FIGS. 18 and 19 are flowcharts illustrating the point processing operation of a manual box P as an example of a terminal device used in the present embodiment.

First, initial setting is performed (step U201), and steps U101 to U113 of FIG. 17 are performed in response to the group information acquisition frame. Each manual box P judges whether it is activated in a predetermined time period T1*a* by judging whether the push button switch SW is in a pressed state (step U203). If the push button switch SW is pressed in the predetermined time period T1*a* and the manual box P is activated (U203, U217), it is judged whether a manual box slot generated by the fire alarming signal receiving device has been detected by the terminal device P within a predetermined time period T2*a* (step U204).

On the other hand, if the push button switch SW is not pressed and thus the manual box P is not activated within the predetermined time period T1*a* (U203, U217), the process exits from the routine. In the above operation, the judgement of whether the predetermined time period T1*a* has elapsed or not is made by a timer provided in the RAM 41 used as the work area. This timer is started when the above initial setting is performed. If the timer has already been started before the initial setting, the timer is reset and restarted when the initial setting is performed. The predetermined time periods T2*a* and T3*a* which will be described later are also monitored in a manner similar to the predetermined time period T1*a*.

If a manual box slot generated by the fire alarming signal receiving device has been detected by the terminal device P within the predetermined time period T2*a* (step U204, U218), the number-of-transmitted-bits counter b is set to "7" (in decimal) (step U205). Herein the b-th bit, measured from the least significant bit, of the address of the manual box P is denoted by the "address AD.b" For example, when b=0, the address AD.b represents the least significant bit, and when b=7 the address AD.b represents the most significant bit. As described above, the address of each manual box P is represented by an 8-bit binary number.

If the manual box P detects a manual box calling pulse transmitted from the fire alarming signal receiving device within a predetermined time period T3*a* (steps U206 and U219), the bit timer Tb is started (step U207). Although not illustrated in the figures, it is judged whether the device address of the manual box was transmitted in the previous point polling operation. If the judgement result is positive, the process exits from the routine. This allows the fire alarming signal receiving device RE to detect all manual boxs in activated states by performing the point polling operation repeatedly, wherein one manual box in an activated state is detected in each execution of the point polling operation and thus all activated manual boxs are detected one by one in the order of increasing addresses with the progress of the point polling operation. If the timer Tb indicates that the predetermined time period has elapsed (step U208), the address AD.b is transmitted and the timer is restarted (step U209). If the timer Tb indicates that the predetermined time period has not elapsed yet (step U208), the process waits without doing anything. Herein the "predetermined time period" is equal to the width of a manual box calling pulse. The predetermined time period is provided so that no collision occurs between the manual box calling pulse from the fire alarming signal receiving device RE and the address data transmitted from the manual box P. Therefore, the predetermined time period is also equal to the length in time of one bit (for example $1/2400$ sec). In the case where the manual box P cannot detect a manual box detecting pulse transmitted from the fire alarming signal receiving device RE within the predetermined time period T3*a* (steps U206 and U219), the process exits from the routine.

On the other hand, if the manual box P does not detect the corresponding manual box slot (steps U204 and U218), the process exits from the routine. The manual box P detects a time slot provided for it by judging whether all the slots provided for data transmission in the group information acquisition frame are all completed.

Then the b-th bit, measured from the least significant bit, of the address ADp of the manual box P is transmitted (wherein the address ADp is stored in the RAM 44), and the timer Tb is restarted (step U209). If the above b-th bit, measured from the least significant bit, of the address ADp of the manual box P is "1" (U210, U211), the manual box monitors the signal line over a predetermined time period and determines whether the signal line is at a 0 level or a 1 level (step U214). This means that the manual box P monitors the signal line over the predetermined time period to determine whether the b-th bit, measured from the least significant bit, of the address transmitted over the signal line from another manual box is 0 or 1.

If the signal line remains at a 1 level over the entire predetermined time period (steps U214 and U215), the value of b is decremented by 1 (step U212). On the other hand, if the status of the signal line becomes 0 in the above predetermined time period (that is, another manual box P having an address lower than that of the former manual box), the manual box P concludes that another manual box is transmitting its address (step U214), and the manual box stops transmitting its address (step U216). The above predetermined time period is set for example to a value equal to the width of one bit of address data transmitted by the manual box P (for example 1/2400 sec). During the time period equal to the width of one bit of address data, each bit of an 8-bit binary address data transmitted from each manual box P is compared sequentially.

If the b-th bit, measured from the least significant bit, of the address transmitted from the manual box P of interest is "0" (step U210), the process waits until the timer Tb indicates that the predetermined time period has elapsed (step U211), and the value of b is decremented by 1 (step U212). The above waiting time is provided so that no collision occurs between one bit of the address data transmitted from the manual box P of interest and one bit of the address data transmitted next from the some manual box P.

If b is equal to or greater than 0 (step U213), the transmission of the address ADp of the manual box P is not completed for all bits, and therefore, the above operation (steps U209 to U213) is repeated. If b is smaller than 0 (step U213), the transmission of the address ADp of the manual box P is completed for all bits, and therefore the transmission operation is completed.

The above process (the routine in steps U209 to U213) is performed repeatedly so that the address data ADp of the manual box P is transmitted bit by bit in the order from higher to lower bits wherein the manual box P compares the data to be transmitted with the received data bit by bit and the manual box P stops transmitting its address data if the above comparison result indicates that the manual box P is trying to transmit an active-level bit when another manual box is transmitting an inactive-level bit thereby ensuring that the fire alarming signal receiving device eventually detects the address of only one manual box in an activated state.

As described above with reference to the group information acquisition frame, a check code may be transmitted to the fire alarming signal receiving device RE each time the transmission of the device address of one manual box P is completed so that the fire alarming signal receiving device RE can determine whether the transmission has been performed successfully without an error.

Although in the above specific example each group includes 16 terminal devices, each group may also include a greater or smaller number of terminal devices. Furthermore, although in the above specific example the system includes 16 groups, the system may also include a greater or smaller number of groups.

Furthermore, instead of representing the address of each terminal device in the above manner, the group number may be represented by the lower digit of a 2-digit hexadecimal number and the intragroup terminal device number may be represented by the higher digit. The address is not limited to the expression by a 2-digit number as long as all terminal device can be represented uniquely. For example, an address represented by a plurality of digits is assigned to each of a plurality of terminal devices in such a manner that the group number is represented by certain digits and the intragroup terminal device number is represented by the remaining digits.

Although in the above specific embodiment, when a plurality of manual boxs P generate a fire alarming signal at the same time, the addresses represented by 8-bit binary numbers of the respective manual boxs P are compared with each other bit by bit in the order from higher to lower bits thereby ensuring that the address of the manual box P having the lowest address of those in the activated states is preferentially transmitted to the fire alarming signal receiving device RE, the comparison in terms of the address may also be made in the order from lower to higher bits. In this case, the manual boxs P transmit their own address bit by bit in the order from lower to higher bits, and the addresses represented by 8-bit binary numbers of the respective manual boxs P in activated states are compared with each other bit by bit in the order from lower to higher bits thereby ensuring that the address of one of the manual boxs P in activated states is preferentially transmitted to. the fire alarming signal receiving device RE.

Figure 20:
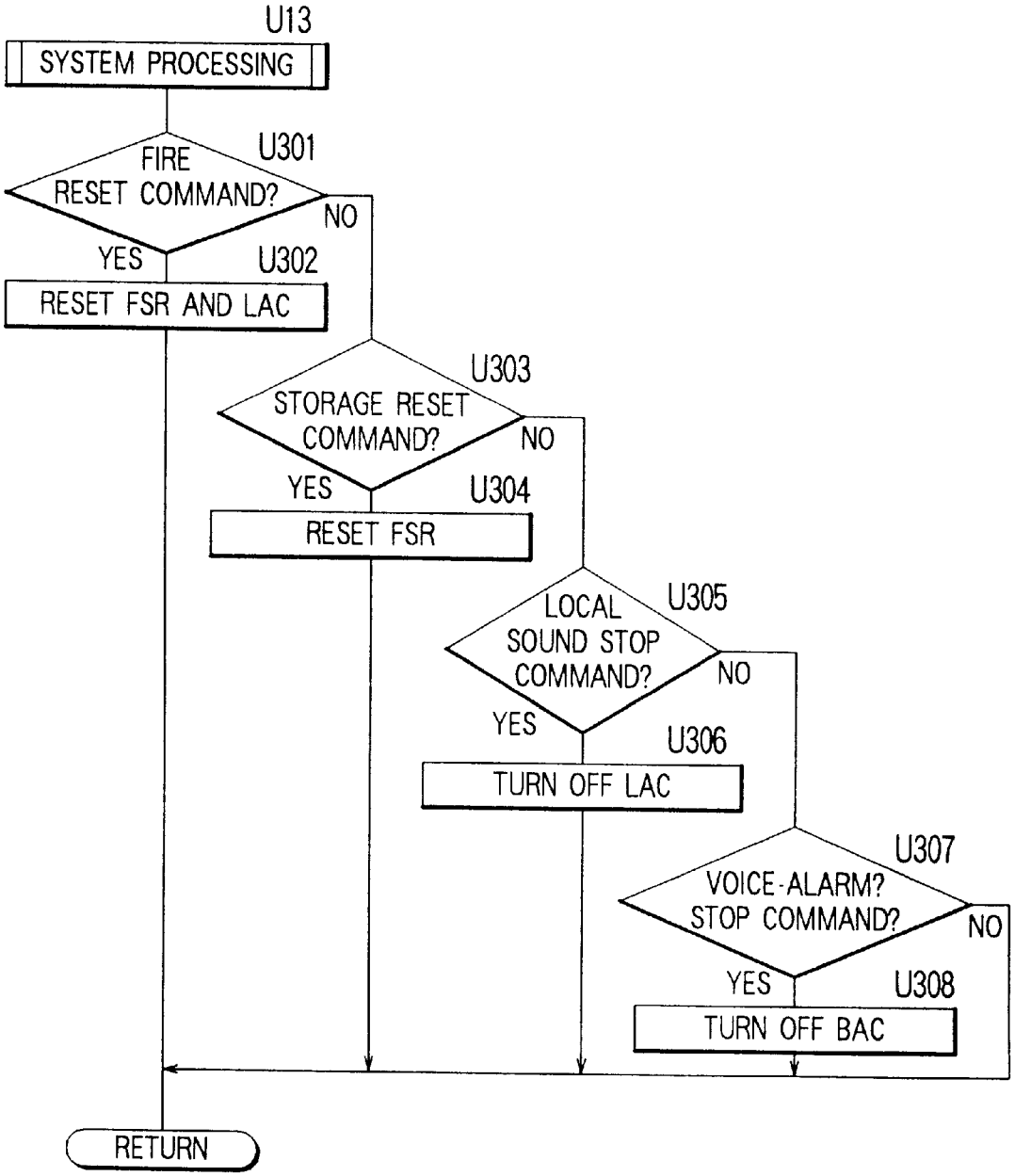
FIG. 20 is a flowchart illustrating the system processing operation (step U13) of the transmitter RP serving as one of terminal devices according to the above embodiment.

FIG. 20 is a flowchart illustrating the system processing operation (step U13) in the transmitter RP as an example of a terminal device used in the present embodiment.

Before starting the system processing operation (step U13), the address AD, the command CM1, the primary checksum code PS stored in the RAM 341, RAM 342, and RAM 344 are transferred to the RAM 361, RAM 362, and RAM 363.

If the command CM1 received by the microprocessor MPU3 is a fire reset command (step U301), the fire alarming signal receiving circuit FSR and the local-area audible-alarm controller LAC are reset and the process exits from the routine. If the command CM1 is not a fire reset command (U301) but a storage reset command (step U303), the fire alarming signal receiving circuit FSR is reset (step U304), and process exits from the routine. If the command CM1 is not a storage reset command (U303) but a local sound stop command (step U305), the local-area audible-alarm controller LAC is turned off (step U306), and the process exits from the routine. If the command CM 1 is not a local sound stop command (step U305) but a voice-alarm stop command (step U307), the voice alarm control circuit BAC is turned off (step U308), and the process exits from the routine. If the command CM 1 is not a voice-alarm stop command (step U307), the process exits from the routine.

The system processing operation for a fire sensor such as a photoelectric fire sensor S is performed in a manner similar to the system processing operation for the transmitter RP described above except that neither the local sound stop command nor the voice-alarm stop command is used in the operation. The system processing operation for a manual box P is performed in a manner similar to the system processing operation for the transmitter RP described above except that the storage reset command, the local sound stop command, and the voice-alarm stop command are not used in the operation.

Figure 21:
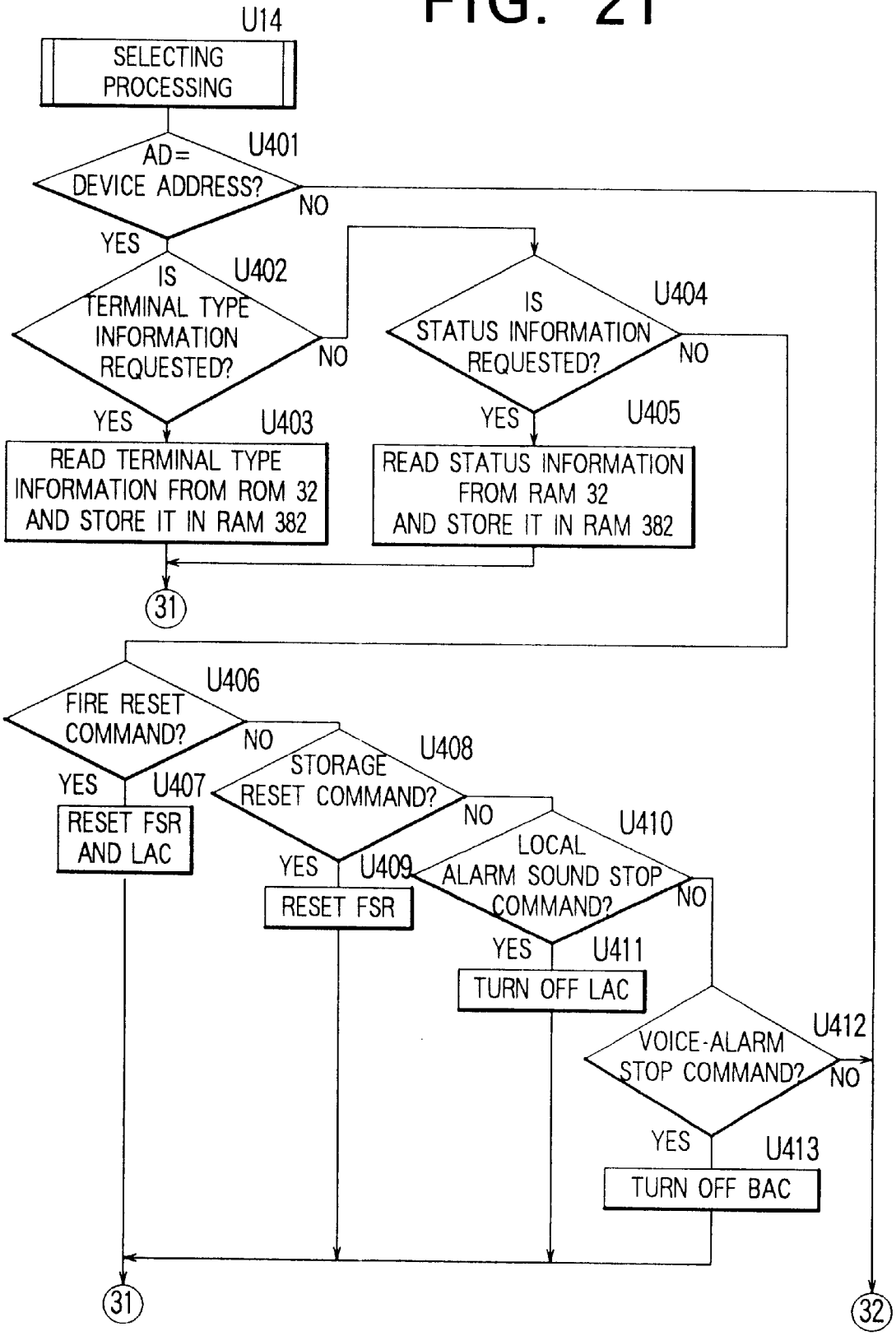
FIG. 21 is a flowchart illustrating the selecting operation (step U14) of the transmitter RP serving as one of terminal devices according to the above embodiment.
Figure 22:
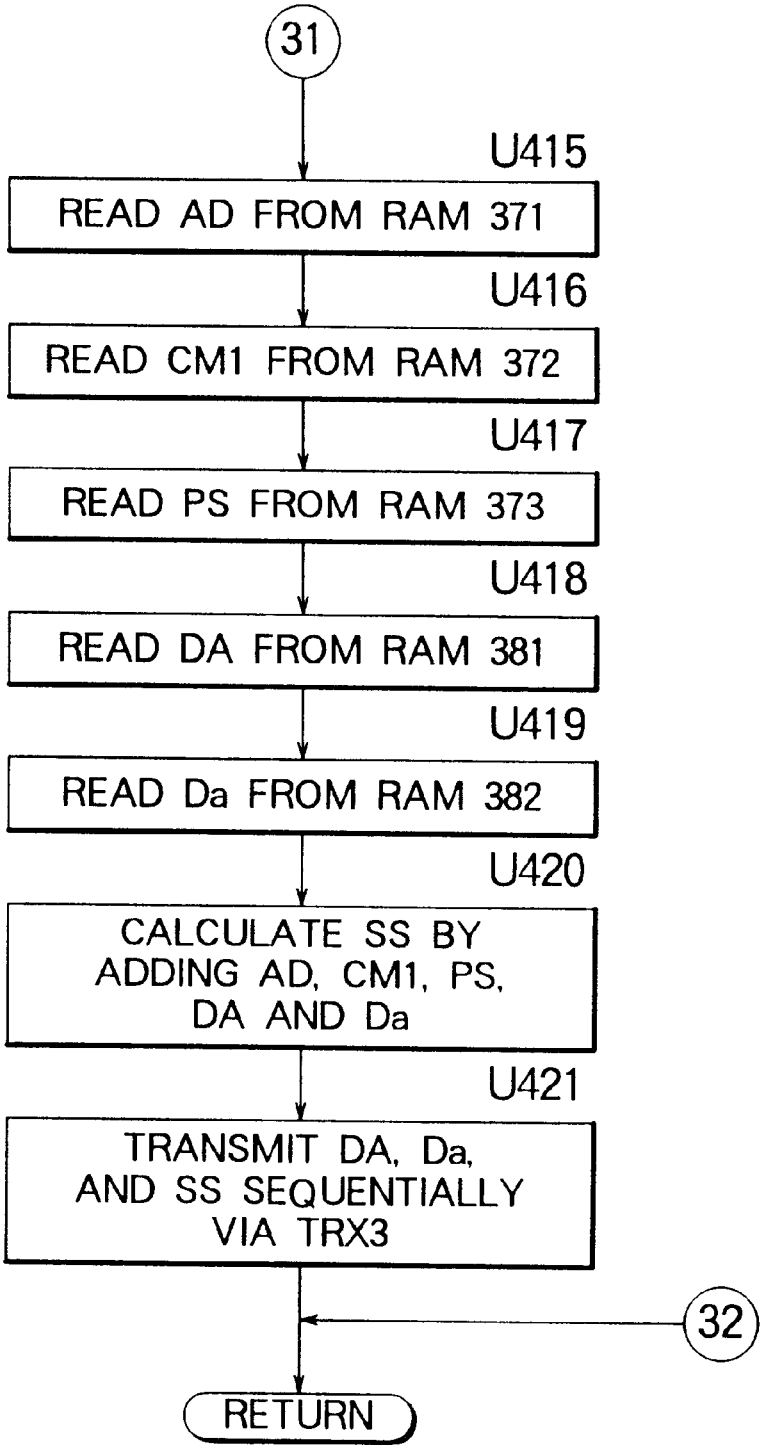
FIG. 22 is also a flowchart illustrating the selecting operation (step U14) of the transmitter RP serving as one of terminal devices according to the above embodiment.

FIGS. 21 and 22 are flowcharts illustrating a specific operation (step U14) in the selecting process for the transmitter taken as an example of a terminal device.

In advance of the selecting processing (step U14), the address AD, the command CM1, and the primary checksum code PS stored in the RAM 341, RAM 342, and RAM 344 are transferred to the RAM 371, RAM 372, and RAM 373.

First, the microprocessor MPU3 judges whether the device address of the transmitter RP is equal to the address AD received (step U401). If the device address of the transmitter RP is equal to the address AD received (step U401), the microprocessor MPU3 concludes that the transmitter RP is designated, and the status information the transmitter RP has is transmitted to the fire alarming signal receiving device RE as follows.

To determine the specific operation to be performed in the selecting processing, the microprocessor MPU3 judges whether the received signal is a terminal type indicating information transmission request (step U402). If the received signal is a terminal type indicating information transmission request (step U402), the terminal type indicating information ID and the device address of the transmitter RP are read from ROM 32 and stored in the RAM 382 and RAM 381, respectively. Then the address AD, the command CM1, the primary checksum code PS, the device address DA, and the returning-back data Da are read from RAM 371, RAM 372, RAM 373, RAM 381, and RAM 382, respectively (steps U415 to U419). The codes of the address AD, the command CM1, the primary checksum code PS, the device address DA, and the returning-back data Da are added together thereby determining a secondary checksum code SS (step U420). The resulting secondary checksum code SS is stored in the RAM 383. The device address DA, the returning-back data Da, and the secondary checksum code SS stored in the RAM 381, RAM 382, and RAM 383 are transmitted sequentially via the signal transmitter/receiver TRX3 (step U421).

If the microprocessor MPU3 concludes in step U402 that the received signal is not a terminal type indicating information transmission request, and further concludes in step U404 that the received signal is a status information transmission request (CM1=01 h), the status information is read from RAM 32 and stored in the RAM 382, and furthermore the device address of the transmitter RP is read from ROM 32 (not shown) and stored in the RAM 382 (step U405). Then steps U415 to U421 are performed. The operation in steps U415 to U421 is performed in a manner similar to the previous case except that instead of the terminal type indicating information the status information is transmitted as the returning-back data Da to the fire alarming signal receiving device RE.

If the microprocessor concludes in step U404 that the received signal is not a status information transmission request, then the microprocessor judges in step U406 whether the received signal is a fire reset command. If the received signal is a fire reset command (U406), the fire alarming signal receiving circuit FSR and the local-area audible-alarm controller LAC are reset (step U407). If the command CM1 is not a fire reset command but a storage reset command (step U408), the fire alarming signal receiving circuit FSR is reset (step U409). If the command CM1 is not a storage reset command but a local sound stop command (step U410), the local-area audible-alarm controller LAC is turned off (step U411). If the command CM1 is not a local sound stop command but a voice-alarm stop command (step U412), the voice alarm control circuit BAC is turned off (step U413). If it is concluded in step U412 that the command CM1 is not a voice-alarm stop command, the process exits from the routine.

In the point polling operation according to the above specific embodiment, the command CM1 designates whether the status information or the terminal type indicating information ID should be transmitted, and the command CM2 designates a specific group. Alternatively, however, the command CM2 may be used to designate whether the status information or the terminal type indicating information ID should be transmitted, and the command CM1 may be used to designate a specific group.

On the other hand, in the system polling operation and also in the selecting operation according to the above specific embodiment, the command CM2 is not used. Alternatively, when the fire alarming signal receiving device RE transmits to a terminal device an indication lamp turn-off command telling that the indication lamp of the fire sensor should be turned off, the fire alarming signal receiving device RE may transmit the command CM1 to indicate that the command is concerned with the control of the indication lamp, and may transmit the command CM2 to indicate that the lamp should be turned off, as well as the address AD and the primary checksum code PS.

Although in the above embodiment, the selecting operation is described for the transmitter RP, the selecting operation for a fire sensor such as a photoelectric fire sensor S may also be performed in a similar manner except that neither the local sound stop command nor the voice-alarm stop command is used in the operation. The selecting operation for a manual box P may also be performed in a similar manner except that the storage reset command, the local sound stop command, and the voice-alarm stop command are not used in the operation.

In the point polling operation according to the above embodiment, the width of time slots used by the fire alarming signal receiving device to receive the status information or the terminal type indicating information as well as the turning-back data D1 and the secondary checksum code SS from the respective terminal devices of one group is set such that the width increases with the intragroup terminal device number m.

Figure 23:
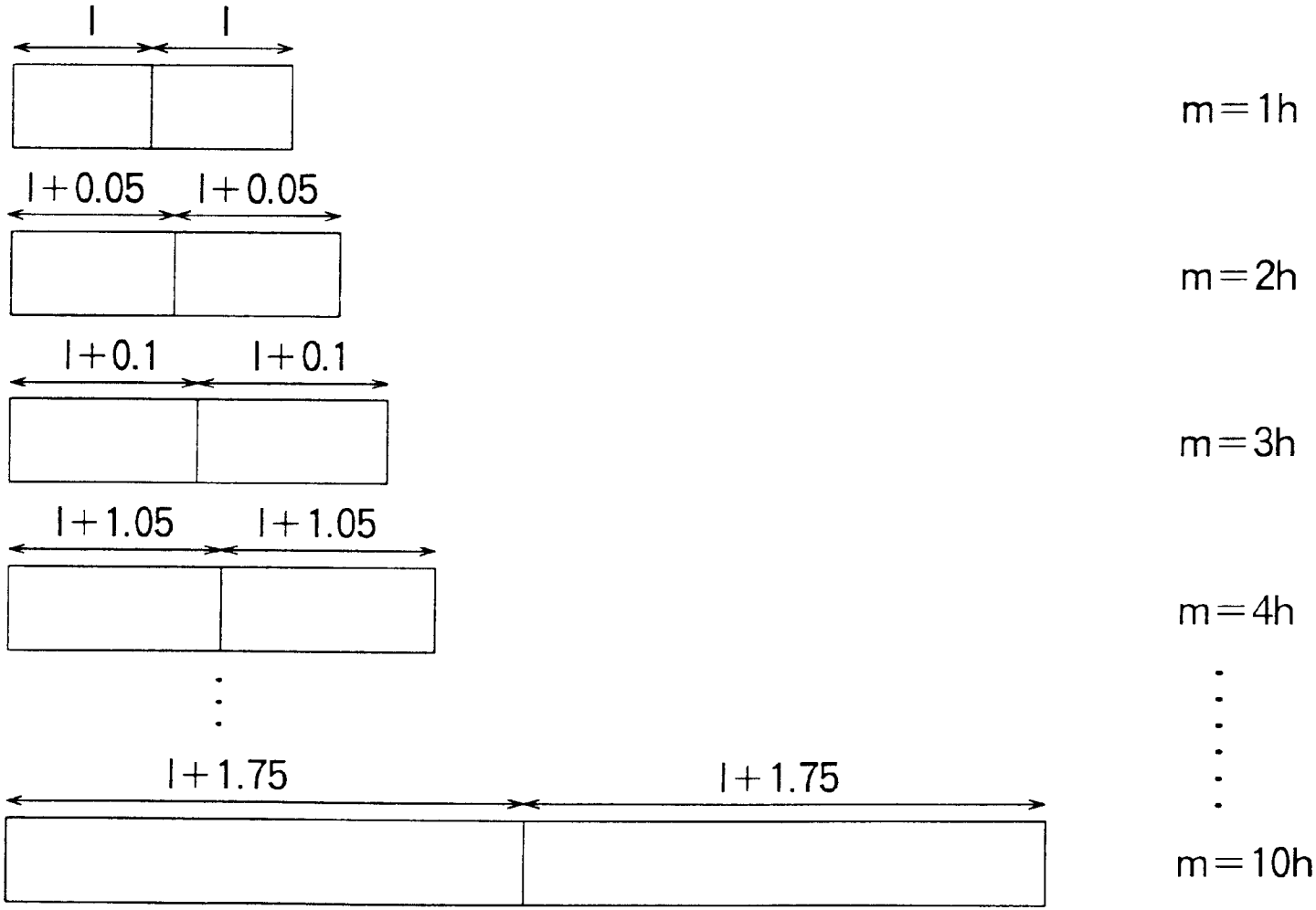
FIG. 23 is a schematic representation of the setting of slot width according to the above embodiment.

By way of example, FIG. 23 illustrates the time slots for group number 1. As can be seen, the slot with increases as the intragroup terminal device number m increases from m=0 h to m=10 h. The clock frequencies of the MPU1, MPU2, MPU3, and MPU4 used in the fire alarming signal receiving device RE or the terminal devices have variations of the order of 1% relative to the specified values. The increasing expansion in the slot width can absorb the deviations in the timing arising from the above variations and thus ensuring that the returning-back data D1 and the secondary checksum code SS can be transmitted from the terminal device to the fire alarming signal receiving device without a failure due to the deviation in the transmission timing.

Furthermore, in the above embodiment, the address AD, the command CM1, and the primary checksum code PS stored in the RAM 341, RAM 342, and RAM 344 are transferred to other RAM s. Instead, the address AD, the command CM1, and the primary checksum code PS may be kept in the RAM 341, RAM 342, and RAM 344 without being transferred, and they may be used in the system processing operation or the selecting operation.

In the above embodiment, it is checked whether an error occurs during the point polling operation. The error checking may also be performed not only in the point polling operation but also in the system polling operation or the selecting operation.

In the above embodiment, the secondary checksum code and the secondary calculation code are calculated using the primary checksum code PS. Alternatively, the secondary checksum code and the secondary calculation code may be calculated without using the primary checksum code PS.

Furthermore, in the above embodiment, when returning-back data and secondary checksum codes are transmitted from two terminal devices such as fire sensors and so on at the same time, if a collision occurs between an active bit of one returning-back data and an inactive bit of the other returning-back data, then the inactive bit can arrive at the fire alarming signal receiving device. Alternatively, however, such the collision may also be handled in such a manner that the fire alarming signal receiving device can receive the active bit.

Figure 24:
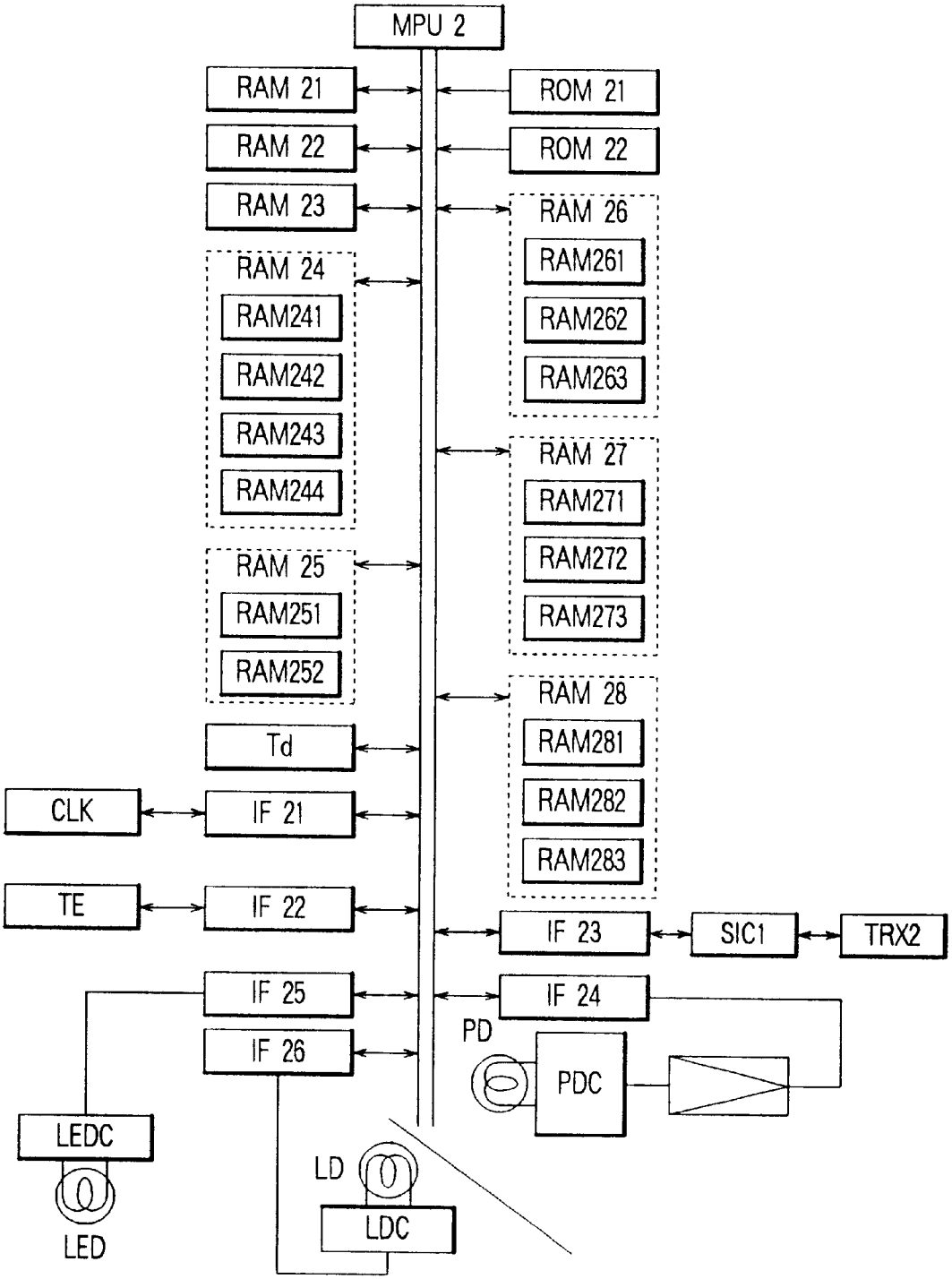
FIG. 24 is a block diagram illustrating a photoelectric fire sensor Sa serving as one of terminal devices according to another embodiment of the invention.

FIG. 24 is a block diagram illustrating a photoelectric fire sensor Sa according to another embodiment of the invention.

Figure 25:
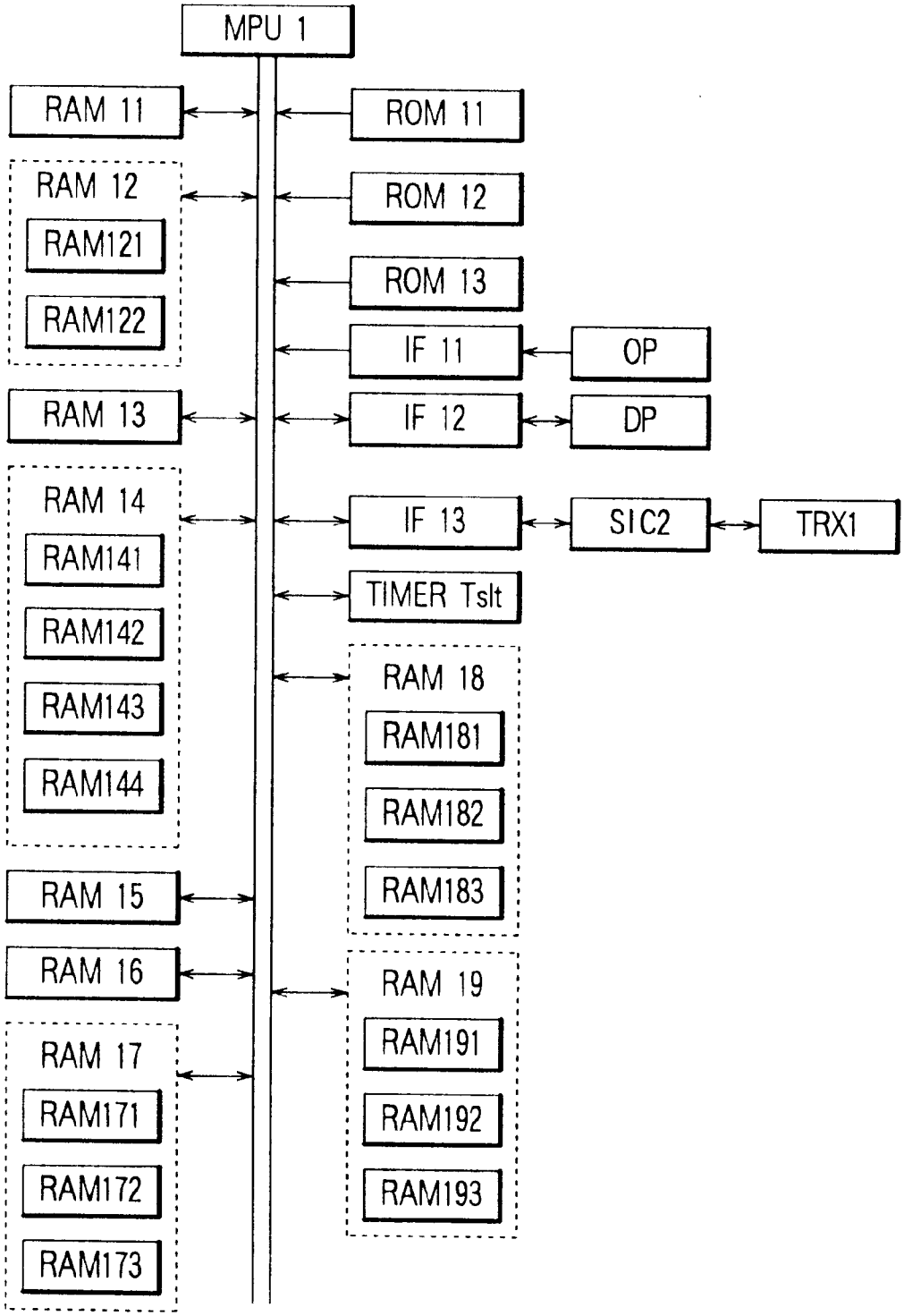
FIG. 25 is a block diagram illustrating a fire alarming signal receiving device REa according to another embodiment of the invention.

FIG. 25 is a block diagram illustrating a fire alarming signal receiving device REa according to still another embodiment of the invention. The photoelectric fire sensor Sa includes a signal inverting circuit SIC1 serving as signal inverting means disposed between an interface IF23 and a signal transmitter/receiver TRX2 wherein the signal inverting circuit SIC1 operates only when a returning-back data or a secondary checksum code is transmitted. On the other hand, the fire alarming signal receiving device REa includes a signal inverting circuit SIC2 serving as signal inverting means disposed between an interface IF13 and a signal transmitter/receiver TRX1 wherein the signal inverting circuit SIC2 operates only in a terminal device field. The signal inverting circuit SIC2 converts an active bit into an inactive bit and converts an inactive bit into an active bit.

Except for the above, other parts are similar to those employed in the previous embodiments. With the above arrangement, an active bit becomes a low-level signal when transmitted from the signal transmitter/receiver TRX1 over the signal line L, and an inactive bit becomes a high-level signal when transmitted from the signal transmitter/receiver TRX1 over the signal line L. On the other hand, a low-level signal on the signal line L is converted to an active bit by the signal inverting circuit SIC2 after output from the signal transmitter/receiver TRX1, and a high-level signal on the signal line L is converted to an inactive bit by the signal inverting circuit SIC2 after output from the signal transmitter/receiver TRX1. If a low-level signal and a high-level signal collide with each other on the signal line L, the results is a high-level signal.

In the fire alarming signal receiving device REa with the above signal inverting circuit SIC2 according to the present embodiment, when an active bit and an inactive bit are transmitted from a plurality of terminal devices at the same time, only the active bit can arrive at the fire alarming signal receiving device.

The point polling operation according to the above embodiment will be described in greater detail below with reference to specific values of various parameters (mainly, S401 to S426, U4 to U12, U101 to U113).

It is assumed here that when the fire sensor Sa detects an event of a fire, the MPU2 of the fire sensor Sa transmits status information D1 having a value of 01 h, while the MPU2 of the fire sensor Sa transmits status information D1 having a value of 00 h when no fire is detected.

It is further assumed that there are provided fire sensors D11 and D22 of the same type as the above fire sensor Sa wherein an equal address 1 is assigned to both fire sensors D11 and D22. Furthermore, the fire sensor D11 is assumed to have detected an event of a fire while the fire sensor D22 is assumed to be in a normal state in which no fire is detected.

The fire alarming signal receiving device REa transmits codes including an address AD, a command CM1, a command CM2, a primary checksum code PS having 2-digit hexadecimal numbers FFh, 01 h, 00 h, and 00 h (11111111, 00000001, 00000000, 00000000 in the form of 8-bit binary numbers), respectively.

The MPU2*a* of the fire sensor D11 transmits a returning-back data D1*a* having a value of 01 h (00000001 in the form of an 8-bit binary number) indicating that a fire has been detected, and also transmits 01 h as the secondary checksum code SS1*a*.

On the other hand, the MPU2*b* of the fire sensor D22 transmits a returning-back data D1*b* having a value of 00 h (00000000 in the form of an 8-bit binary number) indicating that no fire is detected, and also transmits 00 h as the secondary checksum code SS1*b*.

In this embodiment, as described above, when an active bit and an inactive bit are transmitted over the signal line L at the same time (that is, a collision occurs between signals on the signal line L), only the active bit can arrive at the fire alarming signal receiving device REa. Therefore, the fire alarming signal receiving device REa receives 01 h as the returning-back data and 01 h as the secondary checksum code. Thus, the fire alarming signal receiving device REa concludes that a fire is detected by a fire sensor having an address of 1.

Figure 26:
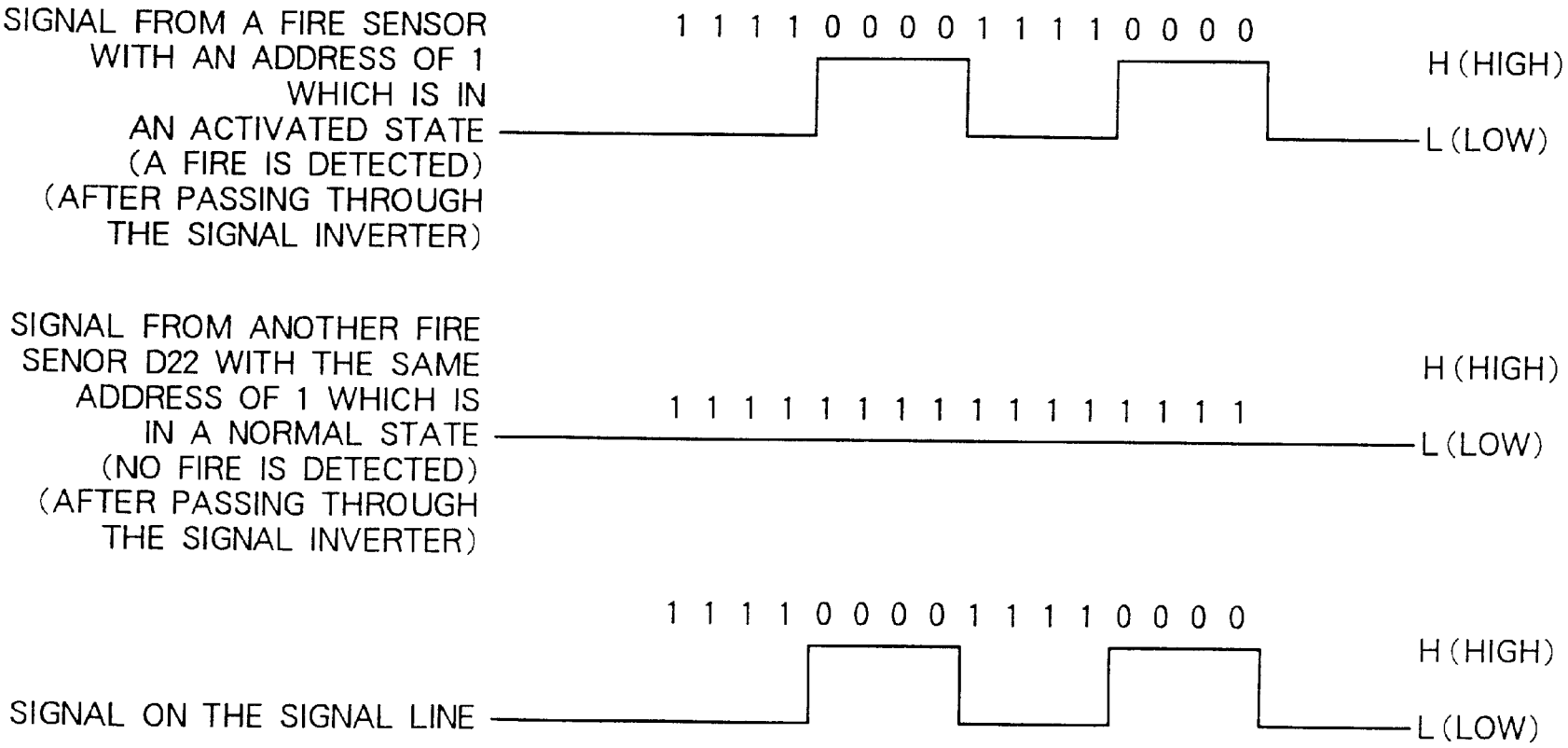
FIG. 26 is a schematic illustration of signals generated by two different fire sensors D11 and D22 as well as a signal on a signal line L, according to the above embodiment of the invention.

FIG. 26 is a schematic illustration of the signals generated by the two fire sensors D11 and D22 as well as the signal on the signal line L.

To avoid the problems in the conventional technique, the checksum may be calculated as follows.

The number of active bits of all codes transmitted over the signal line L is counted, and resultant value is inverted. The most significant bit of the inverted value is removed. The value obtained in this way is employed as the checksum value. In the case of the selecting operation, the maximum possible number of active bits is 8×4+8×3=56.

For example, when the address AD=FFh, the command CM1=01 h, the command CM2=03 h, and the returning-back data D1=07 h, the address AD=FFh can be represented as "11111111" in binary form, and thus the number of active bits is 8 which can be represented as 8 h in hexadecimal form. Similarly, the command CM1=01 h can be represented as "0000001" in binary form, and thus the number of active bits is 1 which can be represented as 1 h in hexadecimal form. The command CM2=03 h can be represented as "0000011" in binary form, and thus the number of active bits is 2 which can be represented as 2 h in hexadecimal form.

Adding the numbers of active bits of the address AD, the command CM1, and the command CM2 results in 8 h+1 h+2 h=0 Bh which can be represented as "00001011" in binary form. If this value is inverted, then the result is "11110100" which can be represented as F4 h in hexadecimal form. If the most significant bit of "11110100", which is a binary representation of F4 h, is removed, the result is "01110100" which can be represented as 74 h in hexadecimal form. Thus, 74 h is employed as the secondary checksum code SS.

The removal of the most significant bit of "11110100" (F4 h in hexadecimal form) can be accomplished by performing an AND operation between "11110100" (F4 h) and "01111111" (7 Fh).

Since the primary checksum code PS having a value of 74 h obtained in the above-described manner can be represented as "01110100", the number of active bits is 4 which can be represented as 4 h in hexadecimal form.

On the other hand, the returning-back data D1=07 h can be represented as "00000111" in binary form, and thus the number of active bits is 3 which can be represented as 3 h in hexadecimal form.

If the numbers of active bits of the address AD, the command CM1, the command CM2, and the primary checksum code PS1, and the returning-back data D1, then the result is 8 h+1 h+2 h+4 h+3 h=12 h, which can be represented as "00010010" in binary form. Thus, "11101101" is obtained as an inverted form. This can be represented as EDh in hexadecimal form. If the most significant bit of "11101101" (EDh) is removed, then the result is "01101101" which can be represented as 6 Dh in hexadecimal form. Thus, 6 Dh is employed as the secondary checksum code SS.

In the above embodiment of the invention, the fire alarming signal receiving device RE includes: first active bit counting means for counting the number of active bits contained in an address code and a command code to be transmitted to the terminal devices, the number of active bits being counted separately for each code; first number-of-active-bits adding means for determining the sum of the numbers of active bits by adding together the respective numbers of active bits counted by the first active bit counting means; first inverting means for determining an inverted value by inverting the sum of the numbers of active bits given by the first number-of-active-bits adding means; primary sum code generating means for generating a primary sum code by removing the most significant bit of the inverted value given by the first inverting means; and first transmission means for transmitting the address code, the command code, and the primary sum code.

Furthermore, in the above embodiment of the invention, each terminal device includes: second active bit counting means for counting the number of active bits contained in the address code and the command code received from the fire alarming signal receiving device, the number of active bits being counted separately for each code; second number-of-active-bits adding means for determining the sum of the numbers of active bits by adding together the respective numbers of active bits counted by the second active bit counting means; second inverting means for determining an inverted value by inverting the sum of the numbers of active bits given by the second number-of-active-bits adding means; first sum code generating means for generating a first sum code by removing the most significant bit of the inverted value given by the second inverting means; first judgment means for judging whether the first sum code is equal to the primary sum code received from the fire alarming signal receiving device; third active bit counting means for counting the number of active bits contained in a returning-back data to be returned to the fire alarming signal receiving device, the address code received from the fire alarming signal receiving device, and the command code received from the fire alarming signal receiving device, the number of active bits being counted separately for the data or each code, the number of active bits being counted when the first sum code is equal to the primary sum code; third number-of-active-bits adding means for determining the sum of the numbers of active bits by adding together the respective numbers of active bits counted by the third active bit counting means; third inverting means for determining an inverted value by inverting the sum of the numbers of active bits given by the third number-of-active-bits adding means; secondary sum code generating means for generating a secondary sum code by removing the most significant bit of the inverted value given by the third inverting means; and second transmission means for transmitting the returning-back data and the secondary sum code to the fire alarming signal receiving device.

The fire alarming signal receiving device RE further includes: fourth active bit counting means for counting the number of active bits contained in the returning-back data received from any of the terminal devices, the address code to be transmitted to the terminal device, and the command code to be transmitted to the terminal device, the number of active bits being counted separately for the data or each code; fourth number-of-active-bits adding means for determining the sum of the numbers of active bits by adding together the respective numbers of active bits counted by the fourth active bit counting means; fourth inverting means for determining an inverted value by inverting the sum of the numbers of active bits given by the fourth number-of-active-bits adding means; second sum code generating means for generating a second sum code by removing the most significant bit of the inverted value given by the fourth inverting means; and second judgment means for judging whether the second sum code is equal to the secondary sum code received from the terminal device.

Furthermore, in the above embodiment, said third active bit counting means also counts the number of active bits contained in the primary sum code; and said fourth active bit counting means also counts the number of active bits contained in the primary sum code.

In the above embodiment of the invention, the terminal devices can transmit a fire alarm signal to the fire alarming signal receiving device without encountering an error even when an equal address is assigned to different terminal devices. Furthermore, it is possible to detect an event of such an error.

In the above embodiment, the primary checksum code PS is an example of the above-described primary sum code, and the secondary checksum code SS is an example of the secondary sum code. The primary calculation code SC1 is an example of the above-described primary sum code. The secondary calculation code SC2 is an example of the above-described secondary sum code.

Although in the above embodiment, the photoelectric fire sensor Sa is taken as an example of a terminal device, the invention may also be applied to other types of fire sensors such as those of the heat sensing type, flame sensing type, gas sensing type, and smell sensing type.

Furthermore, a signal inverting circuit may be added to the signal transmitter/receivers TRX1 and TRX2.

What is claimed is:

1. A fire alarm system in which a fire alarm signal receiving device polls a plurality of terminal devices such as fire sensors, transmitters, manual boxes, and/or other controlled devices, thereby acquiring terminal device information from said terminal devices, making decisions, displaying information, and/or controlling said terminal devices, wherein said fire alarm signal receiving device comprises:

first active bit counting means for counting the number of active bits contained in an address code and a command code to be transmitted to said terminal devices, said number of active bits being counted separately for each code;

first number-of-active-bits adding means for determining the sum of the numbers of active bits by adding together the respective numbers of active bits counted by said first active bit counting means;

first inverting means for determining an inverted value by inverting the sum of the numbers of active bits given by said first number-of-active-bits adding means;

primary sum code generating means for generating a primary sum code by removing the most significant bit of said inverted value given by said first inverting means; and first transmission means for transmitting said address code, said command code, and said primary sum code;

each of said terminal devices comprises:

second active bit counting means for counting the number of active bits contained in said address code and said command code received from said fire alarm signal receiving device, said number of active bits being counted separately for each code;

second number-of-active-bits adding means for determining the sum of the numbers of active bits by adding together the respective numbers of active bits counted by said second active bit counting means;

second inverting means for determining an inverted value by inverting the sum of the numbers of active bits given by said second number-of-active-bits adding means;

first sum code generating means for generating a first sum code by removing the most significant bit of said inverted value given by said second inverting means;

first judgment means for judging whether said first sum code is equal to said primary sum code received from said fire alarming signal receiving device;

third active bit counting means for counting the number of active bits contained in a return-back data to be returned to said fire alarm signal receiving device, said address code received from said fire alarm signal receiving device, and said command code received from said fire alarm signal receiving device, said number of active bits being counted separately for said data or each code, said number of active bits being counted when said first sum code is equal to said primary sum code;

third number-of-active-bits adding means for determining the sum of the numbers of active bits by adding together the respective numbers of active bits counted by said third active bit counting means;

third inverting means for determining an inverted value by inverting the sum of the numbers of active bits given by said third number-of-active-bits adding means;

secondary sum code generating means for generating a secondary sum code by removing the most significant bit of said inverted value given by said third inverting means; and second transmission means for transmitting said return-back data and said secondary sum code to said fire alarm signal receiving device; and said fire alarm signal receiving device further comprises:

fourth active bit counting means for counting the number of active bits contained in the return-back data received from any of said terminal devices, said address code to be transmitted to said terminal device, and said command code to be transmitted to said terminal device, said number of active bits being counted separately for said data or each code;

fourth number-of-active-bits adding means for determining the sum of the numbers of active bits by adding together the respective numbers of active bits counted by said fourth active bit counting means;

fourth inverting means for determining an inverted value by inverting the sum of the numbers of active bits given by said fourth number-of-active-bits adding means;

second sum code generating means for generating a second sum code by removing the most significant bit of said inverted value given by said fourth inverting means; and second judgment means for judging whether said second sum code is equal to said secondary sum code received from said terminal device.

2. A fire alarm system according to claim 7 wherein:

said third active bit counting means also counts the number of active bits contained in said primary sum code; and said fourth active bit counting means also counts the number of active bits contained in said primary sum code.

3. A fire alarm system comprising a fire alarm signal receiving device and a plurality of terminal devices wherein:

said fire alarm signal receiving device includes:

primary sum code generating means for generating a primary sum code by adding together an address code and a command code to be transmitted to said terminal devices; and first transmission means for transmitting said address code, said command code, and said primary sum code;

each of said terminal devices includes:

first sum code generating means for generating a first sum code by adding together said address code and said command code received from said fire alarm signal receiving device;

first judgement means for judging whether said first sum code is equal to said primary sum code received from said fire alarm signal receiving device;

secondary sum code generating means for generating a secondary sum code by adding together return-back data to be returned to said fire alarm signal receiving device, said address code received from said fire alarm signal receiving device, said command code received from said fire alarm signal receiving device, and said primary sum code received from said fire alarm signal receiving device, said secondary sum code being generated when said first sum code is equal to said primary sum code; and second transmission means for transmitting said return-back data and said secondary sum code to said fire alarm signal receiving device; and said fire alarm signal receiving device further includes:

second sum code generating means for generating a second sum code by adding together said return-back data received from said terminal device, said address code to be transmitted to said terminal device, said command code to be transmitted to said terminal device, and said primary sum code to be transmitted to said terminal device; and second judgement means for judging whether said second sum code is equal to said secondary sum code received from said terminal device.

4. A fire alarm system comprising a fire alarm signal receiving device and a plurality of terminal devices, wherein:

said fire alarm signal receiving device includes:

primary sum code generating means for generating a primary sum code by adding together an address code and a command code to be transmitted to said terminal devices; and first transmission means for transmitting said address code, said command code, and said primary sum code;

each of said terminal devices includes:

first sum code generating means for generating a first sum code by adding together said address code and said command code received from said fire alarm signal receiving device;

first judgement means for judging whether said first sum code is equal to said primary sum code received from said fire alarm signal receiving device;

secondary sum code generating means for generating a secondary sum code by adding together return-back data to be returned to said fire alarm signal receiving device, said address code received from said fire alarm signal receiving device, and said command code received from said fire alarm signal receiving device, said secondary sum code being generated when said first sum code is equal to said primary sum code; and second transmission means for transmitting said re-back data and said secondary sum code to said fire alarm signal receiving device; and said fire alarm signal receiving device further includes:

second sum code generating means for generating a second sum code by adding together said return-back data received from said terminal device, said address code to be transmitted to said terminal device, and said command code to be transmitted to said terminal device; and second judgement means for judging whether said second sum code is equal to said secondary sum code received from said terminal device.

5. A fire alarm system comprising: a plurality of terminal devices including fire sensors. transmitters. manual boxes, and/or other controlled devices; and a receiving device to which said plurality of terminal devices are connected;

wherein said plurality of terminal devices are divided into a plurality of groups;

said receiving device transmits common return-back instructions to the terminal devices belonging to said divided groups; and in a time period between the transmission of common return-back instructions to one group and the transmission of common return-back instructions to the terminal devices belonging to a next group, a plurality of time slots which correspond to the number of at least the terminal devices belonging to said one group are provided, and state information of each of the terminal devices belonging to said one group is returned to said receiving device in a time slot allocated to each terminal device;

wherein the width of each of said time slots is set such that said time slot width increases with the start time of said time slots provided in the time period between the transmission of common return-back instructions to a particular group of said plurality of groups and the transmission of common return-back instructions to the next group.

6. A fire alarm system comprising: a plurality of terminal devices including fire sensors, transmitters, manual boxes, and/or other controlled devices; and a receiving device to which said plurality of terminal devices are connected;

wherein said plurality of terminal devices are divided into a plurality of groups;

said receiving device transmits common return-back instructions to the terminal devices belonging to said divided groups; and in a time period between the transmission of common return-back instructions to one group and the transmission of common return-back instructions to the terminal devices belonging to a next group, a plurality of time slots which correspond to the number of at least the terminal devices belonging to said one group are provided, and state information and sum check data of each of the terminal devices belonging to said one group are returned to said receiving device in a time slot allocated to each terminal device;

wherein an address consisting of a plurality of digits is assigned to each of said plurality of terminal devices;

a certain plurality of digits of said address assigned to each terminal device define the group number of a group that said terminal device belongs to; and the remaining digits of said address define the terminal device number within the group having said group number.

* * * * *